US011081793B2

(12) United States Patent
Sano

(10) Patent No.: US 11,081,793 B2
(45) Date of Patent: Aug. 3, 2021

(54) ANTENNA APPARATUS

(71) Applicant: KABUSHIKI KAISHA TOSHIBA, Minato-ku (JP)

(72) Inventor: Makoto Sano, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 16/817,471

(22) Filed: Mar. 12, 2020

(65) Prior Publication Data

US 2020/0411983 A1 Dec. 31, 2020

(30) Foreign Application Priority Data

Jun. 28, 2019 (JP) ..... JP2019-121892

(51) Int. Cl.
*H01Q 3/36* (2006.01)

(52) U.S. Cl.
CPC ..... *H01Q 3/36* (2013.01)

(58) Field of Classification Search
CPC ..... H01Q 3/36; H01Q 3/30; H01Q 3/40
See application file for complete search history.

(56) References Cited

U.S. PATENT DOCUMENTS 5,223,848 A * 6/1993 Rammos ..... H01Q 9/0407 343/700 MS
10,218,426 B1 2/2019 Sano et al.
2017/0187099 A1* 6/2017 Patel ..... H01Q 3/40
2017/0310018 A1* 10/2017 Zimmerman ..... H01Q 21/22
2018/0206199 A1* 7/2018 Harel ..... H04W 52/346
2019/0394073 A1 12/2019 Sano
2020/0335880 A1 10/2020 Sano
2020/0411962 A1* 12/2020 Lindmark ..... H01Q 21/06
2021/0083397 A1* 3/2021 Gottl ..... H01Q 3/36

FOREIGN PATENT DOCUMENTS

JP 3319665 B2 9/2002
JP 2019-50521 A 3/2019
JP 2019-220861 A 12/2019
JP 2020-178254 A 11/2020

* cited by examiner

*Primary Examiner* — Lam T Mai
(74) *Attorney, Agent, or Firm* — Oblon, McClelland, Maier & Neustadt, L.L.P.

(57) ABSTRACT

According to one embodiment, an antenna device includes first to fourth phase shifters to shift phases of first and second left-hand circularly polarized wave signals and first and second right-hand circularly polarized wave signals. The control circuit determines first to fourth phase shift amounts in the first to fourth phase shifters based on a polarization angle and a radiation direction of a radio wave to be radiated. The first radiation element radiates a first left-hand circularly polarized wave in response to the first left-hand circularly polarized wave signal shifted and a first right-hand circularly polarized wave in response to the first right-hand circularly polarized wave signal shifted. The second radiation element radiates a second left-hand circularly polarized wave in response to the second left-hand circularly polarized wave signal shifted and a second right-hand circularly polarized wave in response to the second right-hand circularly polarized wave signal shifted.

20 Claims, 30 Drawing Sheets

ANTENNA APPARATUS

CROSS REFERENCE TO RELATED APPLICATIONS

This application is based upon and claims the benefit of priority from the prior Japanese Patent Application No. 2019-121892, filed on Jun. 28, 2019, the entire contents of which are incorporated herein by reference.

FIELD

Embodiments described herein relate to an antenna apparatus.

BACKGROUND

An antenna device is provided with an antenna element that transmits and receives a right-hand circularly polarized wave and a left-hand circularly polarized wave and phase shifters that shift a phase of a signal of the right-hand circularly polarized wave and a phase of a signal of the left-hand circularly polarized wave. Polarization planes need to be matched between a transmitting side and a receiving side for favorable communication, and therefore the antenna device may change angles of the polarization planes. The antenna device may change directions in which the right-hand circularly polarized wave and the left-hand circularly polarized wave are transmitted. As such antenna devices, it is desirable to use devices capable of changing the angles of polarization planes and transmission/reception directions of the polarized waves by controlling phase shift amounts of the phase shifters.

DETAILED DESCRIPTION

Figure 1:
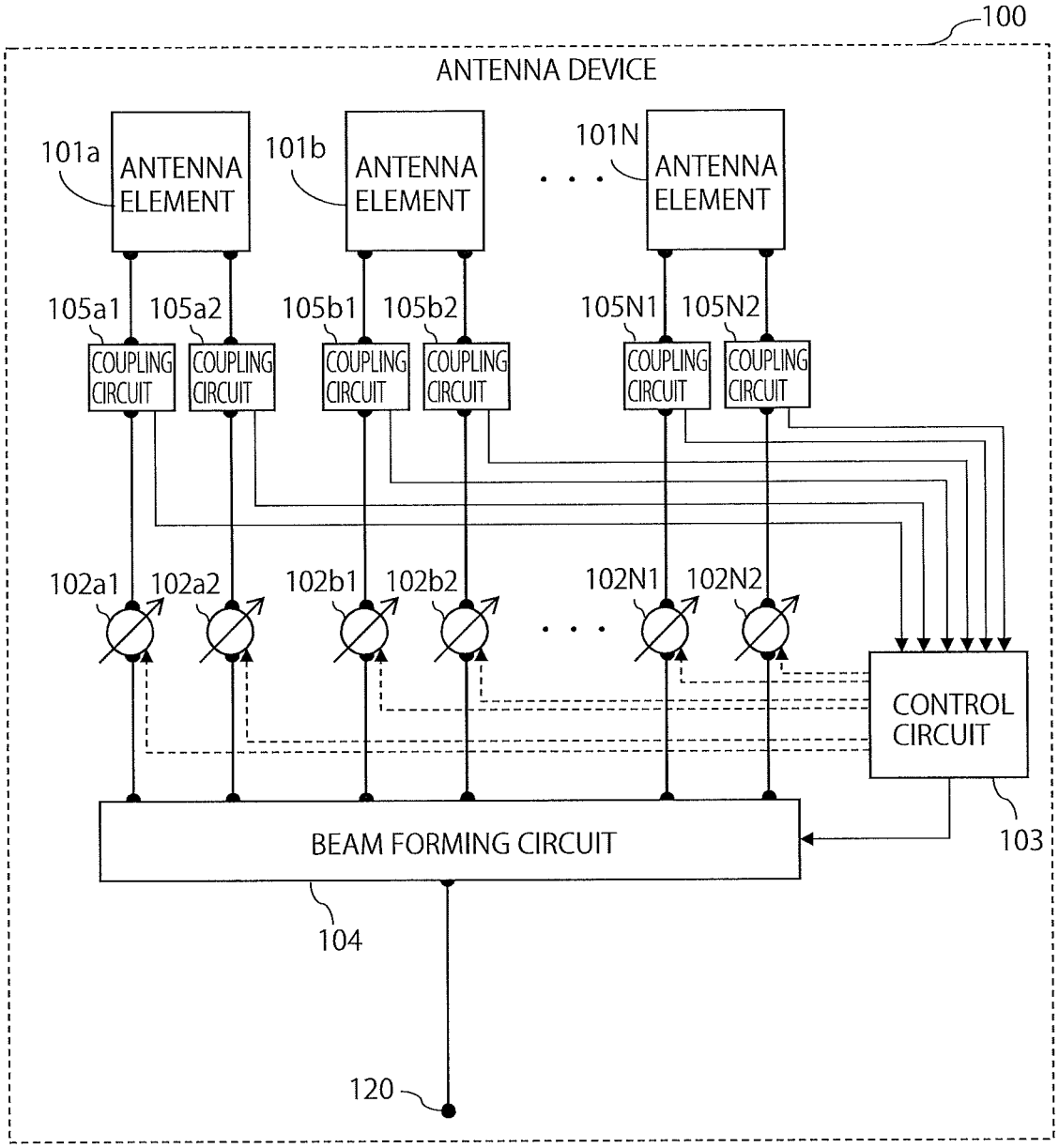
FIG. 1 is a configuration diagram of an antenna device 100 according to a first embodiment.

According to one embodiment, an antenna device includes a first phase shifter configured to shift a phase of a first left-hand circularly polarized wave signal indicating a left-hand circularly polarized wave; a second phase shifter configured to shift a phase of a second left-hand circularly polarized wave signal indicating a left-hand circularly polarized wave; a third phase shifter configured to shift a phase of a first right-hand circularly polarized wave signal indicating a right-hand circularly polarized wave; and a fourth phase shifter configured to shift a phase of a second right-hand circularly polarized wave signal indicating a right-hand circularly polarized wave; a control circuit; a first radiation element; and a second radiation element.

The control circuit determines a first phase shift amount in the first phase shifter, a second phase shift amount in the second phase shifter, a third phase shift amount in the third phase shifter and a fourth phase shift amount in the fourth phase shifter based on a polarization angle and a radiation direction of a radio wave to be radiated.

The first radiation element radiates a first left-hand circularly polarized wave in response to the first left-hand circularly polarized wave signal shifted by the first phase shifter and a first right-hand circularly polarized wave in response to the first right-hand circularly polarized wave signal shifted by the third phase shifter.

The second radiation element radiates a second left-hand circularly polarized wave in response to the second left-hand circularly polarized wave signal shifted by the second phase shifter and a second right-hand circularly polarized wave in response to the second right-hand circularly polarized wave signal shifted by the fourth phase shifter.

Hereinafter, embodiments for implementing the present invention will be described with reference to the accompanying drawings. This disclosure is only an example and the invention will not be limited by contents described in the following embodiments. Modifications easily conceivable by those skilled in the art are naturally included within the scope of the disclosure. To further clarify the description, sizes, shapes or the like of parts in the drawings may be changed with respect to the actual embodiments and may be schematically shown. Corresponding components in a plurality of drawings are assigned identical reference numerals and detailed description may be omitted.

First Embodiment

FIG. 1 is a diagram illustrating a configuration of an antenna device 100 according to a first embodiment. The antenna device 100 is an antenna device that performs communication by transmitting and receiving a left-hand circularly polarized wave and a right-hand circularly polarized wave. The antenna device 100 radiates and thereby transmits the left-hand circularly polarized wave and the right-hand circularly polarized wave. The antenna device 100 can shift phases (hereinafter also referred to as "phase shift") of a high frequency signal representing the left-hand circularly polarized wave (hereinafter also referred to as "left-hand circularly polarized wave signal") and a high frequency signal representing the right-hand circularly polarized wave (hereinafter also referred to as "right-hand circularly polarized wave signal"). Phase shifts of the left-hand circularly polarized wave signal and the right-hand circularly polarized wave signal are performed by phase shifters provided for the antenna device 100. It is possible to change angle of polarization planes by controlling phase shift amounts of the phase shifters.

The antenna device 100 is provided with N (N is 2 or more) antenna elements 101*a*, 101*b*, . . . , 101N (hereinafter also referred to as "antenna elements 101*a* to 101N") and 2N phase shifters 102*a*1, 102*a*2, 102*b*1, 102*b*2, . . . , 102N1 and 102N2 corresponding to the respective antenna elements. The phase shifters 102*a*1, 102*b*1, . . . , 102N1 (hereinafter also referred to as "phase shifters 102*a*1 to 102N1") shift phases of the left-hand circularly polarized wave signals. The phase shifters 102*a*2, 102*b*2, . . . , 102N2 (hereinafter also referred to as "phase shifters 102*a*2 to 102N2") shift phases of the right-hand circularly polarized wave signals.

The phase shifters 102*a*1 to 102N1 shift phases of the left-hand circularly polarized wave signals respectively and the phase shifters 102*a*2 to 102N2 shift phases of the right-hand circularly polarized wave signals respectively. The antenna elements 101*a* to 101N respectively transmit and receive the left-hand circularly polarized waves and right-hand circularly polarized waves and thereby transmit and receive linearly polarized waves with any (freely-selected) polarization angle $\tau$.

The antenna device 100 controls phase shift amounts of the respective phase shifters, and can thereby change directions in which the left-hand circularly polarized waves and right-hand circularly polarized waves are transmitted and received (hereinafter also referred to as "beam direction D"). The directions in which the polarized waves are received mean directions from which the left-hand circularly polarized waves and right-hand circularly polarized waves arrive.

In the present embodiment, the phase shifters control both the any polarization angle $\tau$ and the any beam direction D. By so doing, it is possible to reduce components corresponding to the any beam direction D and achieve labor saving, miniaturization and improvement of productivity of the antenna device.

Figure 2:
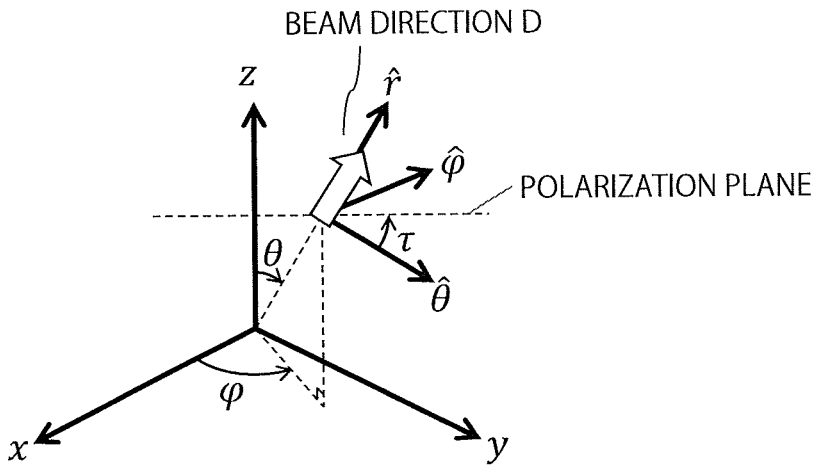
FIG. 2 is a diagram for describing a polarization plane and a beam direction.

The beam direction D, polarization plane, and polarization angle $\tau$ will be described using FIGS. 2 to 4. FIG. 2 illustrates a beam direction D and a polarization plane. The beam direction D is represented by $\theta$ and $\varphi$. The polarization plane represents a vibration plane of a transmitted or received polarized wave and is represented by a $\theta$ hat, $\varphi$hat or r hat. The $\theta$ hat represents a symbol with "^" on the top of $\theta$, the $\varphi$ hat represents a symbol with "^" on the top of $\varphi$, and the r hat represents a symbol with "^" on the top of r. Hereinafter, these symbols will be represented in the like manner. The beam direction D corresponds to the r hat. The angle formed between this polarization plane and the $\theta$ hat axis is referred to as a "polarization angle" and is represented by $\tau$.

The beam direction D will be described. The left-hand circularly polarized wave and the right-hand circularly polarized wave transmitted and received by the antenna device 100 vary in intensity depending on their directions. The intensity that varies depending on the direction is also referred to as "directivity." The beam direction represents a direction in which the directivity reaches maximum (including "quasi-maximum" defined in the antenna device 100). As an example, FIG. 3 shows a change in directivity by $\theta$ at a specific $\varphi$ (e.g., $\varphi_1$). In the present embodiment, the beam direction D corresponds to $\theta$ and $\varphi$ at which the directivity reaches a maximum value. For example, in FIG. 3, a beam direction $D_1$ is represented in association with $\theta_1$ and $\varphi_1$. Note that the maximum value is assumed to include a quasi-maximum value defined in the antenna device 100.

Figure 3:
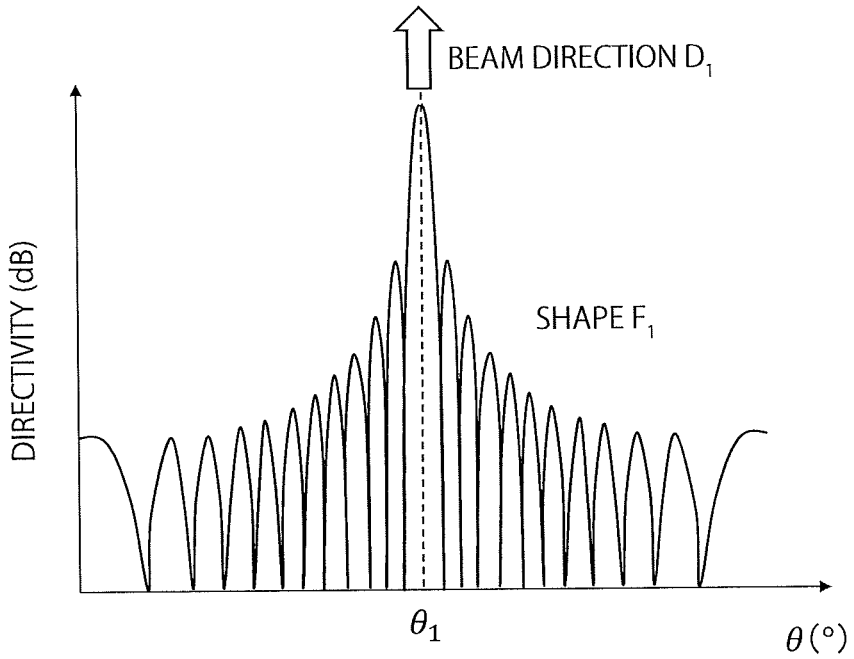
FIG. 3 is a diagram for describing a beam direction and a radiation pattern.
Figure 4:
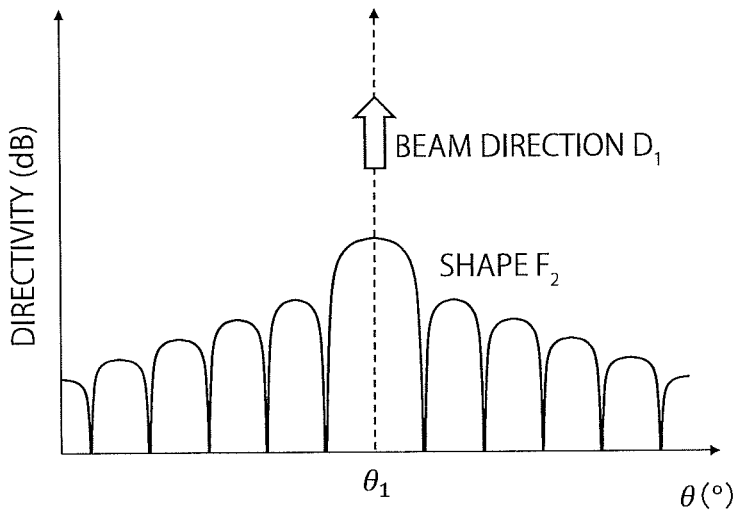
FIG. 4 is a diagram for describing an example of the radiation pattern.

The change in directivity shown in FIG. 3 is also referred to as a "radiation pattern." The radiation pattern changes depending on the polarization angle $\tau$, the beam direction D and the amplitude of the left-hand circularly polarized wave and the right-hand circularly polarized wave. For example, FIG. 4 shows that although the polarization angle and the beam direction $D_1$ are similar to those in FIG. 3, the radiation pattern is changed to a shape $F_2$ which is different from that in FIG. 3 according to the amplitude of the left-hand circularly polarized wave and the right-hand circularly polarized wave.

Figure 5:
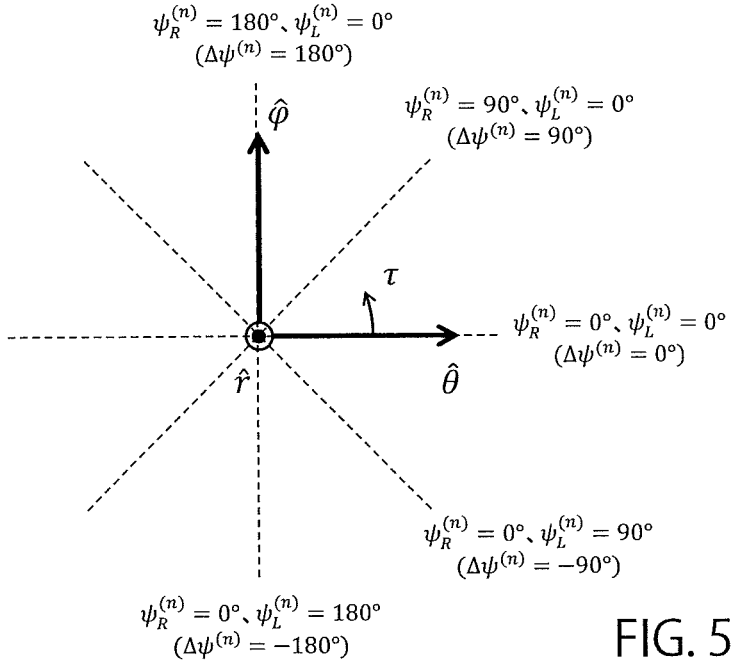
FIG. 5 is a diagram for describing a relationship between a polarization plane and a polarization angle.

FIG. 5 is a diagram for describing a polarization angle. The polarization angle will be described using FIG. 5. An antenna element 101*n* and one set of phase shifters 102*n*1 and 102*n*2 corresponding to the antenna element 101*n* will be described by extracting them from the configuration in FIG. 1. Hereinafter, "n" denotes any one of a, b, . . . , N. The r-hat axis in FIG. 5 is set such that the direction from the other side of the sheet toward the front is positive. In FIG. 5, "$\psi_L^{(n)}$" denotes a phase of the left-hand circularly polarized wave and "$\psi_R^{(n)}$" denotes a phase of the right-hand circularly polarized wave. "$\Delta\psi^{(n)}$" denotes a difference between the phase of the right-hand circularly polarized wave and the phase of the left-hand circularly polarized wave, and the relationship thereof is expressed by equation (1).

[Formula 1]

$$\Delta\psi^{(n)}=\psi_R^{(n)}-\psi_L^{(n)} \tag{1}$$

Here, the phase of the left-hand circularly polarized wave and the phase of the left-hand circularly polarized wave signal correspond, and the right-hand circularly polarized wave and the phase of the right-hand circularly polarized wave signal correspond. For description, the present embodiment will describe that $\psi_L^{(n)}$ is also the phase of the left-hand circularly polarized wave signal and $\psi_R^{(n)}$ is also the phase of the right-hand circularly polarized wave signal. $\Delta\psi^{(n)}$ is also a phase difference between the right-hand circularly polarized wave signal and the left-hand circularly polarized wave signal.

In FIG. 5, as an example, the polarization plane is shown by a broken line in each of five combinations where $\psi_L^{(n)}$ and $\psi_R^{(n)}$ are 0°; $\psi_L^{(n)}$ is 0° and $\psi_R^{(n)}$ is 90°; $\psi_L(n)$ is 0° and $\psi_R^{(n)}$ is 180°; $\psi_L^{(n)}$ is 90° and $\psi_R^{(n)}$ is 0°; and $\psi_L^{(n)}$ is 180° and $\psi_R^{(n)}$ is 0°. Here, the polarization plane when $\psi_L^{(n)}$ is 0° and $\psi_R^{(n)}$ is 180° and the polarization plane when $\psi_L^{(n)}$ is 180° and $\psi_R^{(n)}$ is 0° are common. In FIG. 2, the angle formed between the θ-hat axis and the polarization plane is assumed to be the polarization angle and is represented by τ.

Hereinafter, the left-hand circularly polarized wave and the right-hand circularly polarized wave transmitted and received by the antenna device 100 will be described using mathematical expressions. First, the antenna element 101*n* will be described as in the case of the description of the polarization plane. The left-hand circularly polarized wave and the right-hand circularly polarized wave in the antenna element 101*n* are expressed by equation (2) and equation (3).

[Formula 2]

$$\overrightarrow{f_L^{(n)}}(\theta,\varphi)(n=a,b,\ldots,N) \tag{2}$$

[Formula 3]

$$\overrightarrow{f_R^{(n)}}(\theta,\varphi)(n=a,b,\ldots,N) \tag{3}$$

Hereinafter, the left-hand circularly polarized wave expressed by equation (2) will be represented by a vector $f_L^{(n)}$ and the right-hand circularly polarized wave expressed by equation (3) will be represented by a vector $f_R^{(n)}$.

At this time, a total of antenna elements 101*a* to 101N, that is, a radio wave transmitted and received by the antenna device 100 is expressed by equation (4).

[Formula 4]

$$\vec{E}(\theta,\varphi)=\sum_{n=a}^{N}\left[a_L^{(n)}e^{j\psi_L^{(n)}}\overrightarrow{f_L^{(n)}}(\theta,\varphi)+a_R^{(n)}e^{j\psi_R^{(n)}}\overrightarrow{f_R^{(n)}}(\theta,\varphi)\right]e^{\vec{jk}\cdot\overrightarrow{r^{(n)}}} \tag{4}$$

In equation (4), "$\alpha_L^{(n)}$" represents the amplitude of the left-hand circularly polarized wave in the antenna element 101*n*, "$\alpha_R^{(n)}$" represents the amplitude of the right-hand circularly polarized wave in the antenna element 101*n*, vector "k" represents a wavenumber vector and vector "$r^{(n)}$" represents a position of the antenna element 101*n*.

Here, it is assumed that the amplitudes of the left-hand circularly polarized wave and the right-hand circularly polarized wave in the antenna element 101*n* satisfy equation (5), vector "$f_L^{(n)}$" satisfies equation (6) and vector "$f_R^{(n)}$" satisfies equation (7).

[Formula 5]

$$a^{(n)}=a_L^{(n)}=a_R^{(n)} \tag{5}$$

[Formula 6]

$$\overrightarrow{f_L^{(n)}}(\theta,\varphi)=\frac{E_0}{\sqrt{2}}(\hat{\theta}+j\hat{\varphi}) \tag{6}$$

[Formula 7]

$$\overrightarrow{f_R^{(n)}}(\theta,\varphi)=\frac{E_0}{\sqrt{2}}(\theta+j\hat{\varphi}) \tag{7}$$

Furthermore, when it is assumed that the antenna elements 101*a* to 101N satisfy equations (5), (6) and (7) respectively, the radio wave transmitted and received by the antenna device 100 is expressed by equation (8) based on equation (2) and equation (4).

[Formula 8]

$$\begin{aligned}\vec{E}(\theta,\varphi)&=\frac{e^{jkr}}{r}\sum_{n=a}^{N}a^{(n)}\frac{E_0}{\sqrt{2}}\left[e^{j\psi_L^{(n)}}(\hat{\theta}+j\hat{\varphi})+e^{j\psi_R^{(n)}}(\hat{x}-j\hat{\varphi})\right]e^{\vec{jk}\cdot\overrightarrow{r^{(n)}}}\\&=\frac{e^{jkr}}{r}\sum_{n=a}^{N}a^{(n)}e^{j\psi_L^{(n)}}\frac{E_0}{\sqrt{2}}\left[(1+e^{j\Delta\psi^{(n)}})\hat{\theta}+j(1-e^{j\Delta\psi^{(n)}})\hat{\varphi}\right]\\&\quad e^{\vec{jk}\cdot\overrightarrow{r^{(n)}}}\\&=\frac{e^{jkr}}{r}\sum_{n=a}^{N}a^{(n)}e^{j\psi_L^{(n)}}\overrightarrow{f^{(n)}}e^{\vec{jk}\cdot\overrightarrow{r^{(n)}}}\end{aligned} \tag{8}$$

A vector "E" expressed by this equation (8) represents directivity of the antenna device 100. Note that a radio wave transmitted and received by the antenna element 101*n* is expressed by equation (9).

[Formula 9]

$$\overrightarrow{f^{(n)}}=\frac{E_0}{\sqrt{2}}\left[(1+e^{j\Delta\psi^{(n)}})\hat{\theta}+j(1-e^{j\Delta\psi^{(n)}})\hat{\varphi}\right] \tag{9}$$

A vector "$f^{(n)}$" expressed by this equation (9) represents directivity of the antenna element 101*n*. Here, a ratio between the θ-hat direction component of the vector $f^{(n)}$ and the φ-hat direction component is expressed by equation (10).

[Formula 10]

$$\frac{\hat{\varphi}\cdot\overrightarrow{f^{(n)}}}{\hat{\theta}\cdot\overrightarrow{f^{(n)}}}=j\frac{1-e^{j\Delta\psi^{(n)}}}{1+e^{j\Delta\psi^{(n)}}}=\frac{\sin\Delta\psi^{(n)}}{1+\cos\Delta\psi^{(n)}}=\tan\frac{\Delta\psi^{(n)}}{2} \tag{10}$$

From equation (10), the vector "$f^{(n)}$" represents a linearly polarized wave and a polarization angle "τ" thereof is expressed by equation (11). That is, the antenna device 100 can transmit or receive the linearly polarized wave using the left-hand circularly polarized wave and the right-hand circularly polarized wave. Note that an elliptically polarized wave as well as a linearly polarized wave can also be transmitted or received. Hereinafter, the linearly polarized wave is assumed to include the elliptically polarized wave.

[Formula 11]

$$\tau=\Delta\psi^{(n)}/2 \tag{11}$$

When phase differences $\Delta\psi$ between the left-hand circularly polarized wave and the right-hand circularly polarized wave expressed by equation (12) are equal among the antenna elements 101*a* to 101N, a radio wave transmitted and received by the antenna device 100 is a linearly polarized wave with a polarization angle $\tau$.

[Formula 12]

$$\Delta\psi=\Delta\psi^{(\alpha)}=\ldots=\Delta\psi^{(N)} \tag{12}$$

As described above, the antenna device 100 shifts the phases of the left-hand circularly polarized wave signals using the phase shifters 102*a*1 to 102N1, shifts the phases of the right-hand circularly polarized wave signals using the phase shifter 102*a*2 to 102N2, and can thereby transmit and receive the linearly polarized wave with the any polarization angle $\tau$.

The phase shifters 102*a*1 to 102N1 and 102*a*2 to 102N2 (hereinafter, also referred to as "phase shifters 102*a*1 to 102N2") can change the beam direction D by changing the phases of the left-hand circularly polarized wave signals or the right-hand circularly polarized wave signals while keeping the phase difference $\Delta\psi$ corresponding to the polarization angle $\tau$.

Hereinafter, the configuration of the antenna device 100 according to the present embodiment shown in FIG. 1 will be described. In addition to the antenna elements 101*a* to 101N and the phase shifters 102*a*1 to 102N2, the antenna device 100 is provided with a control circuit 103, a beam forming circuit 104, coupling circuits 105*a*1, 105*a*2, 105*b*1, 105*b*2, 105N1 and 105N2 (hereinafter, also referred to as "105*a*1 to 105N1 and 105*a*2 to 105N2") corresponding to the phase shifters 102*a*1 to 102N2.

The antenna device 100 is a device that transmits or receives a linearly polarized wave corresponding to the any polarization angle $\tau$ and the beam direction D using the left-hand circularly polarized wave and the right-hand circularly polarized wave.

An overview of the antenna device 100 at the time of transmission will be described. The control circuit 103 determines the polarization angle $\tau$ and the beam direction D and determines a phase shift amount to realize the polarization angle $\tau$ and the beam direction D. The beam forming circuit 104 divides the signal transmitted from a connection point 120 to the left-hand circularly polarized wave signal and the right-hand circularly polarized wave signal. The phase shifters 102*a*1 to 102N1 shift the phases of the left-hand circularly polarized wave signals by a determined phase shift amount. The phase shifters 102*a*2 to 102N2 shift the phases of the right-hand circularly polarized wave signal by a determined phase shift amount. The antenna elements 101*a* to 101N transmit the left-hand circularly polarized waves and the right-hand circularly polarized waves in response to the phase-shifted left-hand circularly polarized wave signals and right-hand circularly polarized wave signals. By simultaneously transmitting the left-hand circularly polarized waves and the right-hand circularly polarized waves, the antenna elements 101*a* to 101N transmit the linearly polarized waves with the polarization angle $\tau$ and the beam direction D.

An overview of the antenna device 100 at the time of reception will be described. The antenna elements 101*a* to 101N receive linearly polarized waves and output left-hand circularly polarized wave signals and right-hand circularly polarized wave signals. The same also applies to the case with linearly polarized waves. The coupling circuits 105*a*1 to 105N1 output parts of the left-hand circularly polarized wave signals to the control circuit 103. The coupling circuits 105*a*2 to 105N2 output parts of the right-hand circularly polarized wave signals to the control circuit 103. The control circuit 103 determines a phase shift amount corresponding to the polarization angle $\tau$ and the beam direction D of the received linearly polarized waves based on the input left-hand circularly polarized wave signals and right-hand circularly polarized wave signals. The phase shifters 102*a*1 to 102N1 shift the phases of the left-hand circularly polarized wave signals. The phase shifters 102*a*2 to 102N2 shift the phases of the right-hand circularly polarized wave signals. The beam forming circuit 104 combines the phase-shifted left-hand circularly polarized wave signal and right-hand circularly polarized wave signal. Hereinafter, the combined signal will also be referred to as a "received signal."

A connection relationship among the components of the antenna device 100 will be described. The antenna elements 101*a* to 101N are connected to the corresponding coupling circuits 105*a*1 to 105N1 and 105*a*2 to 105N2. For example, the antenna element 101*a* is connected to the coupling circuits 105*a*1 and 105*a*2. The coupling circuits 105*a*1 to 105N1, 105*a*2 to 105N2 (hereinafter, also referred to as "coupling circuits 105*a*1 to 105N2") are connected to the control circuit 103 and the corresponding phase shifters 102*a*1 to 102N2. For example, the coupling circuit 105*a*1 is connected to the phase shifter 102*a*1 and the control circuit 103. In addition to the coupling circuits 105*a*1 to 105N2, the phase shifters 102*a*1 to 102N2 are connected to the beam forming circuit 104. In addition to the coupling circuits 105*a*1 to 105N2, the control circuit 103 is connected to the beam forming circuit 104. Furthermore, the control circuit 103 is provided with a device to transmit phase shift amounts to the phase shifters 102*a*1 to 102N2. Any device can be used as such device and it may be, for example, a wired or wireless device, a magnetic field control, or mechanical transmission via an any device.

The antenna device 100 and other devices (not shown) are connected to the connection point 120. The other devices are devices from which signals to be transmitted by the antenna device 100 are acquired and devices to which received signals composed by the antenna device 100 are transmitted. Examples of the other devices include an information processing device (signal processing device) and a wireless power supply device.

The antenna elements 101*a* to 101N transmit and receive left-hand circularly polarized waves and right-hand circularly polarized waves. At the time of transmission, the antenna elements 101*a* to 101N radiate and thereby transmit the left-hand circularly polarized waves and right-hand circularly polarized waves. The antenna elements 101*a* to 101N transmit left-hand circularly polarized waves upon receiving left-hand circularly polarized wave signals and transmit right-hand circularly polarized waves upon receiving right-hand circularly polarized wave signals. The antenna elements 101*a* to 101N transmit linearly polarized waves upon simultaneously receiving left-hand circularly polarized wave signals and right-hand circularly polarized wave signals with equivalent amplitudes and frequency bands. Hereinafter, it is assumed that "equivalent" includes "substantially equivalent" and "simultaneous" includes "substantially simultaneous."

At the time of reception, the antenna elements 101*a* to 101N output circularly polarized wave signals corresponding to circularly polarized waves to be received to the coupling circuits 105*a*1 to 105N2. The antenna elements 101*a* to 101N output left-hand circularly polarized wave signals upon receiving left-hand circularly polarized waves and output right-hand circularly polarized wave signals upon receiving right-hand circularly polarized waves. Upon receiving linearly polarized waves, the antenna elements 101*a* to 101N output left-hand circularly polarized wave signals and right-hand circularly polarized wave signals with equivalent amplitudes respectively. Upon receiving, for example, a left-hand circularly polarized wave and a right-hand circularly polarized wave, the antenna element 101*a* outputs a left-hand circularly polarized wave signal to the coupling circuit 105*a*1 and outputs a right-hand circularly polarized wave signal to the coupling circuit 105*a*2.

The antenna elements 101*a* to 101N are also referred to as "radiation elements" and have any configuration as long as the antenna elements can transmit and receive left-hand circularly polarized waves and right-hand circularly polarized waves. As an example, FIG. 1 illustrates the antenna elements 101*a* to 101N using square patch antennas in the present embodiment.

The phase shifters 102*a*1 to 102N2 shift the phases of the corresponding circularly polarized wave signals by delaying the phases. The phase shifters 102*a*1 to 102N1 shift the phases of left-hand circularly polarized wave signals. The phase shifters 102*a*2 to 102N2 shift the phases of right-hand circularly polarized wave signals. At the time of transmission, the phase shifters 102*a*1 to 102N1 shift the phases of left-hand circularly polarized wave signals input from the beam forming circuit 104. The phase shifters 102*a*1 to 102N1 output the phase-shifted left-hand circularly polarized wave signals to the corresponding antenna elements 101*a* to 101N via the corresponding coupling circuits 105*a*1 to 105N1. The phase shifters 102*a*2 to 102N2 output the phase-shifted right-hand circularly polarized wave signals to the corresponding antenna elements 101*a* to 101N via the corresponding coupling circuits 105*a*2 to 105N2. The phase-shifted left-hand circularly polarized wave signals and right-hand circularly polarized wave signals are used to transmit left-hand circularly polarized waves and right-hand circularly polarized waves.

At the time of reception, the phase shifters 102*a*1 to 102N1 shift the phases of the left-hand circularly polarized wave signals input from the corresponding coupling circuits 105*a*1 to 105N1. The phase shifters 102*a*1 to 102N1 output the phase-shifted left-hand circularly polarized wave signals to the beam forming circuit 104. The phase shifters 102*a*2 to 102N2 shift the phases of the right-hand circularly polarized wave signals input from the corresponding coupling circuits 105*a*2 to 105N2. The phase shifters 102*a*2 to 102N2 output the phase-shifted right-hand circularly polarized wave signals to the beam forming circuit 104. The phase-shifted left-hand circularly polarized wave signals and right-hand circularly polarized wave signals are used to compose a received signal.

As the phase shift amount of the phase shifters 102*a*1 to 102N2, not only values transmitted from the control circuit 103 but also values set in advance can be used. The phase shifters 102*a*1 to 102N2 have a phase-shiftable range of 360° or more and can handle any polarization angle and beam direction D.

The phase shifters 102*a*1 to 102N2 can have any configuration as long as the configuration makes it possible to shift phases of the left-hand circularly polarized wave signals and right-hand circularly polarized wave signals. The phase shifters 102*a*1 to 102N2 may be totally or partially different from one another. As an example, it is assumed that the phase shifters 102*a*1 to 102N2 are analog phase shifters, whose phase shift amounts can be continuously changed and are similar to one another in the present embodiment.

The control circuit 103 determines respective phase shift amounts of the phase shifters 102*a*1 to 102N2. The control circuit 103 stores information indicating a relationship between phases of the left-hand circularly polarized wave signals and/or right-hand circularly polarized wave signals and the beam direction D and information indicating a relationship between the phase difference $\Delta\psi$ and the polarization angle $\tau$ in a storage (not shown). Hereinafter, such information will also be referred to as "characteristic information." The control circuit 103 determines phase shift amounts corresponding to the polarization angle $\tau$ and the beam direction D of linearly polarized waves based on at least the characteristic information.

The control circuit 103 determines the amplitudes of the left-hand circularly polarized wave signals and the right-hand circularly polarized wave signals divided by the beam forming circuit 104. The storage also stores information indicating a relationship between the amplitude and the radiation pattern of the left-hand circularly polarized wave signals and the right-hand circularly polarized wave signals as the characteristic information. The control circuit 103 determines the amplitudes of the left-hand circularly polarized wave signals and the right-hand circularly polarized wave signals corresponding to the radiation pattern based on the characteristic information.

At the time of transmission, the control circuit 103 determines the polarization angle $\tau$ and the beam direction D of a linearly polarized wave to be transmitted. The control circuit 103 determines the respective phase shift amounts of the phase shifters 102*a*1 to 102N2 corresponding to this polarization angle and transmission of the determined beam direction D using the characteristic information. Furthermore, the control circuit 103 determines the radiation pattern of the polarized waves to be transmitted. The control circuit 103 determines the amplitudes of the left-hand circularly polarized wave signals and right-hand circularly polarized wave signals corresponding to the determined radiation pattern based on the characteristic information.

At the time of reception, the control circuit 103 receives parts of the left-hand circularly polarized wave signals from the coupling circuits 105*a*1 to 105N1. The control circuit 103 also receives parts of the right-hand circularly polarized wave signals from the coupling circuits 105*a*2 to 105N2. The control circuit 103 estimates the polarization angle $\tau$ and the beam direction D of the left-hand circularly polarized waves and the right-hand circularly polarized waves received by the antenna element 101 based on the input left-hand circularly polarized wave signals, right-hand circularly polarized wave signals and characteristic information. The control circuit 103 determines the respective phase shift amounts of the phase shifters 102*a*1 to 102N2 based on the estimated polarization angle $\tau$, beam direction D and characteristic information.

The control circuit 103 transmits the determined phase shift amounts to the phase shifters 102*a*1 to 102N2 and the control circuit 103 outputs the determined amplitudes.

The control circuit 103 is an electronic circuit (processor) including a hardware control device and a computation device. Examples of the processor can include a general-purpose processor, a central processing unit (CPU), a microprocessor, a digital signal processor (DSP) and a combination thereof.

The storage used by the control circuit 103 is a memory or the like and examples thereof include a RAM (Random Access Memory), ROM (Read Only Memory), PROM (Programmable ROM), EPROM (Erasable PROM), EEPROM (Electrically EPROM), flash memory or register. The storage may be provided inside or outside an internal antenna device 100 of the control circuit 103. As an example, the storage is assumed to be provided inside the control circuit 103 in the present embodiment.

The beam forming circuit 104 divides a signal into a plurality of parts or combines a plurality of signals. At the time of transmission, the beam forming circuit 104 receives a signal from the connection point 120. This signal is a signal to be transmitted (hereinafter, also referred to as "transmission signal") transmitted from a device connected to the antenna device 100 via the connection point 120. The beam forming circuit 104 divides a transmission signal into left-hand circularly polarized wave signals and right-hand circularly polarized wave signals. The beam forming circuit 104 outputs the left-hand circularly polarized wave signals to the phase shifters 102*a*1 to 102N1 and outputs the right-hand circularly polarized wave signals to the phase shifters 102*a*2 to 102N2.

Here, the beam forming circuit 104 outputs the divided left-hand circularly polarized wave signals and right-hand circularly polarized wave signals to the phase shifters 102*n*1 and 102*n*2 corresponding to the same antenna element 101*n* such that they have equivalent amplitudes. Hereinafter, "equivalent" includes "substantially equivalent" or the like. For example, the left-hand circularly polarized wave signal output from the beam forming circuit 104 to the phase shifter 102*a*1 and the right-hand circularly polarized wave signal output to the phase shifter 102*a*2 have equivalent amplitude. Here, the amplitude of signals at the phase shifters 102*m*1 and 102*m*2 corresponding to an antenna element 101*m*, which is different from an antenna element 101*n*, may be different from the amplitude of signals at phase shifters 102*n*1 and 102*n*2. For example, the amplitude of signals output to the phase shifters 102*a*1 and 102*a*2 may be different from the amplitude of signals output to the phase shifters 102*b*1 and 102*b*2.

At the time of reception, the beam forming circuit 104 composes a received signal from the input right-hand circularly polarized wave signal and left-hand circularly polarized wave signal. More specifically, the beam forming circuit 104 composes a received signal from the left-hand circularly polarized wave signal and right-hand circularly polarized wave signal input from the corresponding phase shifters 102*n*1 and 102*n*2. The beam forming circuit 104 outputs the received signal to the connection point 120. The received signal is transmitted to devices connected to the antenna device 100 via the connection point 120.

The beam forming circuit 104 may have any configuration as long as such a configuration makes it possible to divide the signal into a plurality of parts and combine the plurality of signals. It is assumed as an example that the beam forming circuit 104 is an analog circuit.

The coupling circuits 105*a*1 to 105N2 also output parts of the input signals from different terminals. At the time of reception, the left-hand circularly polarized wave signals are input from the antenna elements 101*a* to 101N to the coupling circuits 105*a*1 to 105N1 and the right-hand circularly polarized wave signals are input to the coupling circuits 105*a*2 to N2. The coupling circuits 105*a*1 to 105N1 output parts of the input left-hand circularly polarized wave signals to the control circuit 103 and output the remaining parts of the signals to the phase shifters 102*a*1 to 102N1. The coupling circuits 105*a*2 to 105N2 output parts of the input right-hand circularly polarized wave signals to the control circuit 103 and output the remaining parts of the signals to the phase shifters 102*a*2 to 102N2.

At the time of transmission, the coupling circuits 105*a*1 to 105N2 output signals input from the phase shifters 102*a*1 to 102N2 to the corresponding antenna elements 101*a* to 101N. The coupling circuits 105*a*1 to 105N2 have any configuration as long as such a configuration makes it possible to also output parts of the input signals from a different terminal. As an example, the coupling circuits 105*a*1 to 105N2 are assumed to be directional couplers in the present embodiment.

The components of the antenna device 100 have been described so far. The antenna device 100 is constructed by electrically connecting one or more circuits. The antenna device 100 may be constructed of an integrated circuit such as IC (Integrated Circuit) or LSI (Large Scale Integration). The components may be mounted integrally on one chip or some components may be mounted on another chip.

Figure 6:
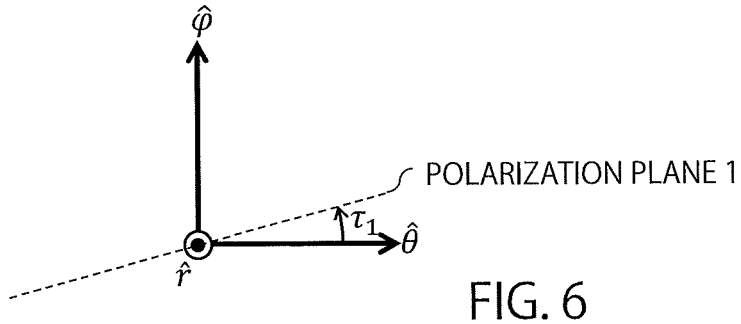
FIG. 6 is a diagram representing a polarization angle $\tau_1$ according to the first embodiment.

The antenna device 100 is a device that shifts the phases of left-hand circularly polarized wave signals and right-hand circularly polarized wave signals so as to correspond to the polarization angle $\tau$ and the beam direction D of the transmitted and received polarized waves. Operation of the antenna device 100 at the time of transmission will be described using FIG. 6 and FIG. 7.

The antenna device 100 is a device that can transmit a linearly polarized wave corresponding to an any polarization angle $\tau$, any beam direction D and any radiation pattern. As an example, operation of the antenna device 100 that transmits a linearly polarized wave with a polarization angle $\tau_1$ shown in FIG. 6 will be described using a flowchart in FIG. 7. Note that the beam direction D is represented by a beam direction $D_1$ as an example. It is assumed that the beam direction $D_1$ is represented by $\theta_1$ and $\varphi_1$. As an example, the radiation pattern is assumed to be the shape in FIG. 3. For description, this shape is represented as a shape $F_1$. In the present embodiment, it is assumed that there is no phase difference between the left-hand circularly polarized wave signal and the right-hand circularly polarized wave signal divided by the beam forming circuit 104 as an example.

Hereinafter, an overview of the flowchart will be described. The antenna device 100 determines the polarization angle $\tau_1$, beam direction $D_1$ and shape $F_1$ of the linearly polarized wave to be transmitted. The antenna device 100 determines and transmits a phase shift amount corresponding to the linearly polarized wave with this polarization angle $\tau_1$ and beam direction $D_1$. The antenna device 100 determines and outputs the amplitude of the left-hand circularly polarized wave signal and right-hand circularly polarized wave signal corresponding to the shape $F_1$. The antenna device 100 divides the transmission signal into the left-hand circularly polarized wave signals and the right-hand circularly polarized wave signals with the determined amplitude. The antenna device 100 shifts the phases of the left-hand circularly polarized wave signals and the right-hand circularly polarized wave signals with the transmitted phase shift amount and transmits a linearly polarized wave with the polarization angle $\tau_1$, beam direction $D_1$ and shape $F_1$.

Operation of the antenna device 100 at the time of transmission will be described according to the flowchart in FIG. 7. The control circuit 103 determines the polarization angle $\tau$, beam direction D, and radiation pattern of the linearly polarized wave to be transmitted (step S101). In the present embodiment, the control circuit 103 determines the polarization angle to be $\tau_1$, the beam direction to be $D_1$ and the shape to be $F_1$.

The control circuit 103 determines respective phase shift amounts of the phase shifters 102*a*1 to 102N2 based on the determined polarization angle $\tau_1$ and beam direction $D_1$ and the characteristic information stored in the storage.

Association of the beam direction $D_1$ is performed using phases of the left-hand circularly polarized wave signals or right-hand circularly polarized wave signals. The beam direction D is associated using a phase difference between two different signals among the plurality of left-hand circularly polarized wave signals or right-hand circularly polarized wave signals. As an example in the present embodiment, it is assumed that the phases of the left-hand circularly polarized wave signal input to the antenna elements 101*a* to 101N and corresponding to the beam direction $D_1$ are $\psi_L^{(a)}$ to $\psi_L^{(N)}$. A phase difference in the left-hand circularly polarized wave signals between the neighboring antenna elements of the antenna elements 101*a* to 101N corresponds to the beam direction $D_1$. For example, a phase difference between $\psi_L^{(a)}$ and $\psi_L^{(b)}$, a phase difference between $\psi_L^{(b)}$ and $\psi_L^{(c)}$, . . . , and a phase difference between $\psi_L^{(N-1)}$ and $\psi_L^{(N)}$ respectively correspond to the beam direction $D_1$. $\psi_L^{(N-1)}$ represents a phase of the left-hand circularly polarized wave signal at the antenna element 101N-1 adjacent to the antenna element 101N.

The control circuit 103 determines phase shift amounts of the phase shifters 102*a*1 to 102N1 such that the phases of the left-hand circularly polarized wave signals become $\psi_L^{(a)}$ to $\psi_L^{(N)}$. For example, the control circuit 103 determines phase shift amounts $\alpha_{a1}$, $\alpha_{b1}$, . . . , $\alpha_{N1}$ (hereinafter, also referred to as "phase shift amounts $\alpha_{a1}$ to $\alpha_{N1}$"). The phase shift amounts $\alpha_{a1}$ to $\alpha_{N1}$ can take any value as long as they correspond to the beam direction $D_1$, but as an example, it is assumed in the present embodiment that they take different values.

Association of the polarization angle $\tau_1$ is performed using a difference between the left-hand circularly polarized wave signals and the right-hand circularly polarized wave signals input to the antenna elements 101*a* to 101N. The difference between the left-hand circularly polarized wave signals and right-hand circularly polarized wave signals input to the antenna elements 101*a* to 101N further satisfies equation (13).

[Formula 13]

$$\tau_1=\Delta\psi_1^{(n)}/2 \tag{13}$$

The control circuit 103 determines phase shift amounts of the phase shifters 102*a*2 to 102N2 that satisfy equation (13). For example, the control circuit 103 determines phase shift amounts $\alpha_{a2}$, $\alpha_{b2}$, . . . $\alpha_{N2}$ (hereinafter, also referred to as "phase shift amounts $\alpha_{a2}$ to $\alpha_{N2}$"). The phase shift amounts $\alpha_{a2}$ to $\alpha_{N2}$ are values corresponding to the phase shift amounts $\alpha_{a1}$ to $\alpha_{N1}$ and satisfying equation (13). As an example in the present embodiment, it is assumed that they take different values.

The control circuit 103 transmits the determined phase shift amounts to the phase shifters 102*a*1 to 102N2 respectively. The phase shifters 102*a*1 to 102N2 set the phase shift amounts as $\alpha_{a1}$ to $\alpha_{N1}$ and $\alpha_{a2}$ to $\alpha_{N2}$.

The control circuit 103 determines amplitudes of the left-hand circularly polarized wave signals and the right-hand circularly polarized wave signals divided by the beam forming circuit 104 based on the determined shape $F_1$. The control circuit 103 determines the amplitudes of signals to be output to the phase shifters 102*a*1 to 102N2 corresponding to the shape $F_1$ from the characteristic information.

More specifically, the control circuit 103 determines an amplitude "an" of the left-hand circularly polarized wave signal and the right-hand circularly polarized wave signal input to the phase shifters 102*n*1 and 102*n*2 corresponding to the antenna element 101*n*. Here, the amplitudes of the left-hand circularly polarized wave signal and the right-hand circularly polarized wave signal corresponding to the same antenna element 101*n* are equivalent. The control circuit 103 determines amplitudes aa, ab, . . . , aN (hereinafter, also referred to as "amplitudes aa to aN") of the signals to be output to the phase shifters 102*a*1 to 102N2.

The antenna device 100 can carry out communication corresponding to any shape F using combinations of amplitudes aa to aN. As an example in the present embodiment, the control circuit 103 realizes transmission of the shape $F_1$ by determining to increase the amplitude from aa to aM (M is assumed to be positioned ahead of N) and decrease the amplitude from aM to aN. The control circuit 103 outputs the determined amplitude to the beam forming circuit 104 (step S102).

The beam forming circuit 104 receives transmission signals from the connection point 120 in addition to the amplitudes from the control circuit 103. The beam forming circuit 104 divides the transmission signals to the left-hand circularly polarized wave signals and the right-hand circularly polarized wave signals. As an example in the present embodiment, the left-hand circularly polarized wave signals and the right-hand circularly polarized wave signals are divided with the determined amplitudes and equivalent phases. The beam forming circuit 104 outputs the left-hand circularly polarized wave signals to the phase shifters 102*a*1 to 102N1. The beam forming circuit 104 outputs the right-hand circularly polarized wave signals to the phase shifters 102*a*2 to 102N2.

The phase shifters 102*a*1 to 102N1 shift the phases of the left-hand circularly polarized wave signals with the phase shift amounts $\alpha_{a1}$ to $\alpha_{N1}$ respectively. The phase shifters 102*a*1 to 102N1 output the phase-shifted left-hand circularly polarized wave signals to the coupling circuits 105*a*1 to 105N1. The phase shifters 102*a*2 to 102N2 shift the phases of the right-hand circularly polarized wave signals with the phase shift amounts $\alpha_{a2}$ to $\alpha_{N2}$ respectively. The phase shifters 102*a*2 to 102N2 output the phase-shifted right-hand circularly polarized wave signals to the coupling circuits 105*a*2 to 105N2. The coupling circuits 105*a*1 to 105N1 output the left-hand circularly polarized wave signals to the antenna elements 101*a* to 101N. The coupling circuits 105*a*2 to 105N2 output the right-hand circularly polarized wave signals to the antenna elements 101*a* to 101N. The antenna elements 101*a* to 101N transmit the left-hand circularly polarized waves in response to the left-hand circularly polarized wave signals and transmit the right-hand circularly polarized waves in response to the right-hand circularly polarized wave signals. In the present embodiment, since the left-hand circularly polarized waves and the right-hand circularly polarized waves are transmitted simultaneously, they are transmitted as linearly polarized waves.

As described above, the antenna elements 101*a* to 101N transmit the left-hand circularly polarized waves and the right-hand circularly polarized waves, and transmit linearly polarized waves with the polarization angle $\tau_1$ and the beam direction $D_1$ (step S103).

Hereinafter, the antenna device 100 continuously performs the operation in step S103 and transmits the linearly polarized waves with the polarization angle $\tau_1$, the beam direction $D_1$ and the shape $F_1$.

The control circuit 103 confirms whether or not a resetting command for resetting (changing) at least one of the polarization angle $\tau_1$, the beam direction $D_1$ and the shape $F_1$ has arrived within a predetermined time (step S104). As this predetermined time, the time stored in the storage may also be used in addition to the time previously set by the control circuit 103. The resetting command is transmitted to the control circuit 103 by the user's input to the antenna device 100 or by the antenna device 100 acquiring a signal including the resetting command or the like.

When the resetting command has arrived at the control circuit 103 (step S104: Yes), the process returns to step S101 and the control circuit 103 redetermines at least one of the polarization angle $\tau$, the beam direction D and the radiation pattern of the linearly polarized wave to be transmitted.

On the other hand, when this resetting command has not arrived at the control circuit 103 (step S104: No), the control circuit 103 confirms whether or not an end command for ending the operation of the antenna device 100 has arrived (step S105). The end command is a command for ending the operation of the antenna device 100 in this flow. The end command is transmitted to the control circuit 103 by the user's input to the antenna device 100 or by the antenna device 100 acquiring a signal including the end command or the like. Regardless of step S105, this end command may also be a command for immediately ending the operation of the antenna device 100.

When the end command has not arrived at the control circuit 103 (step S105: No), the process returns to step S103, and the antenna device 100 continues transmission of the linearly polarized wave. On the other hand, when this end command has arrived at the control circuit 103 (step S105: Yes), the flow ends and the antenna device 100 ends the operation.

The operation for transmission by the antenna device 100 has been described so far. The antenna device 100 is a device that can receive linearly polarized waves corresponding to any polarization angle $\tau$ and any beam direction D. As an example, operation of the antenna device 100 receiving linearly polarized waves with the polarization angle $\tau_1$ shown in FIG. 6 will be described using a flowchart in FIG. 8. Note that it is assumed, as an example, that the beam direction D is represented by the beam direction $D_1$. The beam direction $D_1$ is assumed to be represented by $\theta_1$ and $\varphi_1$.

Hereinafter, an overview of the flowchart will be described. The antenna device 100 receives a linearly polarized wave and outputs the left-hand circularly polarized wave signal and the right-hand circularly polarized wave signal. The antenna device 100 estimates the polarization angle $\tau_1$ and the beam direction $D_1$ from the amplitudes, phases and characteristic information of the left-hand circularly polarized wave signal and the right-hand circularly polarized wave signal. The antenna device 100 determines and transmits the phase shift amount corresponding to the linearly polarized wave with the polarization angle $\tau_1$ and the beam direction $D_1$. The antenna device 100 shifts the phases of the left-hand circularly polarized wave signal and the right-hand circularly polarized wave signal with the transmitted phase shift amount. The antenna device 100 composes a received signal from the phase-shifted left-hand circularly polarized wave signal and right-hand circularly polarized wave signal.

Operation of the antenna device 100 at the time of reception will be described according to the flowchart in FIG. 8.

The antenna elements 101*a* to 101N receive the left-hand circularly polarized waves and the right-hand circularly polarized waves. The antenna elements 101*a* to 101N output the left-hand circularly polarized waves to the coupling circuits 105*a*1 to 105N1 as left-hand circularly polarized wave signals and output the right-hand circularly polarized waves to the coupling circuit 105*a*2 to 105N2 as right-hand circularly polarized wave signals. In the present embodiment, since the antenna elements 101*a* to 101N receive linearly polarized waves, the left-hand circularly polarized waves and the right-hand circularly polarized waves are received simultaneously (step S111).

The coupling circuits 105*a*1 to 105N2 output parts of the input signals to the control circuit 103 and output the remaining parts of the signals to the phase shifters 102*a*1 to 102N2. The coupling circuits 105*a*1 to 105N1 output parts of the left-hand circularly polarized wave signals to the control circuit 103 and output the remaining parts of the signals to the phase shifters 102*a*1 to 102N1. The coupling circuits 105*a*2 to 105N2 output parts of the right-hand circularly polarized wave signals to the control circuit 103 and output the remaining parts of the signals to the phase shifters 102*a*2 to 102N2 (step S112).

The phase shifters 102*a*1 to 102N1 shift the phases of left-hand circularly polarized wave signals and the phase shifters 102*a*2 to 102N2 shift the phases of right-hand circularly polarized wave signals. As an example, the phase shifters 102*a*1 to 102N2 shift the phases with a predetermined phase shift amount. The phase shifters 102*a*1 to 102N1 output the phase-shifted left-hand circularly polarized wave signals to the beam forming circuit 104 and the phase shifters 102*a*2 to 102N2 output the phase-shifted left-hand circularly polarized wave signals to the beam forming circuit 104 (step S113).

The beam forming circuit 104 composes a received signal from the left-hand circularly polarized wave signal and the right-hand circularly polarized wave signal. The beam forming circuit 104 composes the received signal from the left-hand circularly polarized wave signal and the right-hand circularly polarized wave signal input from the phase shifters 102*n*1 and 102*n*2 corresponding to the same antenna element 101*n* (step S114). The beam forming circuit 104 outputs this received signal to a device connected to the antenna device 100 via the connection point 120.

The control circuit 103 receives the left-hand circularly polarized wave signals from the coupling circuits 105*a*1 to 105N1 and the right-hand circularly polarized wave signals from the coupling circuits 105*a*2 to 105N2. The control circuit 103 acquires the phases of these signals (step S115).

Steps S111 to S115 above are continuously executed regardless of settings of phase shift amounts at the phase shifters 102*a*1 to 102N2.

The control circuit 103 estimates the polarization angle and the beam direction D of the linearly polarized waves received by the antenna elements 101*a* to 101N based on the acquired phases of the left-hand circularly polarized wave signals and the right-hand circularly polarized wave signals and the characteristic information stored in the storage.

Since the phase difference between the left-hand circularly polarized wave signal n and the right-hand circularly polarized wave signal n output by the antenna element 101*n* satisfies equation (13), the control circuit 103 estimates the polarization angle $\tau$ of the linearly polarized wave received by the antenna element 101*n*. Furthermore, the control circuit 103 estimates the beam direction D of the linearly polarized wave received by the antenna element 101*n* based on the characteristic information corresponding to the phase of the left-hand circularly polarized wave signal n or the phase of the right-hand circularly polarized wave signal n output by the antenna element 101*n*. As an example in the present embodiment, the control circuit 103 estimates the polarization angle $\tau_1$, and the beam direction to be $D_1$ (step S116).

The control circuit 103 determines phase shift amounts of the phase shifters 102*a*1 to 102N2 corresponding to the polarization angle $\tau_1$ and the beam direction $D_1$ based on the acquired phases of the left-hand circularly polarized wave signal and right-hand circularly polarized wave signal and the characteristic information stored in the storage. In the present embodiment, the control circuit 103 determines the phase shift amounts of the phase shifters 102*a*1 to 102N2 as phase shift amounts $\alpha_{a1}$ to $\alpha_{N1}$, $\alpha_{a2}$ to $\alpha_{N2}$. The control circuit 103 transmits the determined phase shift amounts to the phase shifters 102*a*1 to 102N2 (step S117).

Hereinafter, the phase shifters 102*a*1 to 102N1 reset the phase shift amounts to $\alpha_{a1}$ to $\alpha_{N1}$ and the phase shifters 102*a*2 to 102N2 reset the phase shift amounts to $\alpha_{a2}$ to $\alpha_{N2}$. The antenna device 100 continuously performs operations in step S111 to step S115.

The control circuit 103 confirms whether or not there is a change equal to or higher than a threshold in the phases of the left-hand circularly polarized wave signals and right-hand circularly polarized wave signals input within a predetermined time. In addition to values previously set by the control circuit 103, values stored in the storage may also be used as the predetermined time and threshold (step S118).

When there is a change equal to or higher than a threshold in the phases of the left-hand circularly polarized wave signals and right-hand circularly polarized wave signals input within a predetermined time (step S118: Yes), the process returns to step S116. The control circuit 103 estimates the polarization angle $\tau$ and the beam direction D of the linearly polarized waves received by the antenna elements 101*a* to 101N and determines the phase shift amount corresponding to the estimated polarization angle $\tau$ and beam direction D.

On the other hand, when there is no change equal to or higher than a threshold in the phases of the left-hand circularly polarized wave signals and right-hand circularly polarized wave signals input within a predetermined time (step S118: No), the control circuit 103 confirms whether or not an end command for ending the operation of the antenna device 100 has arrived (step S119). This end command is a command for ending the operation of the antenna device 100 in this flow. This end command is transmitted to the control circuit 103 by the user's input to the antenna device 100 or by the antenna device 100 acquiring a signal including the end command or the like. This end command may be a command for ending the operation of the antenna device 100 immediately regardless of step S119.

When this end command has not arrived at the control circuit 103 (step S119: No), the process returns to step S118 and the antenna device 100 continues to receive linearly polarized waves. On the other hand, when the end command has arrived at the control circuit 103 (step S119: Yes), the flow ends and the antenna device 100 ends the operation.

Operations of transmission and reception by the antenna device 100 have been described so far. The antenna device 100 of the present embodiment can transmit or receive left-hand circularly polarized waves and right-hand circularly polarized waves corresponding to the any polarization angle $\tau$ and the beam direction D by changing the phase shift amounts of the left-hand circularly polarized wave signal and the right-hand circularly polarized wave signal. Furthermore, when performing division to the left-hand circularly polarized wave signals and the right-hand circularly polarized wave signal, it is possible to transmit left-hand circularly polarized waves and right-hand circularly polarized waves according to any radiation pattern by changing amplitudes of the left-hand circularly polarized wave signal and the right-hand circularly polarized wave signal for each antenna element 101*a* to 101N.

The antenna device 100 of the present embodiment has been described so far, but various modifications of the antenna device 100 can be implemented or executed. Hereinafter, modifications of the configuration of the antenna device 100 will be described.

Figure 9:
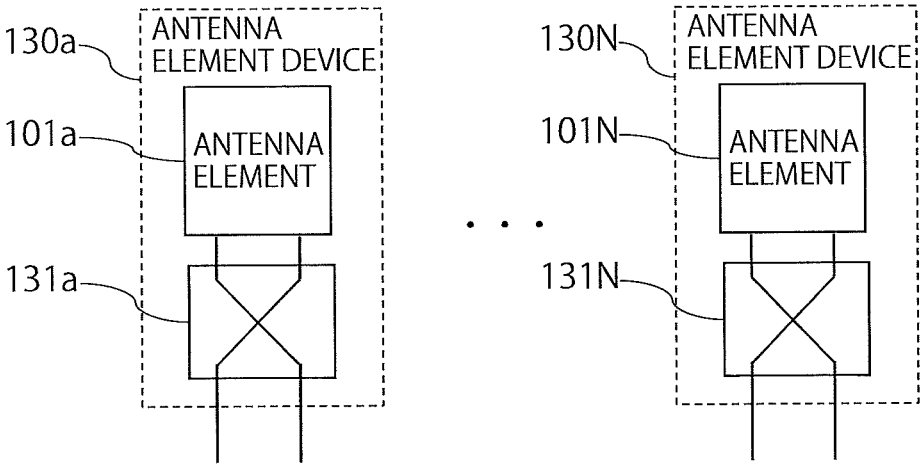
FIG. 9 is a diagram for describing antenna element devices 130*a* to 130N applicable to antenna elements 101*a* to 101N.

In the present embodiment, square patch antennas have been adopted as the antenna elements 101*a* to 101N. As a modification, the antenna elements 101*a* to 101N may be antennas different from the antennas described in the present embodiment. For example, an orthogonal linearly polarized wave shared patch antenna may be combined with a circuit such as a quadrature hybrid coupler. FIG. 9 illustrates antenna element devices 130*a* to 130N obtained by combining the antenna elements 101*a* to 101N with quadrature hybrid couplers 131*a* to 131N.

Other examples of the antenna elements 101*a* to 101N may include an antenna with part of a patch antenna cut out, a dipole antenna, a helical antenna, a spiral antenna, a loop antenna, a dielectric resonator antenna, an antenna using a septum polarizer or a waveguide tube loaded with an orthogonal mode transducer, a slot antenna, a reflector antenna, a lens antenna, and an antenna using a metasurface. A sequential array antenna may also be adopted which generates circularly polarized waves by giving a phase difference to a plurality of linearly polarized wave antennas and exciting them.

Figure 10:
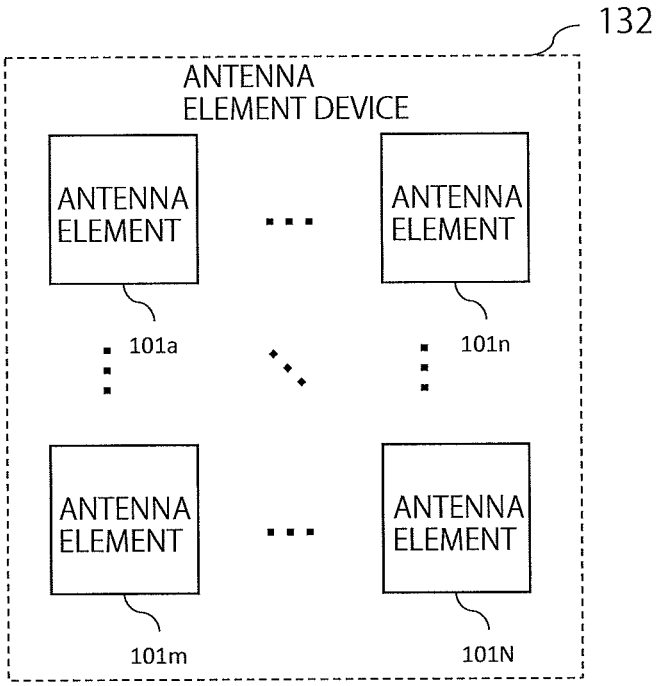
FIG. 10 is a diagram for describing an example of arrangement of the antenna elements 101*a* to 101N.
Figure 11:
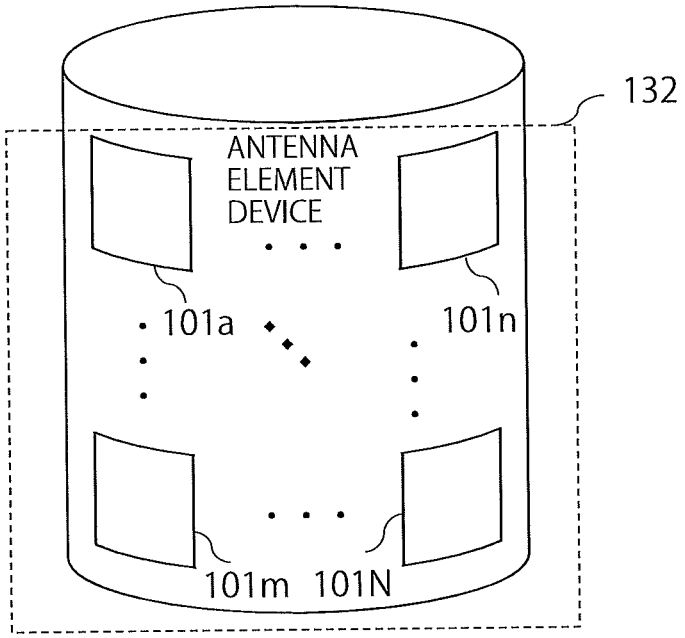
FIG. 11 is a diagram illustrating the arrangement in FIG. 10 applied to a three-dimensional object.

The antenna elements 101*a* to 101N of the present embodiment are not limited to a linear array. For example, the antenna elements may be arranged planarly when viewed from the vertical direction as shown in FIG. 10. This planar array antenna element device 132 may be formed on a three-dimensional surface. For example, FIG. 11 illustrates the antenna element device 132 disposed on a curved surface. In addition, the antenna element device 132 can be disposed on a rectangular parallelepiped surface, a conical surface, a pyramid surface or the like.

Figure 12:
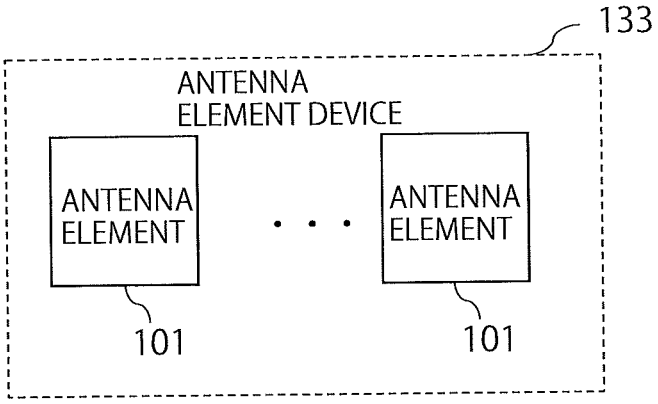
FIG. 12 is a diagram for describing an antenna element device 133 including a plurality of antenna elements.

Each of the antenna elements 101*a* to 101N is not limited to one antenna element. Each of the antenna elements 101*a* to 101N may be an array antenna. For example, FIG. 12 illustrates one antenna element device 133 including a plurality of antenna elements 101. The antenna elements 101*a* to 101N of the present embodiment may be replaced by N antenna element devices 133.

Figure 13:
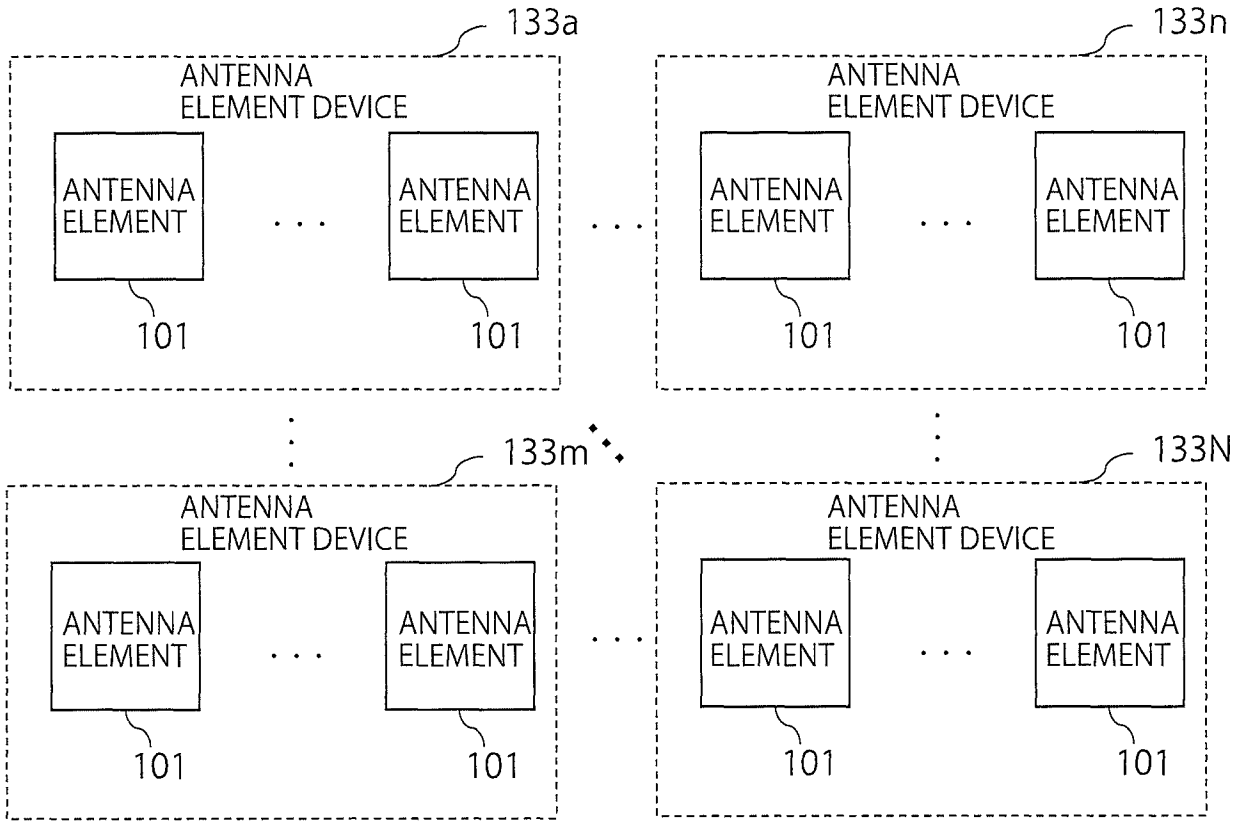
FIG. 13 is a diagram illustrating an arrangement of a plurality of the antenna element devices 133 in FIG. 12.

The antenna element device 133 is not limited to a linear array. The antenna element device 133 may be arranged planarly when viewed from a vertical direction as shown in FIG. 13.

In the present embodiment, it is assumed that the phase shifters 102*a*1 to 102N2 are analog phase shifters. As a modification, the phase shifters 102*a*1 to 102N2 may be digital phase shifters which switch phase shift amounts discretely or configured by combining a plurality of phase shifters. Specific examples of the phase shifters 102*a*1 to 102N2 may include phase shifters capable of changing the length of a line connected to the phase shifter using a PIN diode or FET (Field Effect Transistor), MEMS (Micro Electro Mechanical Systems) switch or the like. The phase shifters 102*a*1 to 102N2 may be reflection-type phase shifters obtained by combining phase shifters whose line length can be switched and a circuit such as a quadrature hybrid coupler. The phase shifters 102*a*1 to 102N2 may be variable impedance elements such as varactor diodes.

In the present embodiment, phase shift amounts are set, in advance, in the phase shifters 102*a*1 to 102N2 at the time of reception. These phase shift amounts may be set during manufacturing of the phase shifters 102*a*1 to 102N2 or the control circuit 103 may determine the phase shift amounts or may determine the phase shift amounts by receiving a command from a device connected to the antenna device 100.

In the present embodiment, the beam forming circuit 104 has been described so far as an analog circuit. As a modification, the beam forming circuit 104 may be a digital circuit or a combination of an analog circuit and a digital circuit. Furthermore, the beam forming circuit 104 may be composed of a plurality of circuits. The beam forming circuit 104 may incorporate an amplifier that amplifies signals or a phase shifter.

In the present embodiment, the beam forming circuit 104 does not give any phase difference when dividing a transmission signal to the left-hand circularly polarized wave signals and the right-hand circularly polarized wave signals. As a modification, the beam forming circuit 104 may be configured to give a phase difference when dividing a transmission signal to the left-hand circularly polarized wave signals and the right-hand circularly polarized wave signals. In this case, the storage includes characteristic information corresponding to the phase difference given by the beam forming circuit 104.

In the present embodiment, the coupling circuits 105*a*1 to 105N2 have been described as directional couplers, but they may also be switches. Destination of output may be switched by the control circuit 103 or may be defined in the switch in advance.

Any line is applicable as the line to which the components of the antenna device 100 of the present embodiment are connected as long as it is a line along which a high frequency signal propagates. Examples thereof include a microstrip line, coplanar line, stripline, parallel two-wire line, coaxial line or waveguide. Although a plurality of types of lines may be combined, two lines connecting the antenna device 100*n* to the coupling circuits 105*n*1 and 105*n*2, two lines connecting the coupling circuits 105*n*1 and 105*n*2 to the phase shifters 102*n*1 and 102*n*2, and two lines connecting the phase shifters 102*n*1 and 102*n*2 to the beam forming circuit 104 are two identical types of lines respectively.

A circuit element associated with the phase shifter 101*n* may also be connected to these lines. Examples thereof include a high-pass capacitor, choke coil, stub, filter or the like.

The configuration modifications of the antenna device 100 have been described so far. Next, modifications of operation of the antenna device 100 will be described.

Figure 7:
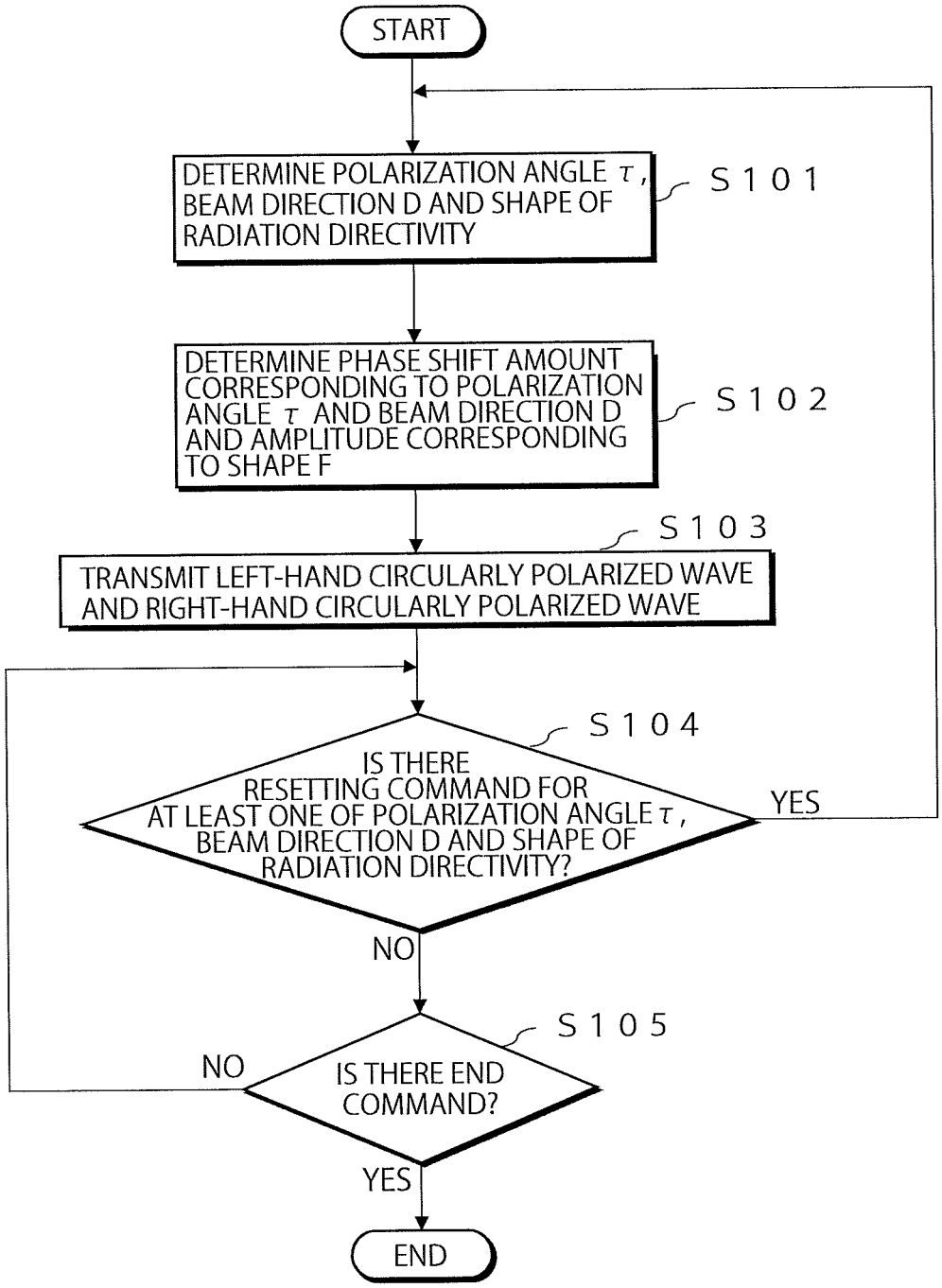
FIG. 7 is a transmission flowchart of an antenna device 100.
Figure 8:
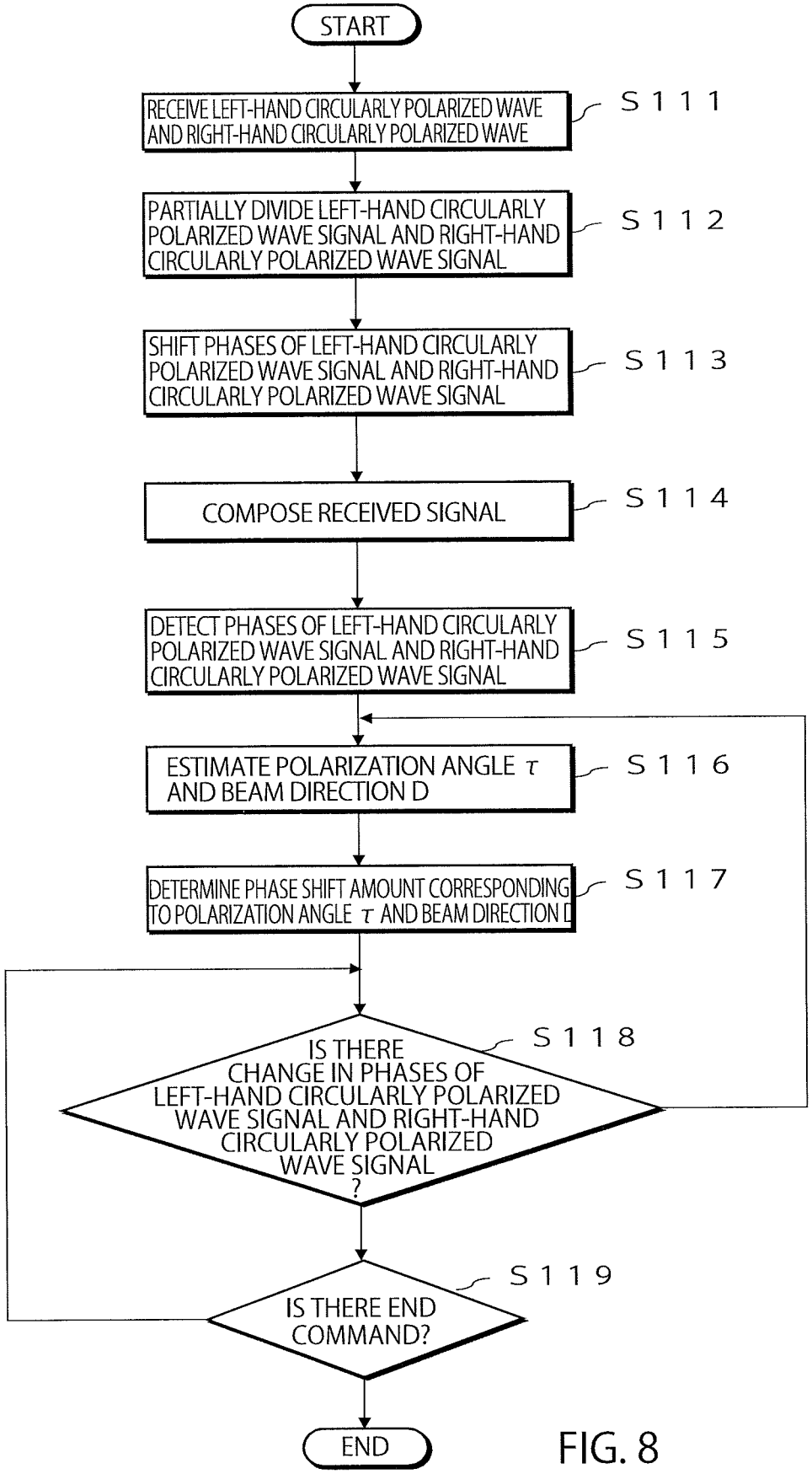
FIG. 8 is a reception flowchart of the antenna device 100.

Some of the steps in the flowcharts described in FIG. 7 and FIG. 8 may be executed independently or in parallel. For example, in step S112, after the left-hand circularly polarized wave signal and the right-hand circularly polarized wave signal are divided by the coupling circuits 105*a*1 to 105N2, step S113 and step S114, and step S115 to step S117 may be executed in parallel.

Although the operation has been described in the present embodiment as operations at the time of transmission and at the time of reception separately, both operations may be linked. For example, when reception from a destination communication device is also performed, the control circuit 103 determines the polarization angle $\tau$ and the beam direction D and determines the corresponding phase shift amount at the time of transmission. At the time of reception, the control circuit 103 may use a phase shift amount determined at the time of transmission.

Furthermore, when the polarization angle $\tau$ and the beam direction D at the time of transmission and reception are predetermined by a standard or through exchange with a partner communication device, the control circuit 103 may use a phase shift amount corresponding to the predetermined polarization angle $\tau$ and beam direction D.

In the present embodiment, operation of the antenna device 100 corresponding to one polarization angle $\tau_1$ and beam direction $D_1$ has been described so far, but the antenna device 100 can perform transmission and reception corresponding to a plurality of polarization angles $\tau$ and a plurality of beam directions D.

For example, two polarization angles $\tau_1$ and $\tau_{12}$ will be described using mathematical expressions. Equation (12) and equation (13) can be modified into equation (14) and equation (15).

[Formula 14]

$$\Delta\psi_1=\Delta\psi^{(\alpha)}=\ldots=\Delta\psi^{(n)}$$

$$\Delta\psi_{12}=\Delta\psi^{(n+1)}=\ldots=\Delta\psi^{(N)}$$

$$\Delta\psi_1\neq\Delta\omega_{12} \tag{14}$$

[Formula 15]

$$\tau_1=\Delta\psi_1/2$$

$$\tau_{12}=\Delta\psi_{12}/2 \tag{15}$$

The antenna elements 101*a* to 101*n* can transmit and receive linearly polarized waves with $\tau_1$ and the antenna elements 101$n_{+1}$ to 101N can transmit and receive linearly polarized waves with $\tau_{12}$. The polarization angles $\tau_1$ and $\tau_{12}$ can take any range.

Figure 14:
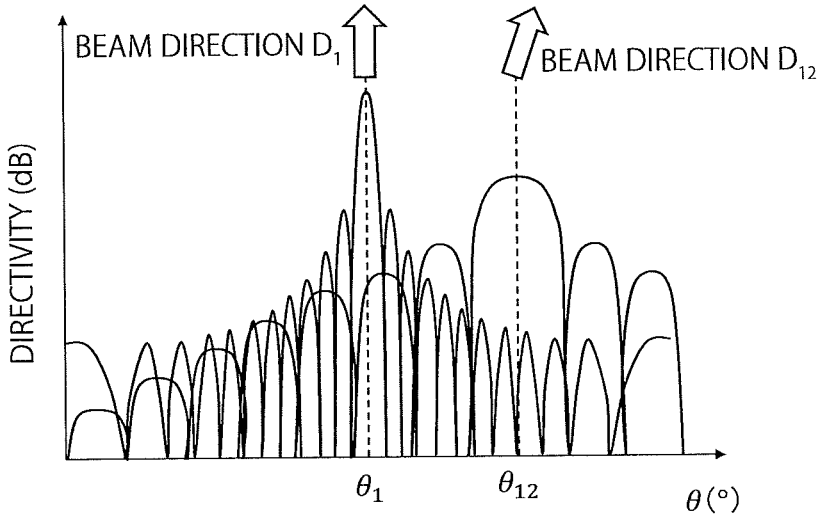
FIG. 14 is a diagram for describing a plurality of beam directions and a radiation pattern.

The phase shifters 102*a*1 to 102*n*1 and 102*a*2 to 102*n*2 each can change the beam direction D by changing the phases of the left-hand circularly polarized wave signals or the right-hand circularly polarized wave signals while keeping the phase difference $\Delta\psi_1$ corresponding to the polarization angle $\tau_1$. For example, the beam direction $D_1$ is assumed. The phase shifters 102$n_{+1}$1 to 102N1 and 102$n_{+1}$2 to 102N2 each can change the beam direction D by changing the phases of the left-hand circularly polarized wave signals or the right-hand circularly polarized wave signals while keeping the phase difference $\Delta\psi_{12}$ corresponding to the polarization angle $\tau_{12}$. For example, the beam direction $D_{12}$ is assumed. The beam directions $D_1$ and $D_{12}$ can take any direction. As an example, the beam direction and the radiation pattern are as shown in FIG. 14. FIG. 14 illustrates a case where the beam direction $D_1$ is represented by $\theta_1$ and $\varphi_1$ and the beam direction $D_{12}$ is represented by $\theta_{12}$ and $\varphi_1$.

Therefore, the antenna device 100 can perform transmission and reception corresponding to a plurality of polarization angles τ and a plurality of beam directions D.

In the present embodiment, the polarization angle and the beam direction D are estimated at the time of reception, but the radiation pattern may be estimated. In this case, the control circuit 103 acquires the amplitude of an input signal. The storage stores a relationship between the amplitude of the left-hand circularly polarized wave signal and right-hand circularly polarized wave signal and the radiation pattern as characteristic information. The control circuit 103 can estimate the radiation pattern of the received left-hand circularly polarized waves and right-hand circularly polarized waves and linearly polarized waves based on the acquired amplitude of the signals and characteristic information.

In the present embodiment, the control circuit 103 determines a phase shift amount corresponding to the polarization angle τ and the beam direction D. Moreover, the control circuit may also be configured to determine phase shift amounts based on a power loss when a signal passes through the phase shifters 102*a*1 to 102N2 (hereinafter, also referred to as "insertion loss").

Figure 15:
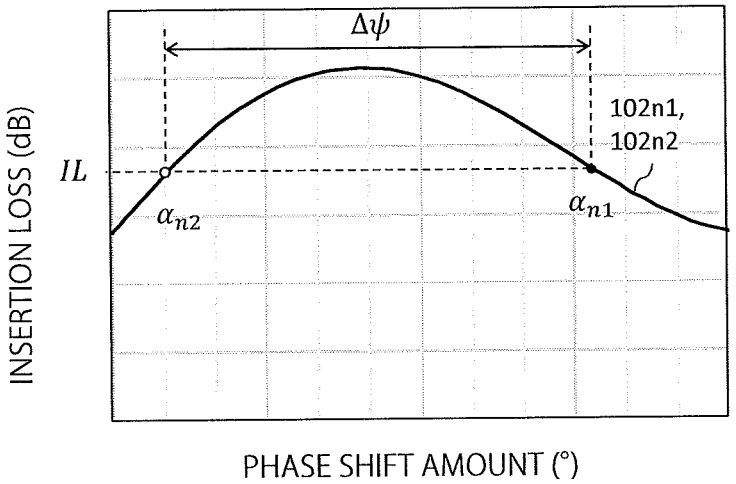
FIG. 15 is a diagram for describing phase shift amounts and insertion losses of phase shifters 102*n*1 and 102*n*2.

It is known that an insertion loss changes for each phase shift amount. An example is shown in FIG. 15. Description is given according to the present embodiment. Since the phase shifters 102*a*1 to 102N2 are similar to one another, the phase shifters 102*n*1 and 102*n*2 have similar insertion losses. The relationship between the phase shift amount and the insertion loss is stored in the storage as characteristic information.

When determining phase shift amounts of the phase shifter 102*n*1 and the phase shifter 102*n*2 corresponding to the antenna element 101*n*, the control circuit 103 may determine a phase shift amount which corresponds to the polarization angle τ and the beam direction D and at which insertion losses become equivalent based on the characteristic information. For example, in FIG. 15, the control circuit 103 determines phase shift amounts $\alpha_{N1}$ and $\alpha_{N2}$ at which insertion losses equally become IL.

Figure 16:
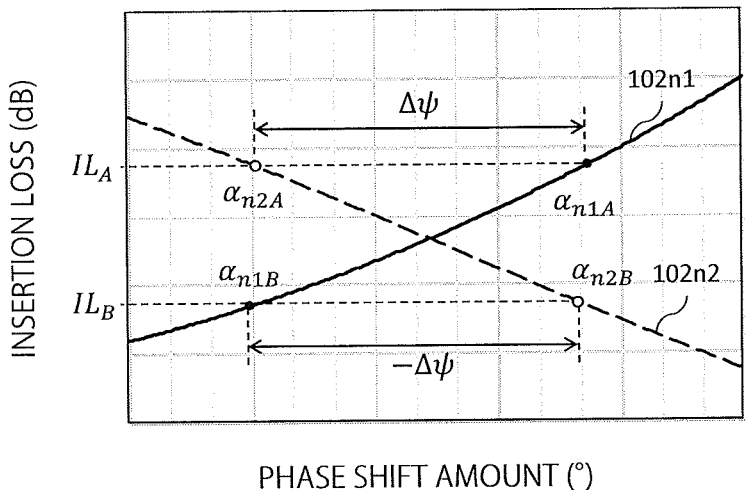
FIG. 16 is a diagram for describing a different example of phase shift amounts and insertion losses of phase shifters 102*n*1 and 102*n*2.

Even when the phase shifter 102*n*1 and the phase shifter 102*n*2 have different insertion losses, they are equally applicable. An example is shown in FIG. 16. The control circuit 103 determines phase shift amounts $\alpha_{N1A}$ and $\alpha_{N2A}$ at which insertion losses equally become $IL_A$. In this case, phase shift amounts $\alpha_{N1B}$ and $\alpha_{N2B}$ at which Δψ is equal and insertion losses equally become $IL_B$ correspond to minus polarization angles.

By determining the phase shift amount such that insertion losses become equivalent, it is possible to further improve a cross-polarization discrimination (XPD) without increasing a circuit scale.

A modification of the operation of the antenna device 100 has been described so far. Hereinafter, a modification of the antenna device 100 applicable to the present embodiment will be described using FIG. 17 to FIG. 27.

Figure 17:
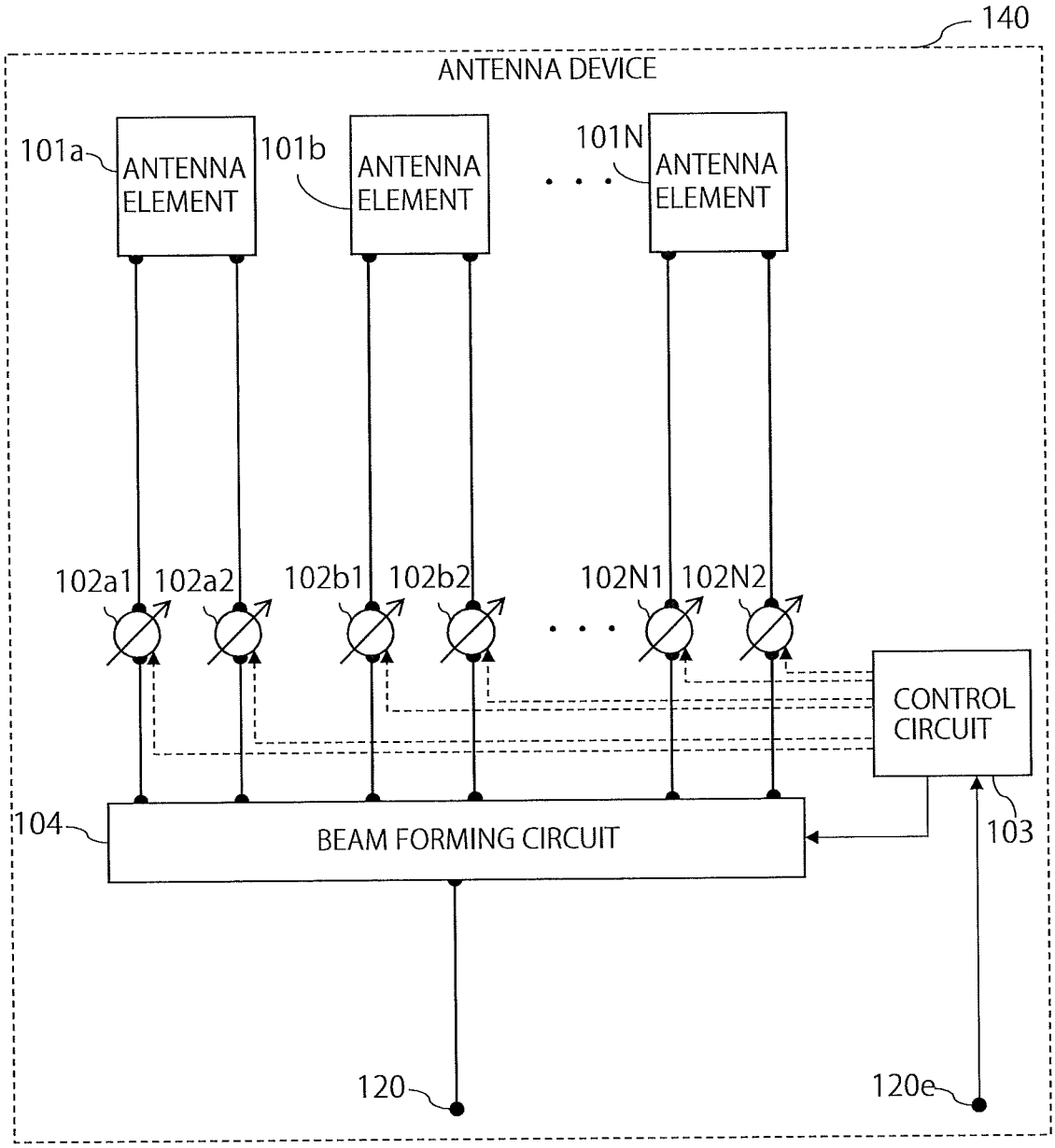
FIG. 17 is a configuration diagram of an antenna device 140 applicable to the first embodiment.

As a modification, a configuration example of an antenna device 140 from which the coupling circuits 105*a*1 to 105N2 are removed is shown in FIG. 17. In the antenna device 140, a connection point 120*e* is connected to the control circuit 103.

Operations of the coupling circuits 105*a*1 to 105N2 included in the operation of the antenna device 140 are omitted. More specifically, a received signal is input from the beam forming circuit 104 to a device connected to the antenna device 140 via the connection point 120. This device internally performs signal processing and inputs at least one of a part of the received signal, information on the phases and amplitudes of the left-hand circularly polarized wave signals and the right-hand circularly polarized wave signals which are the sources of the received signal to the control circuit 103 via the connection point 120*e*. The control circuit 103 estimates the polarization angle τ and the beam direction D, and determines phase shift amounts based on the characteristic information and input signals and/or information.

By eliminating the coupling circuits 105*a*1 to 105N2, it is possible to miniaturize and save labor of the antenna device. It is also possible to input the received signal to a device connected to the antenna device 140 without reducing power of the received signal.

Figure 18:
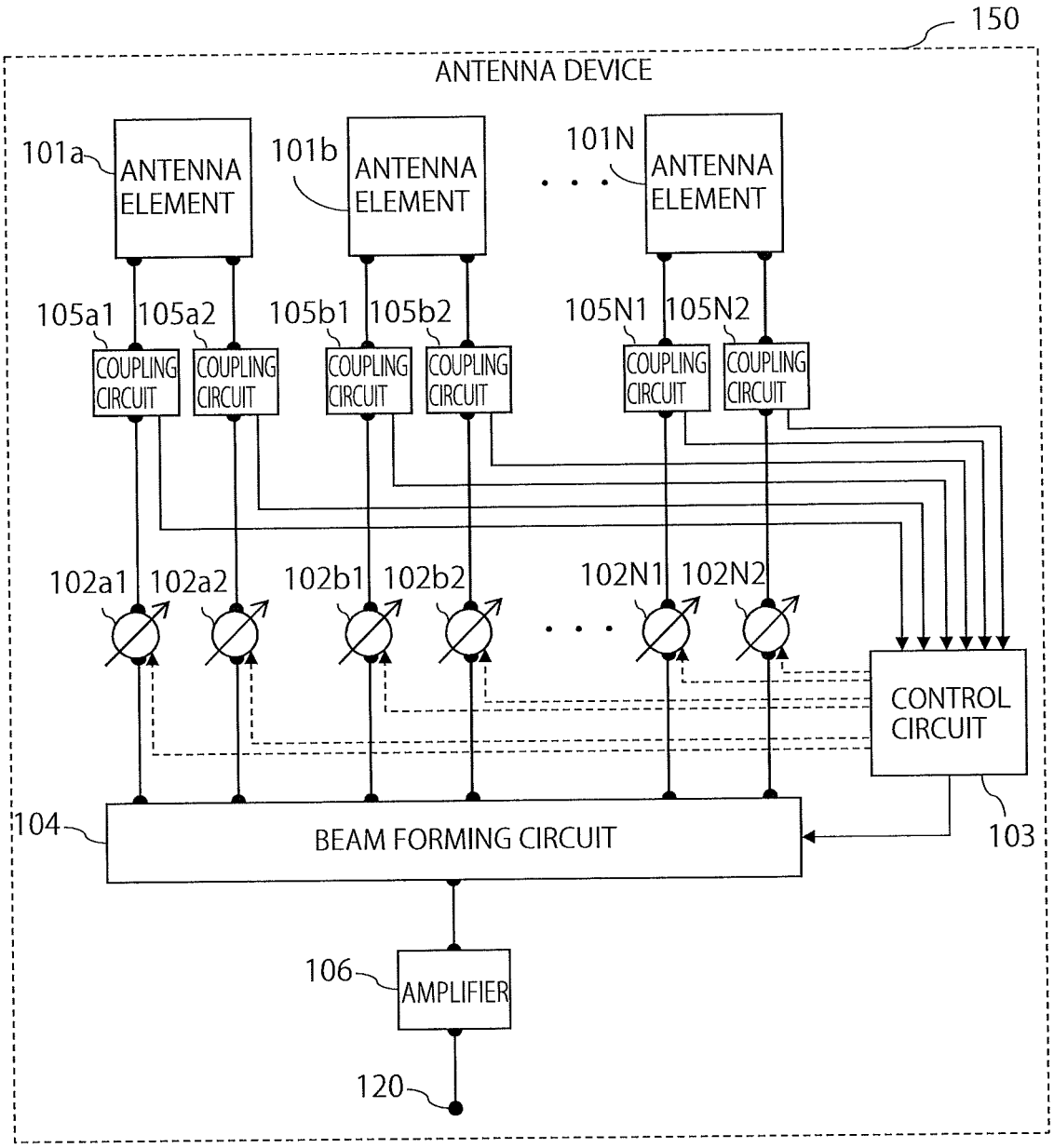
FIG. 18 is a configuration diagram of an antenna device 150 applicable to the first embodiment.

FIG. 18 illustrates a configuration example of an antenna device 150 provided with an amplifier 106 as a modification. The amplifier 106 is connected to the beam forming circuit 104 and the connection point 120.

The amplifier 106 amplifies power of a transmission signal and a received signal. As the amplifier 106, any device is applicable as long as it can amplify power of an input signal and output the amplified signal. For example, the amplifier 106 is a power amplifier (PA), low noise amplifier (LNA) or a combination of these amplifiers. The PA amplifies a transmission signal and the LNA amplifies a received signal. A limiter circuit or a filter (none of them is shown) to protect the amplifier 106 may be connected to a line connected to the amplifier 106.

Provision of the amplifier 106 makes it possible to amplify power of the left-hand circularly polarized waves and the right-hand circularly polarized waves transmitted by the antenna device 150 and amplify power of a received signal output by the antenna device 150. When the antenna device 150 is used for wireless communication, it is possible to improve a signal to noise ratio (SN ratio). When the antenna device 150 is used for wireless power transmission, it is possible to increase the amount of power transmitted.

Operation of the antenna device 150 is similar to that of the antenna device 100, and is therefore omitted, and the control circuit 103 may be configured to command ON/OFF, an amplification amount or the like of the amplifier 106.

Figure 19:
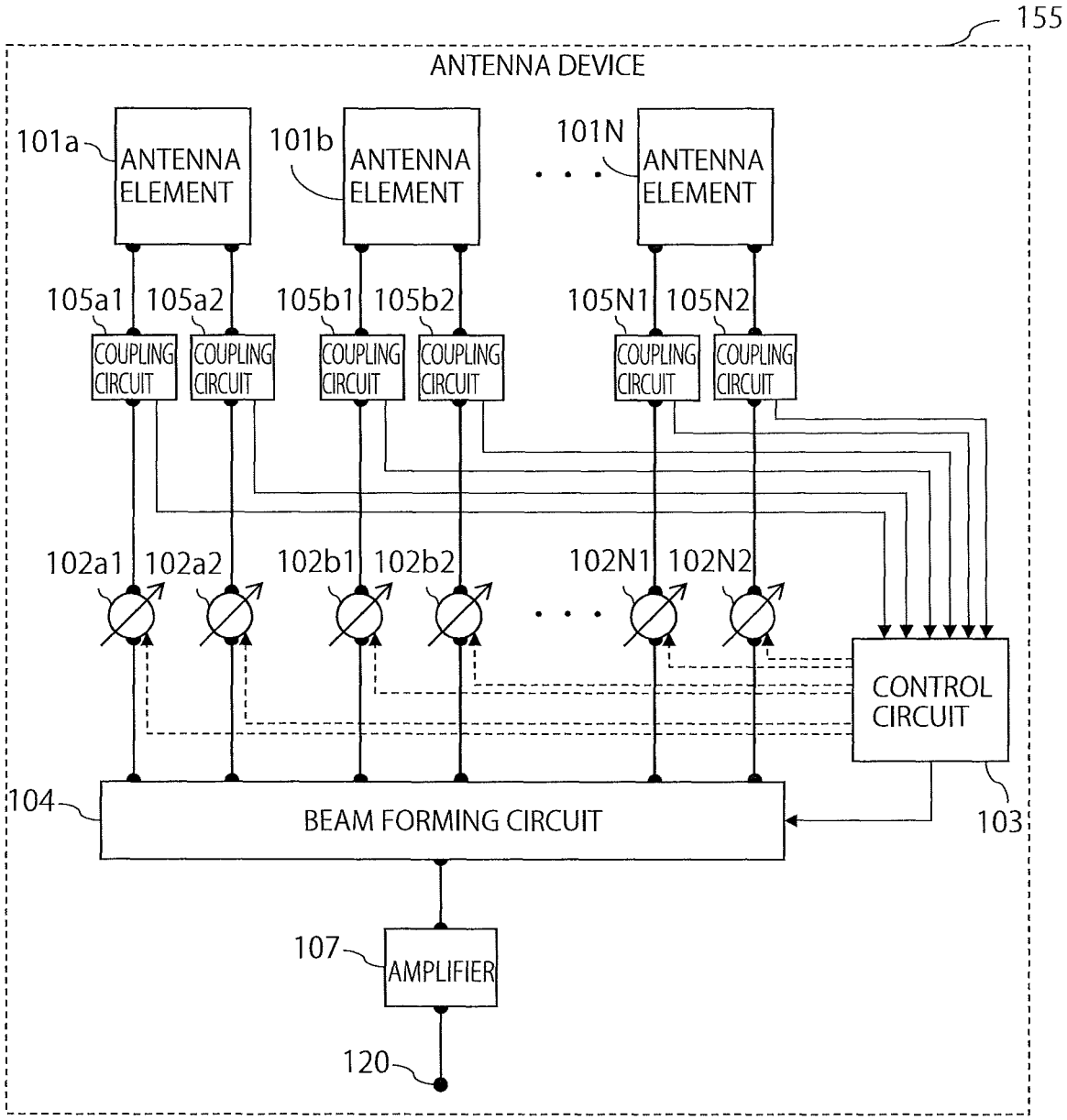
FIG. 19 is a configuration diagram of an antenna device 155 applicable to the first embodiment.
Figure 20:
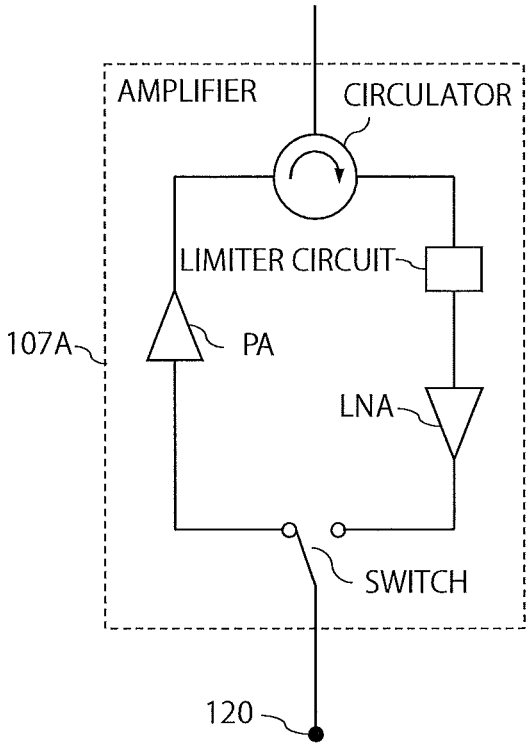
FIG. 20 is a diagram for describing an amplifier 107A.
Figure 21:
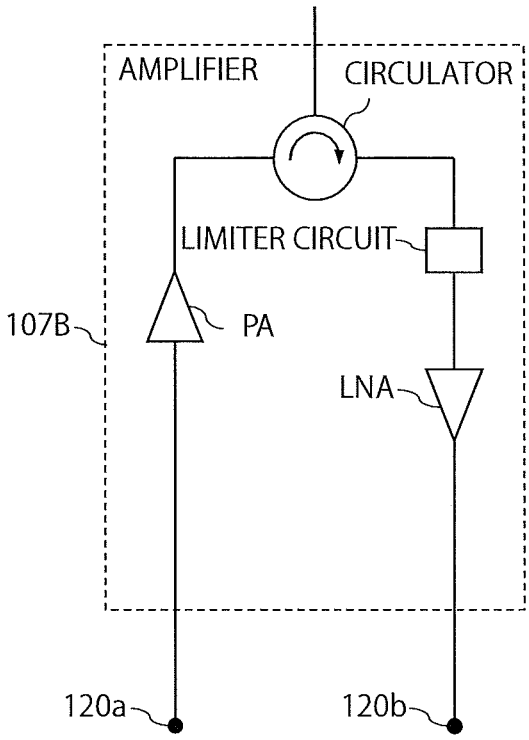
FIG. 21 is a diagram for describing an amplifier 107B.

As a modification, the amplifier 106 may be replaced by an amplifier 107. FIG. 19 illustrates a configuration example of such an antenna device 155. The amplifier 107 combines the PA and the LNA described in relation to the amplifier 106, and can thereby handle both transmission and reception. The amplifier 107 is provided with a PA, a LNA, a limiter circuit and a circulator. As the amplifier 107, both an amplifier 107A (common leg scheme) with one terminal using a switch and an amplifier 107B (isolated scheme) with two terminals without using any switch are applicable. The amplifier 107A is shown in FIG. 20 and the amplifier 107B is shown in FIG. 21.

Effects of the antenna device 155 are similar to the effects described in relation to the antenna device 150 and are therefore omitted. Operation of the antenna device 155 is similar to that of the antenna device 100, and is therefore omitted, but the control circuit 103 may be configured to command amplification amounts of the PA and the LNA, and switchover of the switch or the like.

Figure 22:
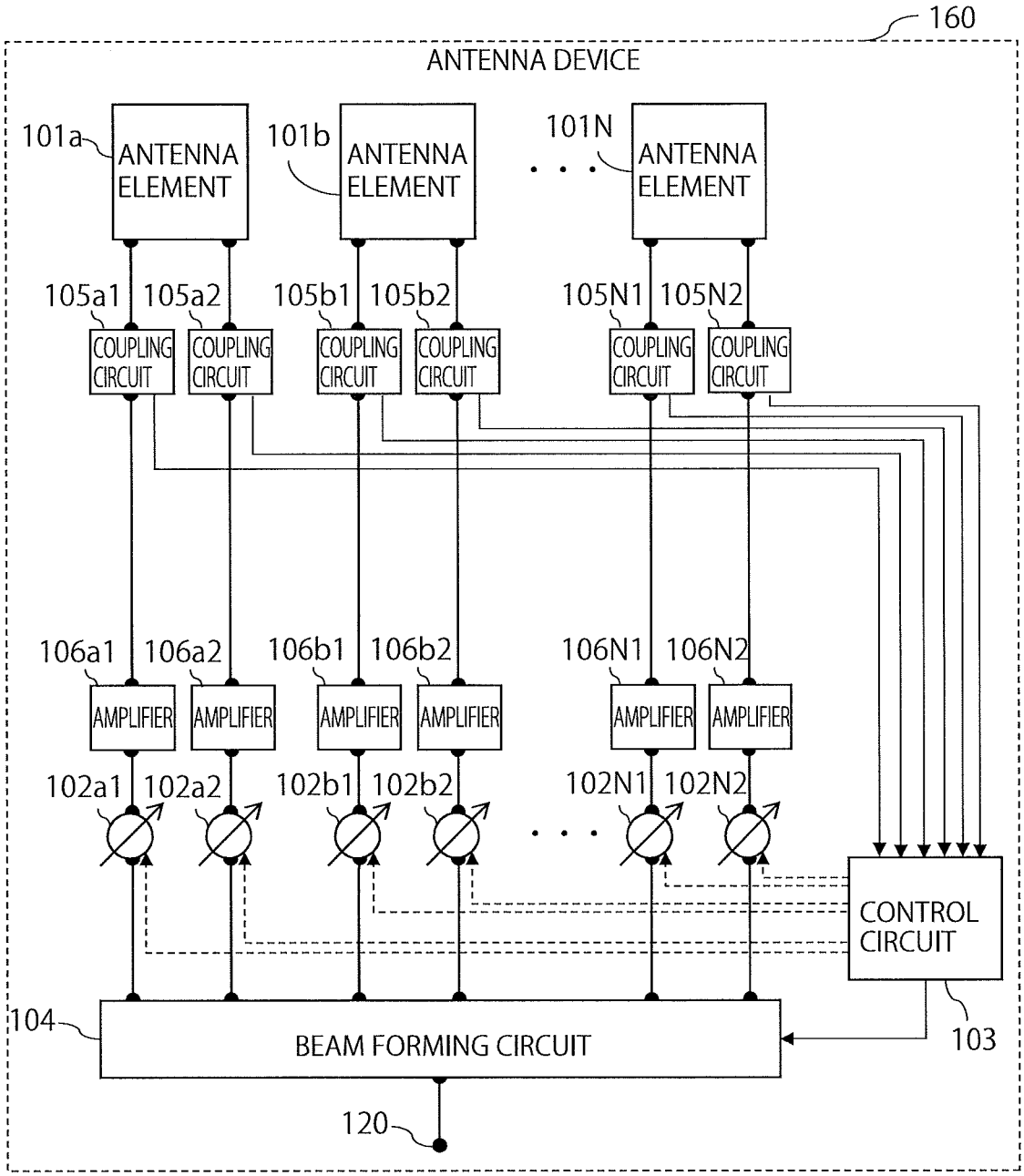
FIG. 22 is a configuration diagram of an antenna device 160 applicable to the first embodiment.

As a modification, the amplifier 106 may be used for amplification of the left-hand circularly polarized wave signals and the right-hand circularly polarized wave signals. FIG. 22 illustrates a configuration example of such an antenna device 160. Amplifiers 106*a*1, 106*b*1, . . . , 106N1, 106*a*2, 106*b*2, . . . , 106N2 (hereinafter, also referred to as "amplifiers 106*a*1 to 106N2") are connected to the phase shifters 102*a*1 to 102N2 and the coupling circuits 105*a*1 to 105N2 correspondingly. FIG. 22 shows an example, and the amplifiers 106a1 to 106N2 may also be connected to the phase shifters 102a1 to 102N2 and the beam forming circuit 104 correspondingly or may also be connected to the coupling circuits 105a1 to 105N2 and the antenna elements 101a to 101N correspondingly. Since effects and operation of an antenna device 160 are similar to those described in relation to the antenna device 150, and so description thereof is omitted.

Figure 23:
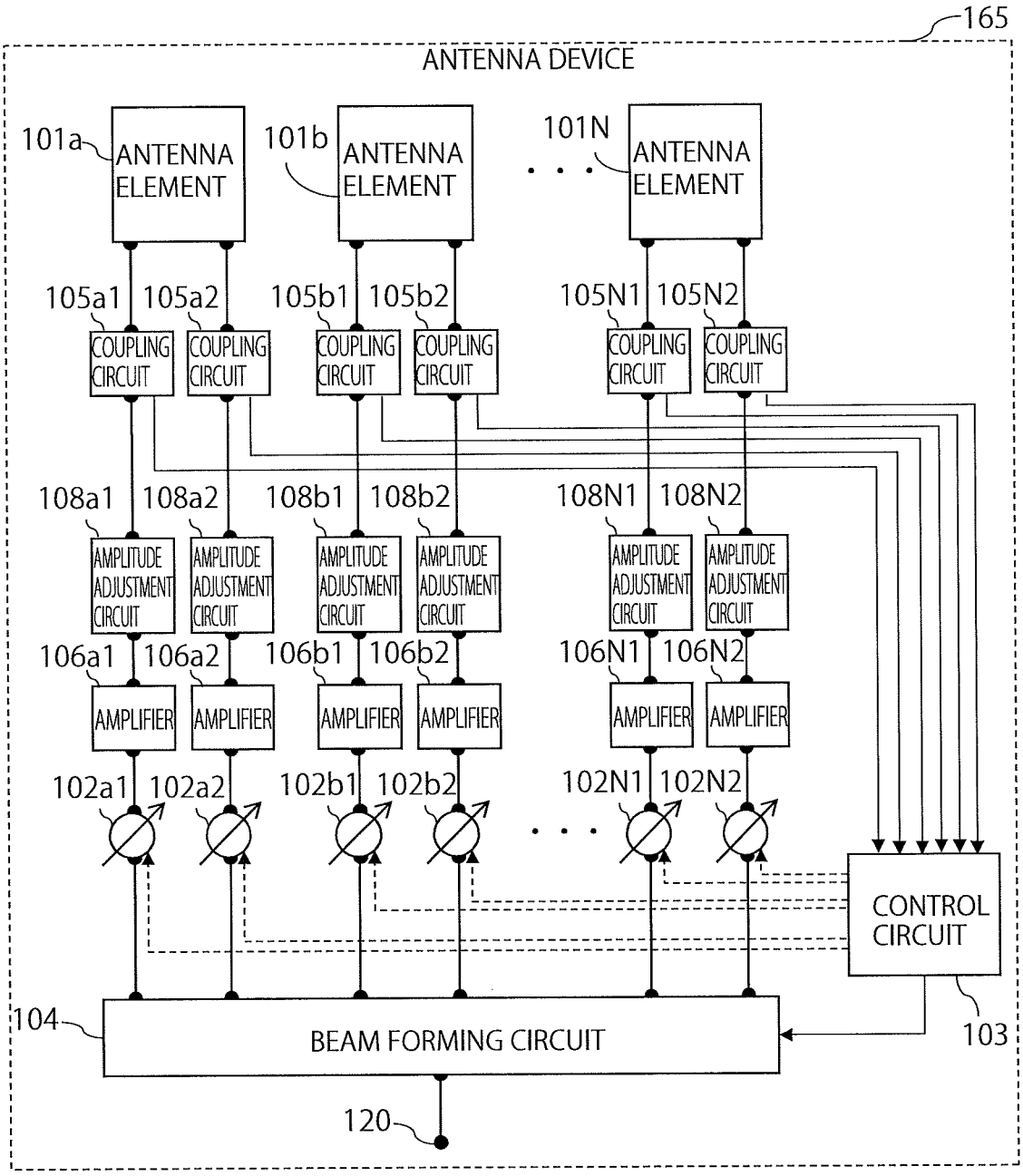
FIG. 23 is a configuration diagram of an antenna device 165 applicable to the first embodiment.

As a modification, the antenna device 160 may be further provided with a circuit to adjust amplitudes of the left-hand circularly polarized wave signals and the right-hand circularly polarized wave signals by amplification. FIG. 23 illustrates a configuration example of such an antenna device 165. Amplitude adjustment circuits 108a1, 108b1, . . . , 108N1, 108a2, 108b2, 108N2 (hereinafter, also referred to as "amplitude adjustment circuits 108a1 to 108N2") are connected to the amplifiers 106a1 to 106N2 and the coupling circuits 105a1 to 105N2 correspondingly. Other examples of FIG. 23 are similar to those of the antenna device 160, and so description thereof is omitted. In addition to the effects described in relation to the antenna device 150, an effect of the antenna device 165 is the ability to improve XPD by performing adjustment so as to equalize amplitudes of the left-hand circularly polarized wave signals and the right-hand circularly polarized wave signals input from or output to each of the antenna elements 101a to 101N. Operation of the antenna device 165 is similar to the operation of the antenna device 150, and is therefore omitted, but the control circuit 103 may be configured so as to command ON/OFF of the amplitude adjustment circuits 108a1 to 108N2, amplitude adjustment amounts or the like.

Figure 24:
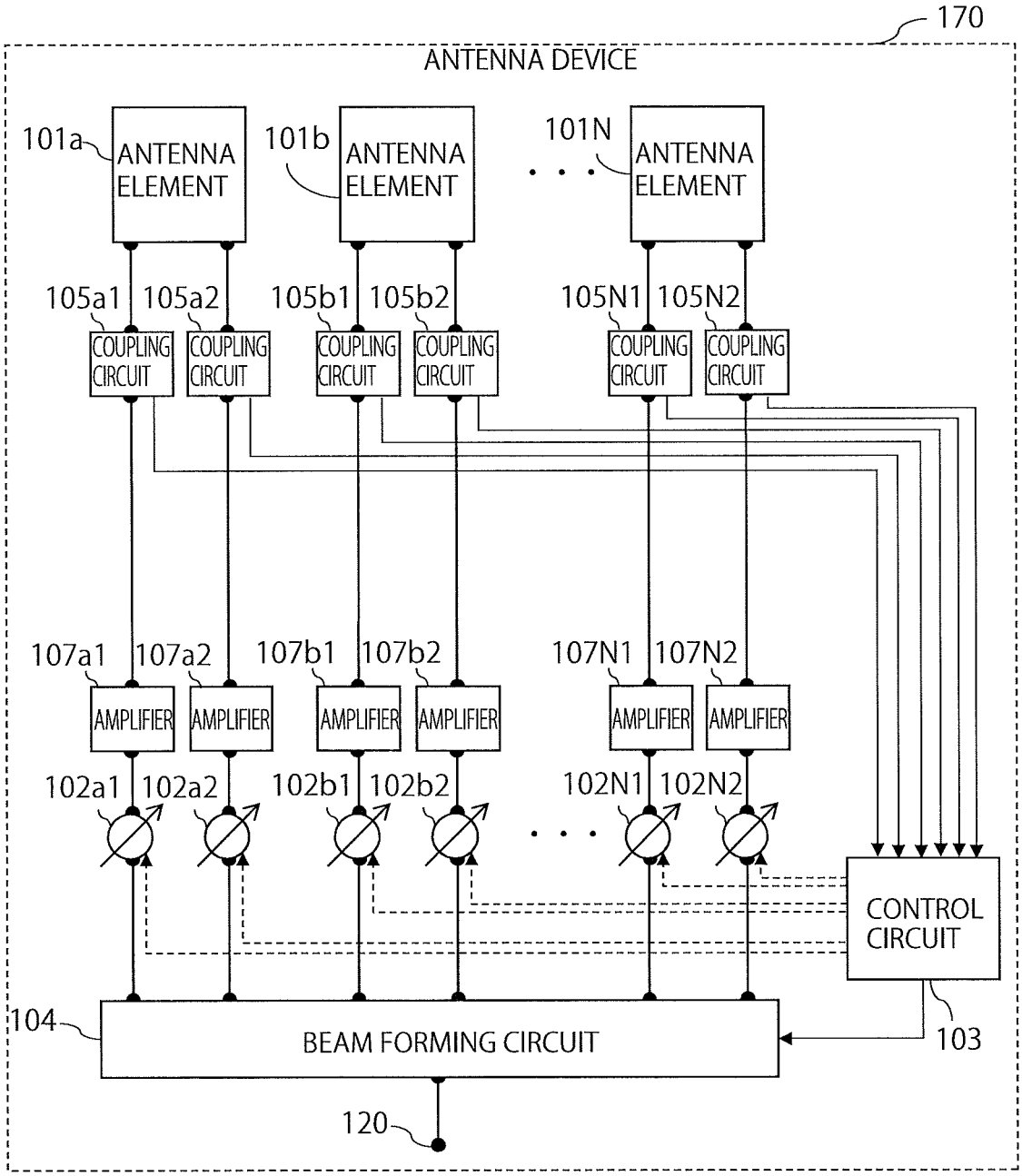
FIG. 24 is a configuration diagram of an antenna device 170 applicable to the first embodiment.
Figure 25:
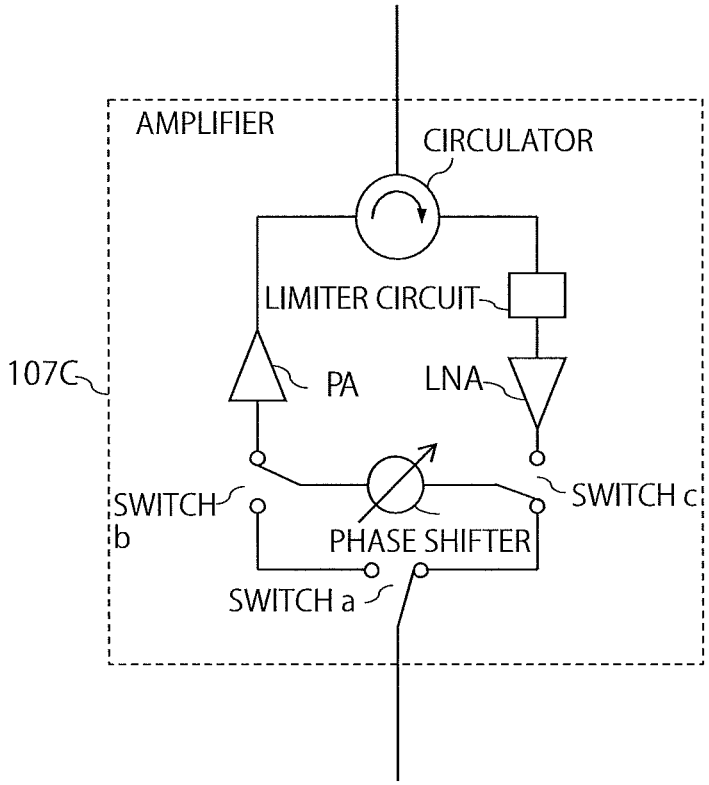
FIG. 25 is a diagram for describing an amplifier 107C.

As a modification, the amplifiers 106a1 to 106N2 may be replaced by amplifiers 107a1 to 107N1 and 107a2 to 107N2 correspondingly. FIG. 24 illustrates a configuration example of such an antenna device 170. As the amplifiers 107a1 to 107N1 and 107a2 to 107N2, the amplifier 107A described in relation to the antenna device 155 is applicable. Furthermore, the amplifiers 107a1 to 107N1 and 107a2 to 107N2 may include a phase shifter. As an example of such a phase shifter, FIG. 25 illustrates a phase shifter 107C. A phase shifter included in the phase shifter 107C may be similar to or different from the phase shifter described in the present embodiment.

Effects of the antenna device 170 are similar to the effects described in relation to the antenna device 155, and are therefore omitted. Operation of the antenna device 170 is similar to that of the antenna device 155, and is therefore omitted, but when the amplifier 107C is used, the control circuit 103 may be configured so as to command a phase shift amount or the like of the phase shifter included in the amplifier 107.

Figure 26:
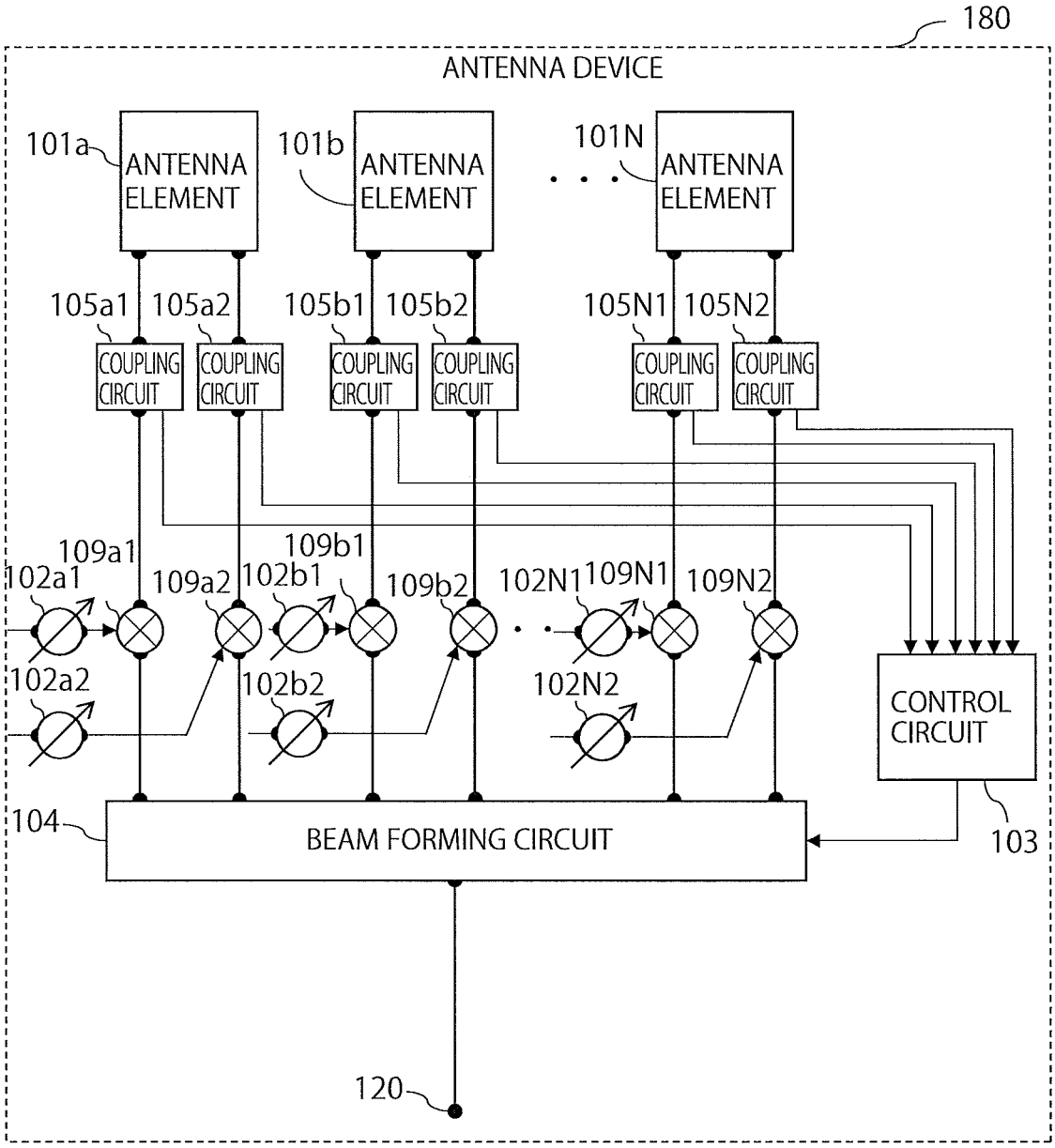
FIG. 26 is a configuration diagram of an antenna device 180 applicable to the first embodiment.

As a modification, a transmission signal transmitted from the connection point 120 may not be a high frequency signal. For example, this is a case where the transmission signal is an intermediate frequency (IF) signal whose frequency band is lower than that of a high frequency signal. FIG. 26 illustrates a configuration example of such an antenna device 180. The antenna device 180 is provided with mixers 109a1, 109b1, . . . , 109N1, 109a2, 109b2, . . . 109N2 (hereinafter, also referred to as "mixers 109a1 to 109N2"), and can switch between the IF signal and high frequency signal. A carrier high frequency signal is input to phase shifters 102a1 to 102N2 from a local oscillator (LO) (not shown). The mixers 109a1 to 109N2 switch between the IF signal and high frequency signal based on the left-hand circularly polarized wave signals and the right-hand circularly polarized wave signals and carrier high frequency signal. Note that the control circuit 103 transmits the determined phase shift amounts to the phase shifters 102a1 to 102N2 in the present modification as well, but since such transmission is complicated, it is not shown in FIG. 26.

The antenna device 180 can handle a device connected to the antenna device 180 even when the device does not use any high frequency signal. Operation of the antenna device 180 is similar to the operation described in relation to the antenna device 100, and is therefore omitted, but operation regarding switching between an IF signal and a high frequency signal will be described below.

At the time of transmission, an IF signal is input to the beam forming circuit 104 from the connection point 120. The beam forming circuit 104 divides the IF signal and outputs the intermediate frequency left-hand circularly polarized wave signals and right-hand circularly polarized wave signals to the mixers 109a1 to 109N2. The control circuit 103 determines the polarization angle $\tau$, the beam direction D, and the radiation pattern. The control circuit 103 determines and transmits the phase shift amount corresponding to the determined polarization angle $\tau$, beam direction D, and radiation pattern for each of the phase shifters 102a1 to 102N2. The phase shifters 102a1 to 102N2 receive a carrier high frequency signal from the LO and shift the phases of this signal with the respectively transmitted phase shift amounts. The phase shifters 102a1 to 102N2 output the phase-shifted signals to the corresponding mixers 109a1 to 109N2. The mixers 109a1 to 109N2 compose high frequency left-hand circularly polarized wave signals and right-hand circularly polarized wave signals from the input carrier high frequency signal and intermediate frequency left-hand circularly polarized wave signals or right-hand circularly polarized wave signals. By becoming high frequency left-hand circularly polarized wave signals and right-hand circularly polarized wave signals, these signals can be transmitted by the antenna elements 101a to 101N.

At the time of reception, the high frequency left-hand circularly polarized wave signals or right-hand circularly polarized wave signals received by the antenna elements 101a to 101N are input to the mixers 109a1 to 109N2. Furthermore, the phase shifters 102a1 to 102N2 respectively receive carrier high frequency signals from the LO and shift the phases of these signals with a predetermined phase shift amount or a phase shift amount transmitted from the control circuit 103. The mixers 109a1 to 109N2 convert the input carrier high frequency signal and high frequency left-hand circularly polarized wave signal or right-hand circularly polarized wave signal to intermediate frequency left-hand circularly polarized wave signal and right-hand circularly polarized wave signal. By becoming intermediate frequency left-hand circularly polarized wave signal and right-hand circularly polarized wave signal, the IF signal is composed, which can be handled by a device connected to the antenna device 180.

Figure 27:
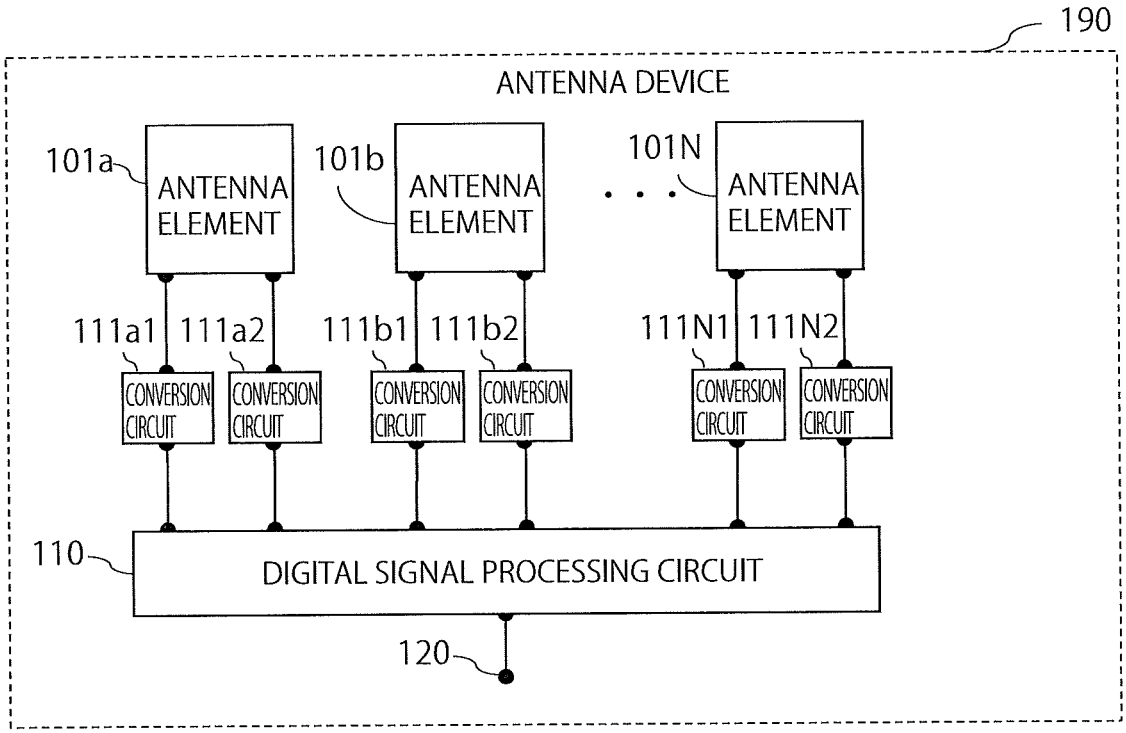
FIG. 27 is a configuration diagram of an antenna device 190 applicable to the first embodiment.

As a modification, FIG. 27 illustrates an antenna device 190 that implements the present embodiment using a digital circuit. The antenna device 190 is provided with a digital signal processing circuit 110 and conversion circuits 111a1, 111b1, . . . , 111N1 (hereinafter, also referred to as "conversion circuits 111a1 to 111N1"), 111a2, 111b2, . . . , 111N2 (hereinafter, also referred to as "conversion circuits 111a2 to 111N2") in addition to the antenna elements 101a to 101N. Hereinafter, the conversion circuits 111a1 to 111N1 and 111a2 to 111N2 are also referred to as "conversion circuits 111a1 to 111N2."

The digital signal processing circuit 110 performs signal processing in a digital region. At the time of transmission, the digital signal processing circuit 110 generates information indicating left-hand circularly polarized wave signals and right-hand circularly polarized wave signals from information indicating a transmission signal. The information indicating the left-hand circularly polarized wave signals and the right-hand circularly polarized wave signals includes amplitudes, phases or the like of the left-hand circularly polarized wave signals and right-hand circularly polarized wave signals output when those signals are analog-digital (A/D) converted. The digital signal processing circuit 110 determines the polarization angle τ, the beam direction D and the radiation pattern of linearly polarized waves to be transmitted and generates information indicating the left-hand circularly polarized wave signals and the right-hand circularly polarized wave signals including the corresponding amplitudes and phases. The characteristic information stored in the storage (not shown) is used to generate information indicating the left-hand circularly polarized wave signals and the right-hand circularly polarized wave signals. The digital signal processing circuit 110 transmits information indicating the left-hand circularly polarized wave signals to the conversion circuits 111*a*1 to 111N1 and transmits information indicating the right-hand circularly polarized wave signals to the conversion circuits 111*a*2 to 111N2.

At the time of reception, the digital signal processing circuit 110 generates information indicating the received signal from information obtained by A/D-converting the left-hand circularly polarized wave signals and right-hand circularly polarized wave signals output from the antenna elements 101*a* to 101N. The A/D-converted information includes information indicating the left-hand circularly polarized wave signals and right-hand circularly polarized wave signals including phases and amplitude. The digital signal processing circuit 110 generates information indicating the received signal based on the information indicating the left-hand circularly polarized wave signals and right-hand circularly polarized wave signals and the characteristic information stored in the storage. The digital signal processing circuit 110 sends the information indicating this received signal to the connection point 120.

The digital signal processing circuit 110 is a processor or the like and a device similar to the control circuit 103 described in the present embodiment is applicable.

The conversion circuits 111*a*1 to 111N2 are circuits that perform A/D conversion. The conversion circuits 111*a*1 to 111N1 A/D-convert the left-hand circularly polarized wave signals and information indicating the left-hand circularly polarized wave signals, and the conversion circuits 111*a*2 to 111N2 A/D-convert the left-hand circularly polarized wave signals and information indicating the left-hand circularly polarized wave signals.

An effect of the antenna device 190 is the ability to reduce the circuit scale by replacing operation of an analog circuit by digital signal processing. As the circuit scale decreases, it is possible to reduce the size and save labor.

Since the digital signal processing circuit 110 performs part of operation of the antenna device 100, operation of the antenna device 190 is similar to the operation of the antenna device 100. For example, operations in S101 and S102, and S104 and S105 in the flowchart shown in FIG. 7 are performed in a digital region by the digital signal processing circuit 110. In step S103, in addition to transmission of left-hand circularly polarized wave and right-hand circularly polarized waves by the antenna elements 101*a* to 101N, the digital signal processing circuit 110 newly performs processing in the digital region other than A/D conversion by the conversion circuits 111*a*1 to 111N2.

Furthermore, step S112 is eliminated from the flowchart shown in FIG. 8, and in addition to transmission of the left-hand circularly polarized waves and right-hand circularly polarized waves by the antenna elements 101*a* to 101N in step S111, the digital signal processing circuit 110 newly performs processing in the digital region other than A/D conversion by the conversion circuits 111*a*1 to 111N2.

The antenna device 100 according to the first embodiment and modifications thereof have been described so far. The antenna device according to the present embodiment shifts the phases of the left-hand circularly polarized wave signals or the right-hand circularly polarized wave signals using one corresponding phase shifter respectively. By so doing, it is possible to transmit or receive the left-hand circularly polarized waves and right-hand circularly polarized waves in accordance with the any polarization angle τ, the beam direction D and the radiation pattern. The circuit scale can be reduced by shifting the phases corresponding to the any polarization angle τ, beam direction D and the radiation pattern using one corresponding phase shifter respectively. It is possible to achieve miniaturization and labor saving of the antenna device by reducing the circuit scale.

Second Embodiment

Figure 28:
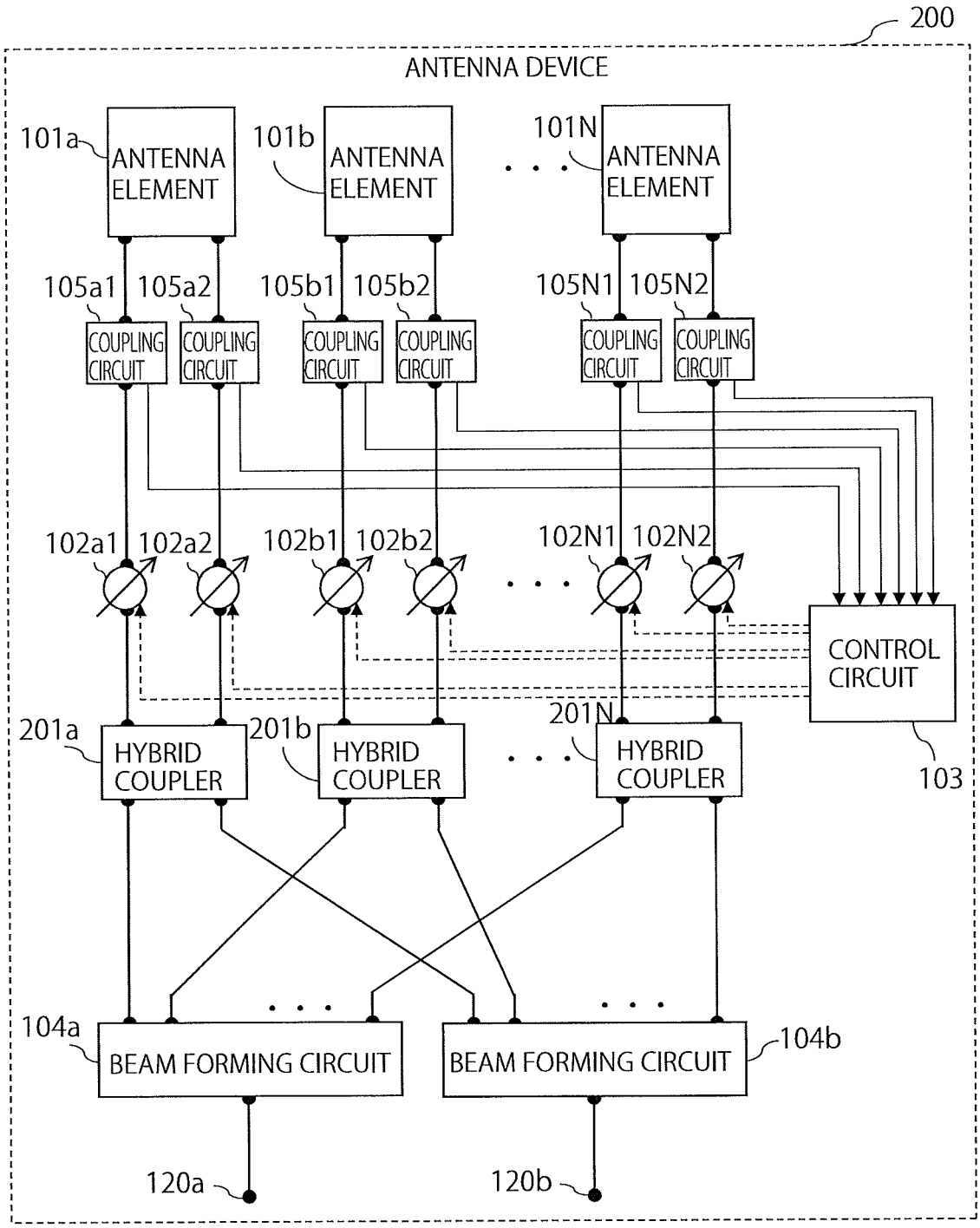
FIG. 28 is a configuration diagram of an antenna device 200 in a second embodiment.

FIG. 28 is a diagram illustrating a configuration of an antenna device 200 according to a second embodiment. The antenna device 200 corresponds to the antenna device 100 according to the first embodiment further provided with hybrid couplers 201*a* to 201N. The antenna device 200 is further provided with two beam forming circuits 104*a* and 104*b*. The antenna device 200 can transmit and receive linearly polarized waves with different polarization angles without changing phase shift amounts of the phase shifters 102*a*1 to 102N2. More specifically, the antenna device 200 can transmit and receive linearly polarized waves whose polarization planes are orthogonal (hereinafter, "orthogonal" includes "substantially orthogonal"). The antenna device 200 can efficiently perform communication by transmitting and receiving linearly polarized waves whose polarization planes are orthogonal in addition to the effects described in the first embodiment.

An overview of the antenna device 200 at the time of transmission is similar to the antenna device 100. As for differences, phase differences are provided between left-hand circularly polarized wave signals and right-hand circularly polarized wave signals output from the hybrid couplers 201*a*, 201*b*, . . . , 201N (hereinafter, also referred to as hybrid couplers 201*a* to 201N). A signal input from the beam forming circuit 104*a* and a signal input from the beam forming circuit 104*b* to the hybrid couplers 201*a* to 201N differ in phase differences between the left-hand circularly polarized wave signals and right-hand circularly polarized wave signals to be output. In this way, the antenna device 200 transmits the orthogonal left-hand circularly polarized waves and right-hand circularly polarized waves without changing the phase shift amounts of the phase shifters 102*a*1 to 102N2. The antenna device 200 transmits the orthogonal linearly polarized waves by transmitting the left-hand circularly polarized waves and the right-hand circularly polarized waves simultaneously.

An overview of the antenna device 200 at the time of reception is similar to the antenna device 100. As for differences, the hybrid couplers 201*a* to 201N each compose a received signal from each left-hand circularly polarized wave signal and each right-hand circularly polarized wave signal. The hybrid couplers 201*a* to 201N output the received signal to either the beam forming circuit 104*a* or 104*b* with a phase difference between the input left-hand circularly polarized wave signal and right-hand circularly polarized wave signal. The beam forming circuits 104*a* and 104*b* output the composed signal to the connection points 120*a* and 120*b*. In this way, the antenna device 200 receives the orthogonal left-hand circularly polarized wave and right-hand circularly polarized wave without changing the phase shift amounts of the phase shifters 102*a*1 to 102N2. The antenna device 200 receives the orthogonal linearly polarized waves.

The beam forming circuits 104*a* and 104*b* of the present embodiment output transmission signals to the hybrid couplers 201*a* to 201N but do not output the left-hand circularly polarized wave signal and the right-hand circularly polarized wave signal. The beam forming circuits 104*a* and 104*b* output a transmission signal with a freely-selected amplitude for each hybrid coupler. Furthermore, the beam forming circuits 104*a* and 104*b* output the received signals to the connection points 120*a* and 120*b*. The beam forming circuits 104*a* and 104*b* may combine the received signals and output the combined signals.

The beam forming circuits 104*a* and 104*b* may be one circuit. In this case, the connection points 120*a* and 120*b* may not be separate.

The hybrid couplers 201*a* to 201N divide and combine signals. At the time of transmission, the hybrid couplers 201*a* to 201N each divide a transmission signal to each left-hand circularly polarized wave signal and each right-hand circularly polarized wave signal and output the transmission signals. At the time of reception, the hybrid couplers 201*a* to 201N combine received signals from each left-hand circularly polarized wave signal and each right-hand circularly polarized wave signal and output the combined received signal.

The hybrid couplers 201*a* to 201N divide the transmission signals to each left-hand circularly polarized wave signal and each right-hand circularly polarized wave signal assigned with a phase difference which differs depending on the terminal to which the transmission signal is input. The amplitudes of the left-hand circularly polarized wave signal and the right-hand circularly polarized wave signal divided by the hybrid couplers 201*a* to 201N are similar. The amplitudes of the left-hand circularly polarized wave signal and the right-hand circularly polarized wave signal of the hybrid coupler 201*n* may be different from the amplitudes of the left-hand circularly polarized wave signal and the right-hand circularly polarized wave signal of the hybrid coupler 201*m*.

At the time of reception, the hybrid couplers 201*a* to 201N compose a received signal from the left-hand circularly polarized wave signals and the right-hand circularly polarized wave signals input from the phase shifters 102*a*1 to 102N2. The hybrid couplers 201*a* to 201N output the combined received signal in accordance with the phase difference between the input left-hand circularly polarized wave signal and right-hand circularly polarized wave signal. The received signal is output to any one of the beam forming circuits 104*a* and 104*b*.

As the hybrid couplers 201*a* to 201N, any circuit with four terminals for dividing a signal into two signals and combining the two signals into one signal is applicable. Examples thereof include a magic Tee, a rat race, a hybrid circuit such as a quadrature hybrid coupler and a 180° hybrid coupler. A case where a quadrature hybrid coupler is applied will be described as an example in the present embodiment.

The storage described in the first embodiment stores characteristic information corresponding to the phase differences between the left-hand circularly polarized wave signal and the right-hand circularly polarized wave signal from the hybrid couplers 201*a* to 201N.

Operation of the antenna device 200 at the time of transmission is mostly similar to the operation of the antenna device 100, and is therefore omitted, whereas differences are supplemented. In the present embodiment, a transmission signal input from the connection point 120*a* is referred to as a "first transmission signal" and a transmission signal input from the connection point 120*b* is referred to as a "second transmission signal." The left-hand circularly polarized wave signal and the right-hand circularly polarized wave signal into which the first transmission signal is divided are referred to as a "first left-hand circularly polarized wave signal" and a "first right-hand circularly polarized wave signal." The left-hand circularly polarized wave signal and the right-hand circularly polarized wave signal into which the second transmission signal is divided are referred to as a "second left-hand circularly polarized wave signal" and a "second right-hand circularly polarized wave signal." Frequency bands of the first transmission signal and the second transmission signal are equivalent. Furthermore, frequency bands of the first left-hand circularly polarized wave signal and the second left-hand circularly polarized wave signal are also equivalent and frequency bands of the first right-hand circularly polarized wave signal and the second right-hand circularly polarized wave signal are also equivalent.

Furthermore, in the present embodiment, the phase of the first right-hand circularly polarized wave signal is divided delayed by 90° compared to the phase of the first left-hand circularly polarized wave signal. The phases are divided so that the amplitude of the first left-hand circularly polarized wave signal is similar to the amplitude of the first right-hand circularly polarized wave signal. The phase of the second left-hand circularly polarized wave signal is divided delayed by 90° compared to the phase of the second right-hand circularly polarized wave signal. The phases are divided so that the amplitude of the second left-hand circularly polarized wave signal is similar to the amplitude of the second right-hand circularly polarized wave signal.

Figure 29:
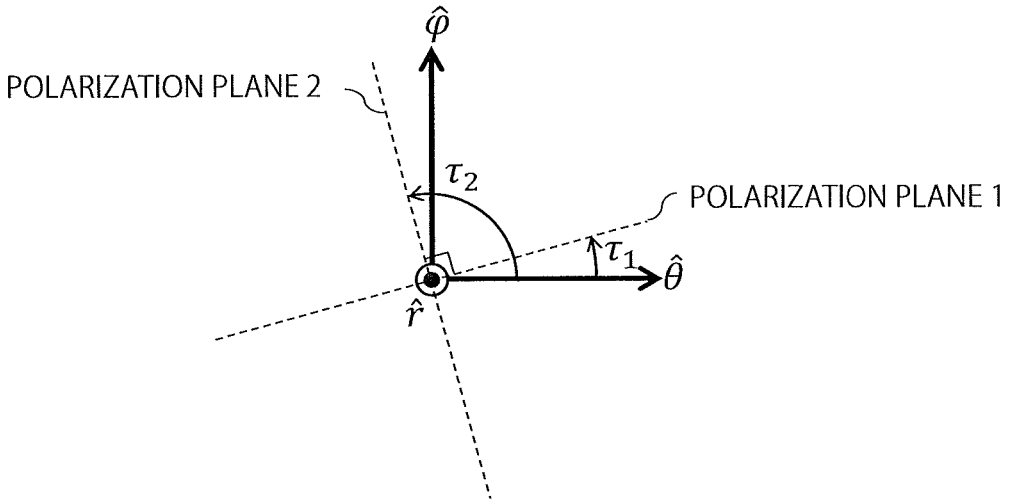
FIG. 29 is a diagram showing polarization angles $\tau_1$ and $\tau_2$ in the second embodiment.

In the present embodiment, it is assumed that the polarization angle of a linearly polarized wave based on the first left-hand circularly polarized wave signal and the first right-hand circularly polarized wave signal (hereinafter, also referred to as a "first linearly polarized wave") is $\tau_1$, and the polarization angle of the linearly polarized wave based on the second left-hand circularly polarized wave signal and the second right-hand circularly polarized wave signal (hereinafter, also referred to as a "second linearly polarized wave") is $\tau_2$. FIG. 29 illustrates the polarization angle $\tau_1$ and the polarization angle $\tau_2$. The first linearly polarized wave is orthogonal to the second linearly polarized wave. Note that it is assumed that the beam direction is $D_1$ and the shape is $F_1$.

In the present embodiment, the control circuit 103 may determine either a phase shift amount for the first left-hand circularly polarized wave signal and the first right-hand circularly polarized wave signal to correspond to the polarization angle $\tau_1$, beam direction $D_1$ and shape $F_1$ or a phase shift amount for the second left-hand circularly polarized wave signal and the second right-hand circularly polarized wave signal to correspond to the polarization angle $\tau_2$, beam direction $D_1$ and shape $F_1$. If the phase shift amount corresponds to one, the phase shift amount also corresponds to the other.

The antenna device 200 may transmit the first linearly polarized wave and the second linearly polarized wave by switching between the first and second linearly polarized waves or transmit those linearly polarized waves simultaneously.

The above-described matter will be described using mathematical expressions. In the present embodiment, the phase of the first right-hand circularly polarized wave signal is divided delayed by 90° from the phase of the first left-hand circularly polarized wave signal and the phase of the second left-hand circularly polarized wave signal is divided delayed by 90° from the phase of the second right-hand circularly polarized wave signal. Thus, the relationship between the polarization angles $\tau_1$ and $\tau_2$ is expressed by equation (16) using a phase difference $\Delta\psi_2$ between the second left-hand circularly polarized wave signal and the second right-hand circularly polarized wave signal.

[Formula 16]

$$\tau_2 = \Delta\psi_2^{(n)}/2 = \frac{\Delta\psi_1^{(n)} + 180^\circ}{2} = \tau_1 + 90^\circ \tag{16}$$

Therefore, it has been shown that the first linearly polarized wave is orthogonal to the second linearly polarized wave.

Operation of the antenna device 200 at the time of reception is mostly similar to the operation of the antenna device 100, and is therefore omitted, whereas differences are supplemented. As an example in the present embodiment, it is assumed that the linearly polarized wave with the polarization angle $\tau_1$ and the linearly polarized wave with the polarization angle $\tau_2$ shown in FIG. 29 are received. In the description at the time of reception as well as the description at the time of transmission, the linearly polarized wave with the polarization angle $\tau_1$ is referred to as a "first linearly polarized wave" and the linearly polarized wave with the polarization angle $\tau_2$ is referred to as a "second linearly polarized wave." The beam directions of the first linearly polarized wave and the second linearly polarized wave are equally assumed to be $D_1$. The left-hand circularly polarized wave signals and right-hand circularly polarized wave signals whereby the antenna elements 101*a* to 101N receive and output the first linearly polarized waves are referred to as "first left-hand circularly polarized wave signals" and "first right-hand circularly polarized wave signals." The left-hand circularly polarized wave signals and right-hand circularly polarized wave signals whereby the antenna elements 101*a* to 101N receive and output the second linearly polarized waves are referred to as "second left-hand circularly polarized wave signals" and "second right-hand circularly polarized wave signals." A signal obtained by the hybrid couplers 201*a* to 201N combining the first left-hand circularly polarized wave signal and the first right-hand circularly polarized wave signal is referred to as a "first received signal" and a signal obtained by combining the second left-hand circularly polarized wave signal and the second right-hand circularly polarized wave signal is referred to as a "second received signal." Frequency bands of the first left-hand circularly polarized wave signal and the second left-hand circularly polarized wave signal are equivalent and frequency bands of the first right-hand circularly polarized wave signal and the second right-hand circularly polarized wave signal are equivalent. Frequency bands of the first received signal and the second received signal are also equivalent.

A difference from the antenna device 100 is that the antenna device 200 is a device that composes the first received signal and the second received signal. In the antenna device 100, the beam forming circuit 104 composes the received signals, whereas in the antenna device 200, the hybrid couplers 201*a* to 201N compose the first received signal and the second received signal.

As described in the first embodiment, the control circuit 103 estimates the polarization angle $\tau$ and the beam direction D of the linearly polarized wave received by the antenna elements 101*a* to 101N from the input signal. The control circuit 103 determines a phase shift amount corresponding to the estimated polarization angle $\tau$ and beam direction D and transmits them to the phase shifters 102*a*1 to 102N2. This phase shift amount becomes a phase shift amount also corresponding to a linearly polarized wave with the estimated polarization angle $\tau$ and a different linearly polarized wave orthogonal to the polarization angle $\tau$.

The hybrid couplers 201*a* to 201N have different destinations of the composed received signal depending on phase differences between the input left-hand circularly polarized wave signals and the right-hand circularly polarized wave signals. For example, in the present embodiment, it is assumed that the phase of the first right-hand circularly polarized wave signals input to the hybrid couplers 201*a* to 201N is delayed by 90° from the phase of the first left-hand circularly polarized wave signals and the phase of the second left-hand circularly polarized wave signals is delayed by 90° from the phase of the second right-hand circularly polarized wave signals.

In this case, the first received signal is output to the beam forming circuit 104*a* and the second received signal is output to the beam forming circuit 104*b*.

The antenna device 200 may receive the first linearly polarized wave and the second linearly polarized wave by switching between the first and second linearly polarized waves or may receive the linearly polarized waves simultaneously.

The antenna device 200 of the present embodiment has been described so far. The modification described in the first embodiment is applicable as the antenna device 200. The antenna device 200 may be further provided with the hybrid couplers 201*a* to 201N and may be thereby enabled to perform communication efficiently by transmitting and receiving linearly polarized waves whose polarization planes are orthogonal to each other in addition to the effects described in the first embodiment.

Third Embodiment

Figure 30:
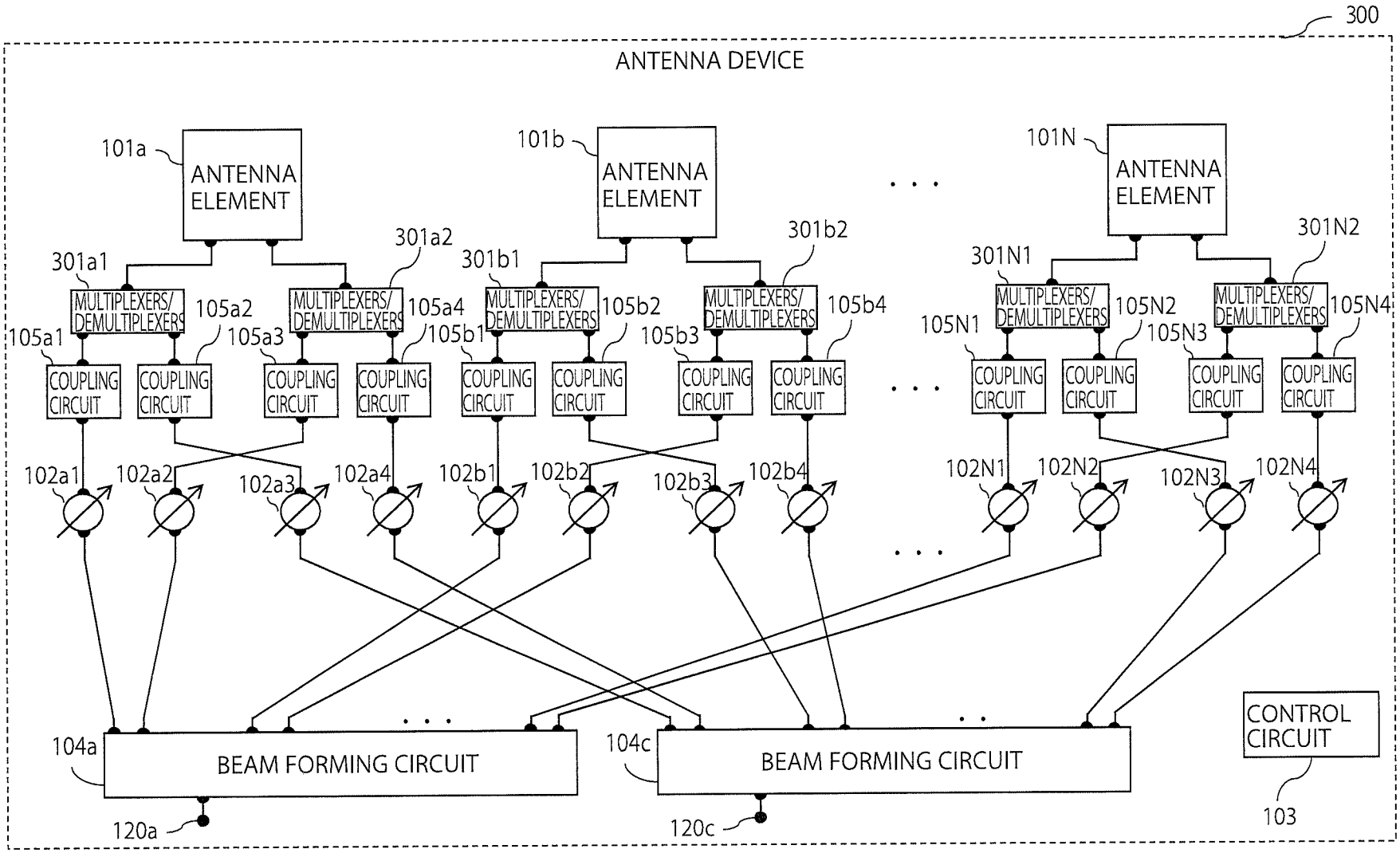
FIG. 30 is a configuration diagram of an antenna device 300 according to a third embodiment.

FIG. 30 is a diagram illustrating a configuration of an antenna device 300 according to a third embodiment. The antenna device 300 is corresponding to the antenna device 100 according to the first embodiment further provided with multiplexers/demultiplexers 301*a*1, 301*b*1, . . . , 301N1 (hereinafter, also referred to as "multiplexers/demultiplexers 301*a*1 to 301N1"), 301*a*2 to 301N2 (hereinafter, also referred to as "multiplexers/demultiplexers 301*a*2 to 301N2"). Furthermore, the antenna device 300 is provided with phase shifters 102*a*3, 102*b*3, . . . , 102N3 (hereinafter, also referred to as "phase shifters 102*a*3 to 102N3"), 102*a*4, 102*b*4, . . . . , 102N4 (hereinafter, also referred to as "phase shifters 102*a*4 to 102N4"), coupling circuits 105*a*3, 105*b*3, . . . , 105N3 (hereinafter, also referred to as "coupling circuits 105*a*3 to 105N3"), 105*a*4, 105*b*4, . . . , 105N4 (hereinafter, also referred to as "coupling circuits 105*a*4 to 105N4") and two beam forming circuits 104*a* and 104*c*.

Using the multiplexers/demultiplexers 301*a*1 to 301N1 and 301*a*2 to 301N2, the antenna device 300 can transmit and receive left-hand circularly polarized waves and right-hand circularly polarized waves in different frequency bands. The antenna device 300 can perform communication corresponding to a wide frequency band by transmitting and receiving linearly polarized waves in different frequency bands in addition to the effects described in the first embodiment.

Hereinafter, the multiplexers/demultiplexers 301*a*1 to 301N1 and 301*a*2 to 301N2 are also referred to as "multiplexers/demultiplexers 301*a*1 to 301N2." Hereinafter, the phase shifters 102*a*3 to 102N3 and 102*a*4 to 102N4 are also referred to as "phase shifter 102*a*3 to 102N4," and the phase shifters 102*a*1 to 102N1, 102*a*2 to 102N2, 102*a*3 to 102N3 and 102*a*4 to 102N4 are also referred to as "phase shifters 102*a*1 to 102N4." Hereinafter, the coupling circuits 105*a*3 to 105N3 and 105*a*4 to 105N4 are also referred to as "coupling circuits 105*a*3 to 105N4," and the coupling circuits 105*a*1 to 105N1, 105*a*2 to 105N2, 105*a*3 to 105N3 and 105*a*4 to 105N4 are also referred to as "coupling circuits 105*a*1 to 105N4."

An overview of the antenna device 300 at the time of transmission is similar to the antenna device 100. As for differences, the left-hand circularly polarized wave signals and right-hand circularly polarized wave signals output from the phase shifters 102*a*1 to 102N4 are input to the antenna elements 101*a* to 101N via the multiplexers/demultiplexers 301*a*1 to 301N2. As a result, the antenna device 300 transmits the left-hand circularly polarized waves and the right-hand circularly polarized waves in different frequency bands. By simultaneously transmitting the left-hand circularly polarized waves and the right-hand circularly polarized waves, the antenna device 300 transmits linearly polarized waves in different frequency bands.

An overview of the antenna device 300 at the time of reception is similar to the antenna device 100. As for differences, the left-hand circularly polarized wave signals and the right-hand circularly polarized wave signals output from the antenna elements 101*a* to 101N are input to the coupling circuits 105*a*1 to 105N4 corresponding to the frequency bands via the multiplexers/demultiplexers 301*a*1 to 301N2. The beam forming circuits 104*a* and 104*c* output composed signals to connection points 120*a* and 120*c*. As a result, the antenna device 300 receives the left-hand circularly polarized waves and the right-hand circularly polarized waves in different frequency bands. Furthermore, the antenna device 300 receives linearly polarized waves in different frequency bands.

As in the case of the first embodiment, the control circuit 103 is connected to the coupling circuits 105*a*1 to 105N4 and the beam forming circuits 104*a* and 104*c* and has a device for transmitting the linearly polarized waves to the phase shifters 102*a*1 to 102N4, which is however complicated and is therefore not shown in FIG. 30.

As has been described in the first embodiment, the beam forming circuits 104*a* and 104*c* of the present embodiment divide transmission signals to the left-hand circularly polarized wave signals and the right-hand circularly polarized wave signals at the time of transmission. The beam forming circuits 104*a* and 104*c* compose a received signal from the left-hand circularly polarized wave signals and right-hand circularly polarized wave signals.

The beam forming circuits 104*a* and 104*c* may be one circuit. In this case, the connection points 120*a* and 120*c* need not be separate.

The multiplexers/demultiplexers 301*a*1 to 301N2 output input signals to different lines in accordance with their frequency bands of the input signals. In the present embodiment, the multiplexers/demultiplexers 301*a*1 to 301N2 output the left-hand circularly polarized wave signals and the right-hand circularly polarized wave signals to different lines in accordance with their frequency bands at the time of reception. At the time of transmission, the multiplexers/demultiplexers 301*a*1 to 301N2 transmit the input left-hand circularly polarized wave signals and right-hand circularly polarized wave signals to the antenna elements 101*a* to 101N.

The multiplexers/demultiplexers 301*a*1 to 301N2 are connected to their corresponding devices among the antenna elements 101*a* to 101N and the coupling circuits 105*a*1 to 105N4.

Any devices are applicable as the multiplexers/demultiplexers 301*a*1 to 301N2 as long as they can output the input signals to different lines in accordance with frequency bands of the signals. Examples thereof include a diplexer or a switch.

The storage described in the first embodiment stores characteristic information corresponding to frequency bands of the left-hand circularly polarized wave signals and the right-hand circularly polarized wave signals.

Operation of the antenna device 300 at the time of transmission is mostly similar to the operation of the antenna device 100, and is therefore omitted, whereas differences are supplemented. In the present embodiment, a transmission signal input from the connection point 120*a* is referred to as a "first transmission signal" and a transmission signal input from the connection point 120*c* is referred to as a "third transmission signal." A left-hand circularly polarized wave signal and a right-hand circularly polarized wave signal resulting from a division of the first transmission signal are referred to as a "first left-hand circularly polarized wave signal" and a "first right-hand circularly polarized wave signal." A left-hand circularly polarized wave signal and a right-hand circularly polarized wave signal resulting from a division of the third transmission signal are referred to as a "third left-hand circularly polarized wave signal" and a "third right-hand circularly polarized wave signal." The frequency bands of the first transmission signal and the third transmission signal are different. Furthermore, the frequency bands of the first left-hand circularly polarized wave signal and the third left-hand circularly polarized wave signal are also different, and the frequency bands of the first right-hand circularly polarized wave signal and the third right-hand circularly polarized wave signal are also different.

Figure 31:
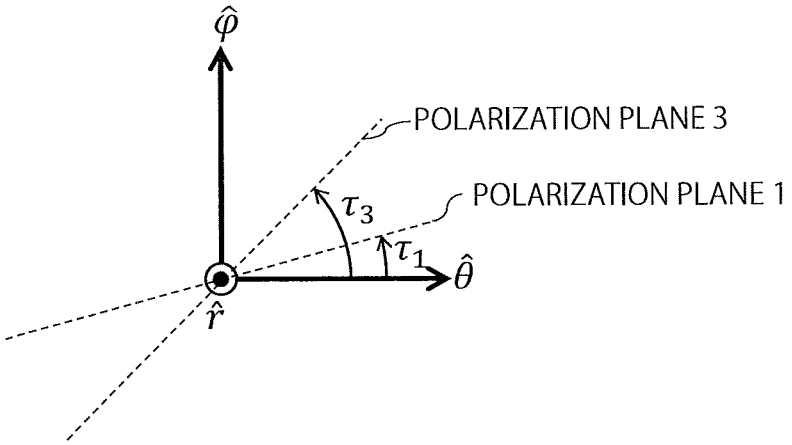
FIG. 31 is a diagram showing polarization angles $\tau_1$ and $\tau_3$ in the third embodiment.

In the present embodiment, the polarization angle of the linearly polarized wave (hereinafter, also referred to as a "first linearly polarized wave") based on the first left-hand circularly polarized wave signal and the first right-hand circularly polarized wave signal is assumed to be $\tau_1$, and the polarization angle of the linearly polarized wave (hereinafter, also referred to as a "third linearly polarized wave") based on the third left-hand circularly polarized wave signal and the third right-hand circularly polarized wave signal is assumed to be $\tau_3$. Although the polarization angles $\tau_1$ and $\tau_3$ may be similar to or different from each other, FIG. 31 illustrates an example of the polarization angle $\tau_1$ and polarization angle $\tau_3$. Note that it is assumed that the beam direction is $D_1$ and the shape is $F_1$.

In the present embodiment, the control circuit 103 determines phase shift amounts corresponding to the polarization angle $\tau_1$, beam direction $D_1$ and shape $F_1$, and transmits them to the phase shifters 102*a*1 to 102N2. The control circuit 103 determines phase shift amounts corresponding to the polarization angle $\tau_3$, beam direction $D_1$ and shape $F_1$, and transmits them to the phase shifters 102*a*3 to 102N4.

Hereinafter, additional information will be given about the signal flow until the first transmission signal and the third transmission signal are transmitted as the first linearly polarized wave and the third linearly polarized wave. The first transmission signal is divided by the beam forming circuit 104*a* into the first left-hand circularly polarized wave signals and the first right-hand circularly polarized wave signals. The first left-hand circularly polarized wave signals are input to the phase shifters 102*a*1 to 102N1. The first right-hand circularly polarized wave signals are input to the phase shifters 102*a*2 to 102N2. The phases of the first left-hand circularly polarized wave signals and the first right-hand circularly polarized wave signals are shifted by the phase shifters 102*a*1 to 102N2 and input to the antenna elements 101*a* to 101N via the coupling circuits 105*a*1 to 105N1 and 105*a*3 to 105N3, and the multiplexers/demultiplexers 301*a*1 to 301N2. The antenna elements 101*a* to 101N transmit the left-hand circularly polarized waves and the right-hand circularly polarized waves in response to the first left-hand circularly polarized wave signals and the first right-hand circularly polarized wave signals, and transmit first linearly polarized waves.

The third transmission signal is divided by the beam forming circuit 104*c* into third left-hand circularly polarized wave signals and third right-hand circularly polarized wave signals. The third left-hand circularly polarized wave signal is input to the phase shifters 102*a*3 to 102N3. The third right-hand circularly polarized wave signals are input to the phase shifter 102*a*4 to 102N4. The phases of the first left-hand circularly polarized wave signals and the first right-hand circularly polarized wave signals are shifted by the phase shifters 102*a*3 to 102N4 and input to the antenna elements 101*a* to 101N via the coupling circuits 105*a*2 to 105N2 and 105*a*4 to 105N4 and the multiplexers/demultiplexers 301*a*1 to 301N2. The antenna elements 101*a* to 101N transmit the left-hand circularly polarized waves and the right-hand circularly polarized waves in response to the third left-hand circularly polarized wave signals and the third right-hand circularly polarized wave signals and transmit third linearly polarized waves.

The antenna device 300 may transmit the first linearly polarized waves and the third linearly polarized waves by switching between the first and third linearly polarized waves or transmit them simultaneously.

Operation of the antenna device 300 at the time of reception is mostly similar to the operation of the antenna device 100, and is therefore omitted, whereas differences are supplemented. As an example in the present embodiment, it is assumed that the linearly polarized wave with polarization angle $\tau_1$ and the linearly polarized wave with polarization angle $\tau_3$ shown in FIG. 31 are received. In the description at the time of reception as well as the description at the time of transmission, the linearly polarized wave with the polarization angle $\tau_1$ is referred to as a "first linearly polarized wave" and the linearly polarized wave with the polarization angle $\tau_3$ is referred to as a "third linearly polarized wave." The beam directions of the first linearly polarized waves and the third linearly polarized waves are equally assumed to be $D_1$. The left-hand circularly polarized wave signals and right-hand circularly polarized wave signals whereby the antenna elements 101*a* to 101N receive and output the first linearly polarized waves are referred to as "first left-hand circularly polarized wave signals" and "first right-hand circularly polarized wave signals." The left-hand circularly polarized wave signals and right-hand circularly polarized wave signals whereby the antenna elements 101*a* to 101N receive and output the third linearly polarized waves are referred to as "third left-hand circularly polarized wave signals" and "third right-hand circularly polarized wave signals." A signal obtained by the beam forming circuit 104*a* combining the first left-hand circularly polarized wave signals and the first right-hand circularly polarized wave signals is referred to as a "first received signal." A signal obtained by the beam forming circuit 104*c* combining the third left-hand circularly polarized wave signals and the third right-hand circularly polarized wave signals is referred to as a "third received signal." Frequency bands of the first left-hand circularly polarized wave signals and the third left-hand circularly polarized wave signals are different and frequency bands of the first right-hand circularly polarized wave signals and the third right-hand circularly polarized wave signals are also different. Frequency bands of the first received signals and the third received signals are also different.

The control circuit 103 determines phase shift amounts of the phase shifters 102*a*1 to 102N2 and the phase shifters 102*a*3 to 102N4 independently of one another. For example, in the present embodiment, the control circuit 103 determines phase shift amounts of the phase shifters 102*a*1 to 102N2 based on the first left-hand circularly polarized wave signals and first right-hand circularly polarized wave signal, and characteristic information. The control circuit 103 determines phase shift amounts of the phase shifters 102*a*3 to 102N4 based on the third left-hand circularly polarized wave signals and third right-hand circularly polarized wave signals, and characteristic information.

Hereinafter, additional information will be given about the signal flow after the first linearly polarized waves and the third linearly polarized waves are received until those signals are output as the first received signals and the third received signals. When the antenna device 300 receives the first linearly polarized waves, operation thereof is similar to the operation of the antenna device 100, but the antenna elements 101*a* to 101N output the first left-hand circularly polarized wave signals to the multiplexers/demultiplexers 301*a*1 to 301N1 and output the first right-hand circularly polarized wave signals to the multiplexers/demultiplexers 301*a*2 to 301N2. The multiplexers/demultiplexers 301*a*1 to 301N1 output the first left-hand circularly polarized wave signals to the coupling circuits 105*a*1 to 105N1 and the multiplexers/demultiplexers 301*a*2 to 301N2 output the first right-hand circularly polarized wave signals to the coupling circuits 105*a*3 to 105N3. The first left-hand circularly polarized wave signal and the first right-hand circularly polarized wave signals, the phases of which have been shifted by the phase shifters 102*a*1 to 102N2 are combined by the beam forming circuit 104*a* into the first received signal, which is output to the connection point 120*a*.

Operation when the antenna device 300 receives the third linearly polarized waves is also similar to the operation of the antenna device 100, whereas the antenna elements 101*a* to 101N output the third left-hand circularly polarized wave signals to the multiplexers/demultiplexers 301*a*1 to 301N1 and output the third right-hand circularly polarized wave signals to the multiplexers/demultiplexers 301*a*2 to 301N2. The multiplexers/demultiplexers 301*a*1 to 301N1 output the third left-hand circularly polarized wave signals to the coupling circuits 105*a*2 to 105N2 and the multiplexers/demultiplexers 301*a*2 to 301N2 output the third right-hand circularly polarized wave signal to the coupling circuits 105*a*4 to 105N4. The third left-hand circularly polarized wave signals and the third right-hand circularly polarized wave signals, the phases of which have been shifted by the phase shifters 102*a*3 to 102N4 are combined by the beam forming circuit 104*c* into a third received signal, which is output to the connection point 120*c*.

The antenna device 300 may receive the first linearly polarized wave and the third linearly polarized wave by switching between the first and third linearly polarized waves or receive them simultaneously.

The antenna device 300 according to the present embodiment has been described so far. As the antenna device 300, the modifications described in the first embodiment and the second embodiment are applicable. Hereinafter, modifications of the antenna device 300 will be described.

Figure 32:
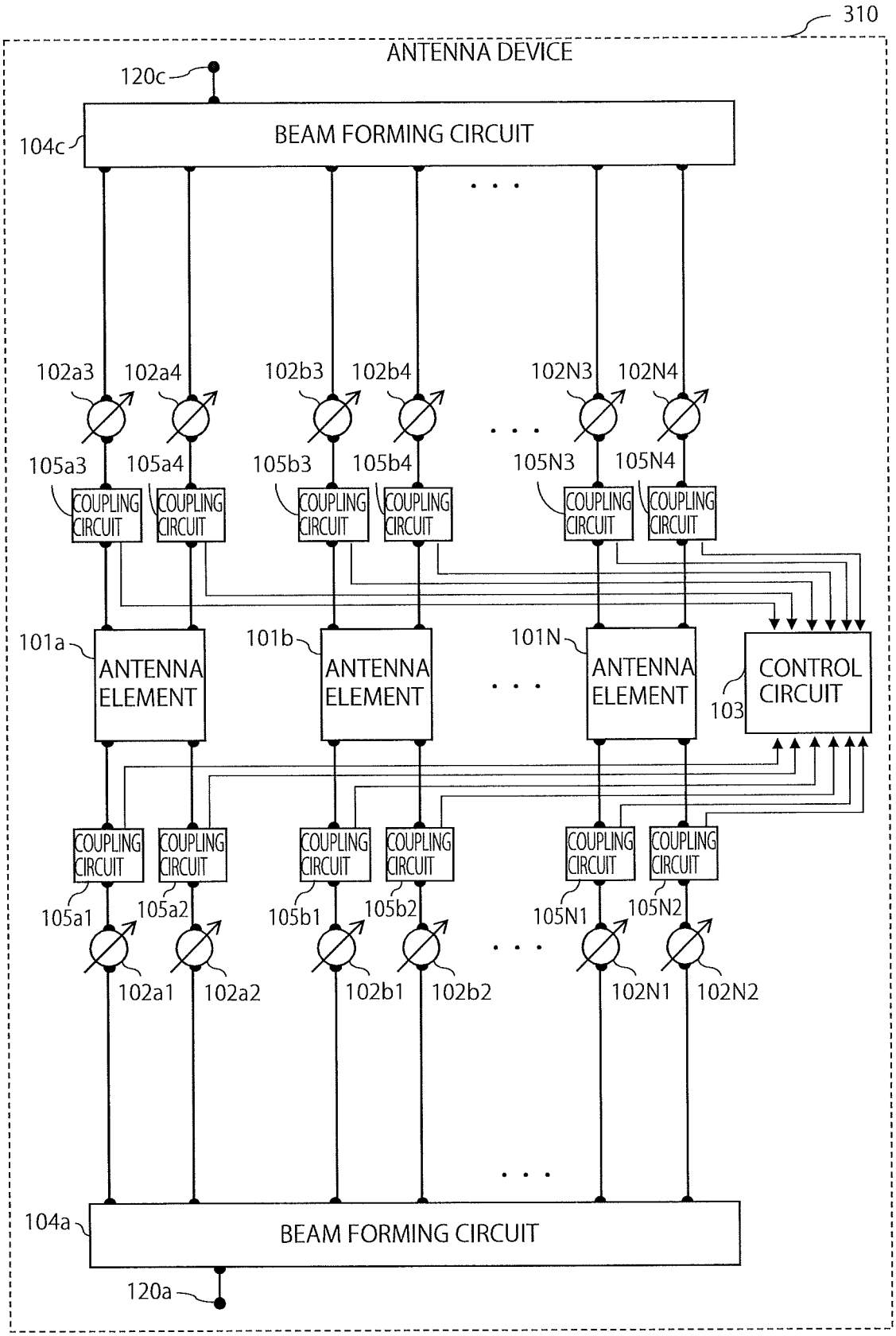
FIG. 32 is a configuration diagram of an antenna device 310 applicable to the third embodiment.

In the present embodiment, the multiplexers/demultiplexers 301*a*1 to 301N2 change the output destination of the left-hand circularly polarized wave signals and the right-hand circularly polarized wave signals in different frequency bands. As a modification, the functions of the multiplexers/demultiplexers 301*a*1 to 301N2 may be mounted on the antenna elements 101*a* to 101N. FIG. 32 illustrates such an antenna device 310. In FIG. 32 as well as FIG. 30, expressions of transmission of the phase shifters 102*a*1 to 102N4 are omitted from the control circuit 103 due to complexity of drawings, but phase shift amounts are actually transmitted from the control circuit 103 to the phase shifters 102*a*1 to 102N4.

In the antenna device 310, the antenna elements 101*a* to 101N output the first left-hand circularly polarized wave signal to the coupling circuits 105*a*1 to 105N1 and the first right-hand circularly polarized wave signals to the coupling circuits 105*a*2 to 105N2, and output the third left-hand circularly polarized wave signals to the coupling circuits 105*a*3 to 105N3 and the third right-hand circularly polarized wave signals to the coupling circuits 105*a*4 to 105N4.

Since the antenna elements 101*a* to 101N have the functions of the multiplexers/demultiplexers 301*a*1 to 301N2, it is possible to reduce the circuit scale of the antenna device applicable to different frequency bands. It is possible to achieve miniaturization and labor saving of the antenna device by reducing the circuit scale.

Figure 33:
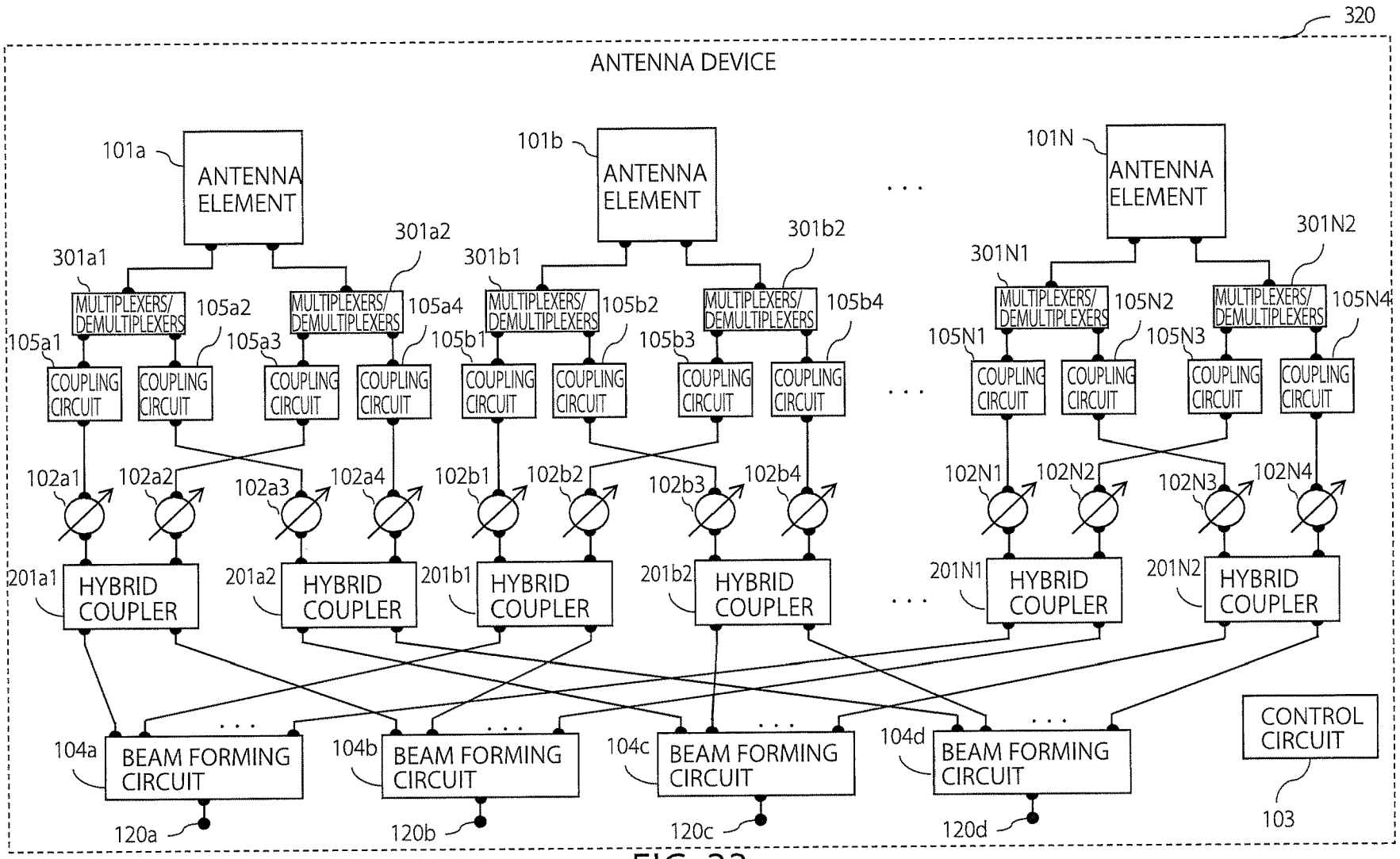
FIG. 33 is a configuration diagram of an antenna device 320 applicable to the third embodiment.
Figure 34:
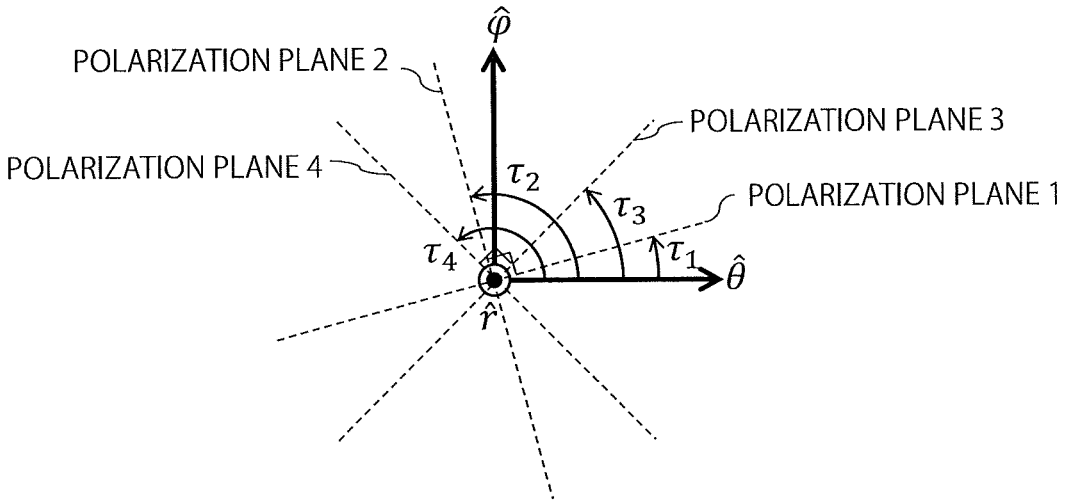
FIG. 34 is a diagram showing polarization angles $\tau_1$ to $\tau_4$ according to a modification of the third embodiment.

As a modification, the antenna device 300 may be combined with the antenna device 200 described in the second embodiment. FIG. 33 illustrates such an antenna device 320. The antenna device 320 is applicable to linearly polarized waves in different frequency bands and is also applicable to linearly polarized waves having polarization angles orthogonal to each other in their respective frequency bands. For example, as shown in FIG. 34, it is possible to perform communication corresponding to four polarization angles $\tau_1$, $\tau_2$, $\tau_3$ and $\tau_4$. Of the four polarization angles, a polarization plane 1 is orthogonal to a polarization plane 2, and a polarization plane 3 is orthogonal to a polarization plane 4. The linearly polarized wave of the polarization plane 1 (first linearly polarized wave) and the linearly polarized wave of the polarization plane 2 (second linearly polarized wave) have similar frequency bands and the linearly polarized wave of the polarization plane 3 (third linearly polarized wave) and the linearly polarized wave of the polarization plane 4 (hereinafter, also referred to as "fourth linearly polarized wave") have similar frequency bands. Hereinafter, the frequency band of the first linearly polarized wave or the second linearly polarized wave is also referred to as a first frequency band, and the frequency band of the third linearly polarized wave or the fourth linearly polarized wave is also referred to as "second frequency band." FIG. 34 is an example and the polarization angles $\tau_1$ and $\tau_3$ may be similar, and the first frequency band and the second frequency band may be similar frequency bands.

In FIG. 33 as well as FIG. 30, connections of the control circuit 103 and a transmission relationship thereof are omitted due to complexity of drawings. The control circuit 103 is connected to the coupling circuits 105*a*1 to 105N4 and transmits phase shift amounts to the phase shifters 102*a*1 to 102N4.

The antenna device 320 is provided with hybrid couplers 201*a*1, 201*b*1, . . . , 201N1 (hereinafter, also referred to as "hybrid couplers 201*a*1 to 201N1"), 201*a*2, 201*b*2, . . . , 201N2 (hereinafter, also referred to as "hybrid couplers 201*a*2 to 201N2") in addition to the antenna device 300 and is provided with the beam forming circuits 104*b* and 104*d*.

Hereinafter, the hybrid couplers 201*a*1 to 201N1 and 201*a*2 to 201N2 are also referred to as "hybrid couplers 201*a*1 to 201N2." Furthermore, the beam forming circuits 104*a*, 104*b*, 104*c* and 104*d* are also referred to as "beam forming circuits 104*a* to 104*d*."

In the present modification, the beam forming circuits 104*a* to 104*d* neither divide a transmission signal to the left-hand circularly polarized wave signals and the right-hand circularly polarized wave signals nor compose a received signal from the left-hand circularly polarized wave signals and the right-hand circularly polarized wave signals. The hybrid couplers 201*a*1 to 201N2 divide and combine the left-hand circularly polarized wave signals and the right-hand circularly polarized wave signals.

The beam forming circuits 104*a* to 104*d* divide power of a transmission signal and transmit the transmission signal to the corresponding hybrid couplers 201*a*1 to 201N2. The beam forming circuits 104*a* to 104*d* may further be configured to combine received signals input from the corresponding hybrid couplers 201*a*1 to 201N2.

The storage described in the first embodiment stores characteristic information corresponding to phase differences between the left-hand circularly polarized wave signals and the right-hand circularly polarized wave signals by the hybrid couplers 201*a*1 to 201N2 and also applicable to different frequency bands.

Since the antenna device 320 is an antenna device obtained by combining the antenna device 300 and the antenna device 200 of the second embodiment, an overview thereof will be described. At the time of transmission in the present modification, a transmission signal input from the connection point 120*d* is also referred to as a "fourth transmission signal" and the fourth transmission signal is assumed to be finally transmitted as a fourth linearly polarized wave with a polarization angle $\tau_4$, beam direction $D_1$ and shape $F_1$. Similarly to the second embodiment, the hybrid couplers 201*a*1 to 201N2 are assigned a phase difference and the transmission signal is divided into the left-hand circularly polarized wave signals and the right-hand circularly polarized wave signals. The control circuit 103 determines a phase shift amount corresponding to the transmission signal and transmits the transmission signal. For example, the control circuit 103 determines a phase shift amount with which the first transmission signal is output as linearly polarized waves with the polarization angle $\tau_1$, beam direction $D_1$ and shape $F_1$ and transmits the phase shift amount to the phase shifters 102*a*1 to 102N2. This phase shift amount is also a phase shift amount with which the second transmission signal is output as linearly polarized waves with the polarization angle $\tau_2$, beam direction $D_1$ and shape $F_1$. Similarly, the control circuit 103 determines a phase shift amount with which the third transmission signal is output as linearly polarized waves with the polarization angle $\tau_3$, beam direction $D_1$ and shape $F_1$ and transmits the phase shift amount to the phase shifters 102*a*3 to 102N4. This phase shift amount is also a phase shift amount with which the fourth transmission signal is output as a linearly polarized waves with the polarization angle $\tau_4$, beam direction $D_1$ and shape $F_1$.

The phases of the left-hand circularly polarized wave signal and the right-hand circularly polarized wave signals resulting from divisions of the first transmission signal to the fourth transmission signal are shifted and the signals are transmitted as linearly polarized waves with the respective polarization angles, beam directions and shape $F_1$. The antenna device 300 may transmit the first to fourth linearly polarized waves by switching the first to fourth linearly polarized waves or transmit some or all of those linearly polarized waves simultaneously.

At the time of reception in the present modification, the received signal composed by the beam forming circuit 104*d* is also referred to as a "fourth received signal" and the fourth received signal is assumed to have been received as a fourth linearly polarized wave with the polarization angle $\tau_4$ and beam direction $D_1$. As in the case of the third embodiment, the multiplexers/demultiplexers 301*a*1 to 301N2 output the input left-hand circularly polarized wave signals and right-hand circularly polarized wave signals to the coupling circuits 105*a*1 to 105N4 that differ depending on the frequency bands.

For example, signals of the first frequency band are output to the coupling circuits 105*a*1 to 105N1 and 105*a*3 to 105N3 and signals in the second frequency band are output to the coupling circuits 105*a*2 to 105N2 and 105*a*4 to 105N4. The phases of the signals in the first frequency band are shifted by the phase shifters 102*a*1 to 102N2 and the signals in the second frequency band are shifted by the phase shifters 102*a*3 to 102N4.

As in the case of the second embodiment, the hybrid couplers 201*a*1 to 201N2 compose a received signal from the left-hand circularly polarized wave signals and the right-hand circularly polarized wave signals. The hybrid couplers 201*a*1 to 201N2 output the composed received signal to the beam forming circuits 104*a* to 104*d* in accordance with the phase differences between the input left-hand circularly polarized wave signals and right-hand circularly polarized wave signals. For example, the first received signal is output to the beam forming circuit 104*a*, the second received signal to the beam forming circuit 104*b*, the third received signal to the beam forming circuit 104*c* and the fourth received signal to beam forming circuit 104*d*, respectively.

The antenna device 320 may receive the first to fourth linearly polarized waves by switching the first to fourth linearly polarized waves or receive some or all of the linearly polarized waves simultaneously.

Figure 35:
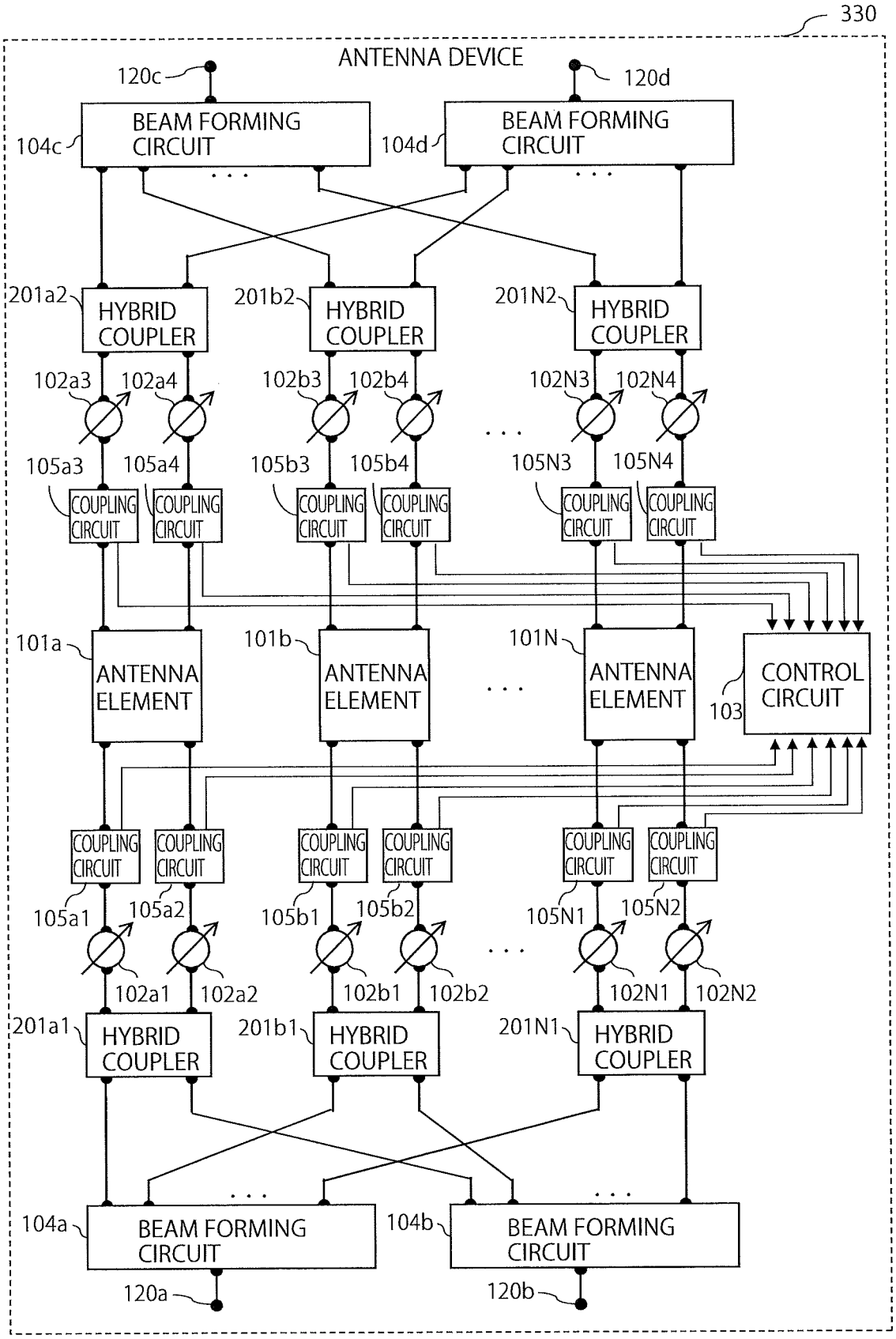
FIG. 35 is a configuration diagram of an antenna device 330 applicable to the third embodiment.

In the antenna device 320, the functions of the multiplexers/demultiplexers 301*a*1 to 301N2 may be mounted on the antenna elements 101*a* to 101N. FIG. 35 illustrates such an antenna device 330. In FIG. 35 as well as FIG. 30 and FIG. 32, expressions of transmission from the control circuit 103 to the phase shifters 102*a*1 to 102N4 are omitted due to complexity of drawings, but phase shift amounts are actually transmitted from the control circuit 103 to the phase shifters 102*a*1 to 102N4.

In the antenna device 330, the antenna elements 101*a* to 101N output the first left-hand circularly polarized wave signals and the second left-hand circularly polarized wave signals to the coupling circuits 105*a*1 to 105N1, output the first right-hand circularly polarized wave signals and second right-hand circularly polarized wave signals to the coupling circuits 105*a*2 to 105N2, output the third left-hand circularly polarized wave signals and the fourth left-hand circularly polarized wave signals to the coupling circuits 105*a*3 to 105N3, and output the third right-hand circularly polarized wave signals and the fourth right-hand circularly polarized wave signals to the coupling circuits 105*a*4 to 105N4. Note that the fourth left-hand circularly polarized wave signals and the fourth right-hand circularly polarized wave signals are signals whereby the antenna elements 101*a* to 101N receive and output the fourth linearly polarized waves.

Since the antenna elements 101*a* to 101N are provided with the functions of the multiplexers/demultiplexers 301*a*1 to 301N2, it is possible to reduce the circuit scale of the antenna device that can handle different frequency bands. By reducing the circuit scale, it is possible to achieve miniaturization and labor saving of the antenna device.

The antenna device 300 of the present embodiment has been described so far. In addition to the effects described in the first embodiment, the antenna device 300 can perform communication corresponding to a wide frequency band by transmitting and receiving linearly polarized waves in different frequency bands.

Fourth Embodiment

The antenna devices described in the first to third embodiments are connected to and used for various electronic devices. As an example, an application example of the antenna device 100 shown in FIG. 1 will be described.

Figure 36:
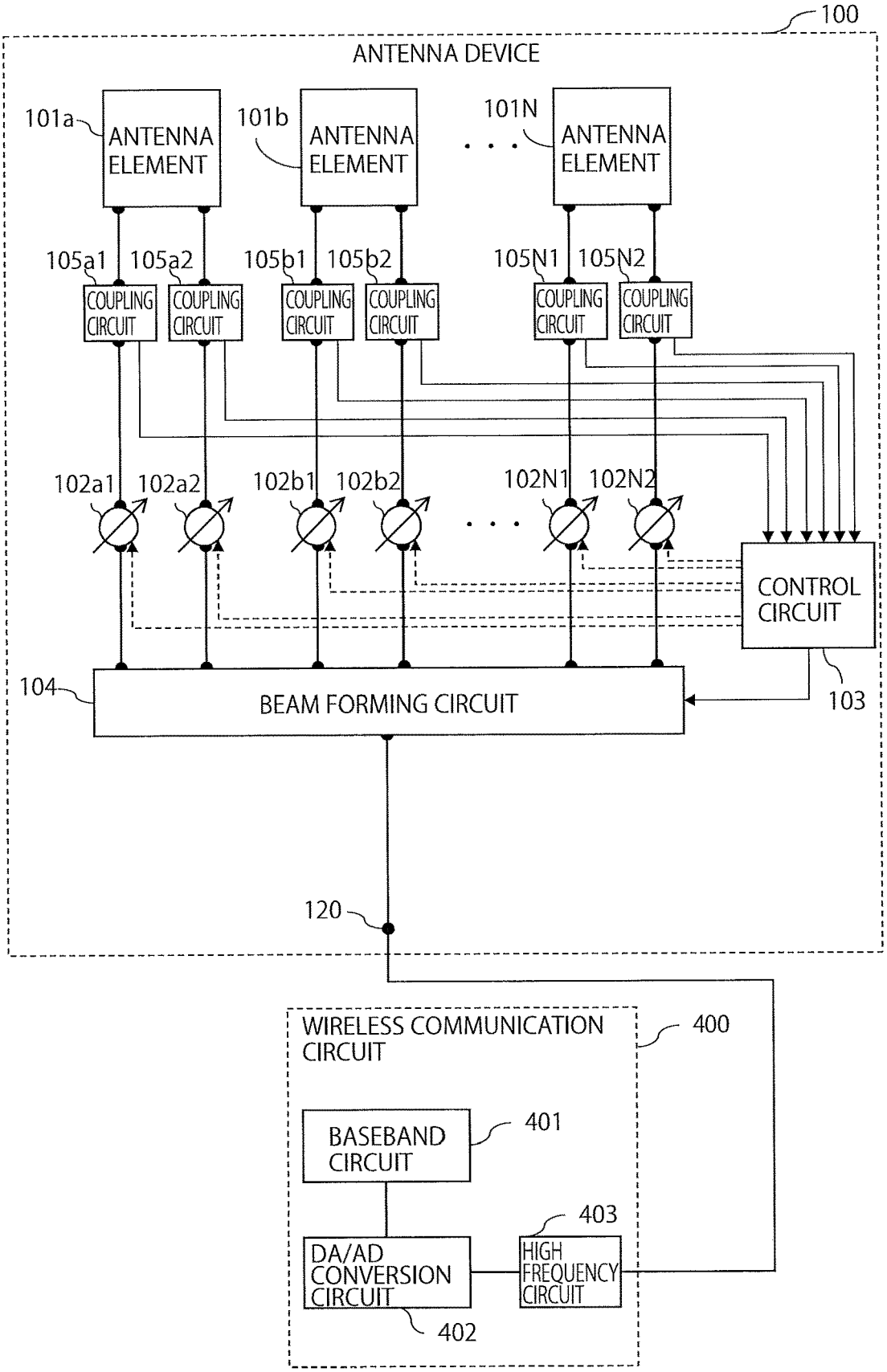
FIG. 36 is a diagram illustrating a wireless communication circuit 400 connected to the antenna device 100 according to a fourth embodiment.

As an application example, FIG. 36 illustrates a wireless communication circuit 400 connected to the antenna device 100. The wireless communication circuit 400 performs wireless communication with a partner wireless communication device using the antenna device 100. The wireless communication circuit 400 includes a baseband circuit 401, a DA/AD conversion circuit 402 and a high frequency circuit 403.

The baseband circuit 401 generates a frame or packet compliant with a communication scheme or specification or the like used and encodes and modulates a digital signal of the generated frame or packet.

The DA/AD conversion circuit 402 converts a modulated digital signal to an analog signal. The high frequency circuit 403 extracts a desired signal from the analog signal under band control, converts the extracted signal to a frequency to be used for wireless communication, amplifies the converted signal (high frequency signal) using an amplifier provided therein (not shown) and outputs the amplified signal to the connection point 120.

At the time of reception, the high frequency circuit 403 receives a high frequency signal from the connection point 120. The high frequency circuit 403 amplifies the received signal using the amplifier provided therein, extracts a desired signal from the amplified signal, converts the extracted signal to a frequency to be used for a baseband and outputs the baseband signal to the DA/AD conversion circuit 402.

The DA/AD conversion circuit 202 converts the input baseband signal to a digital signal and outputs the digital signal to the baseband circuit 401. The baseband circuit 401 demodulates and decodes the input digital signal and acquires a frame or packet.

Figure 37:
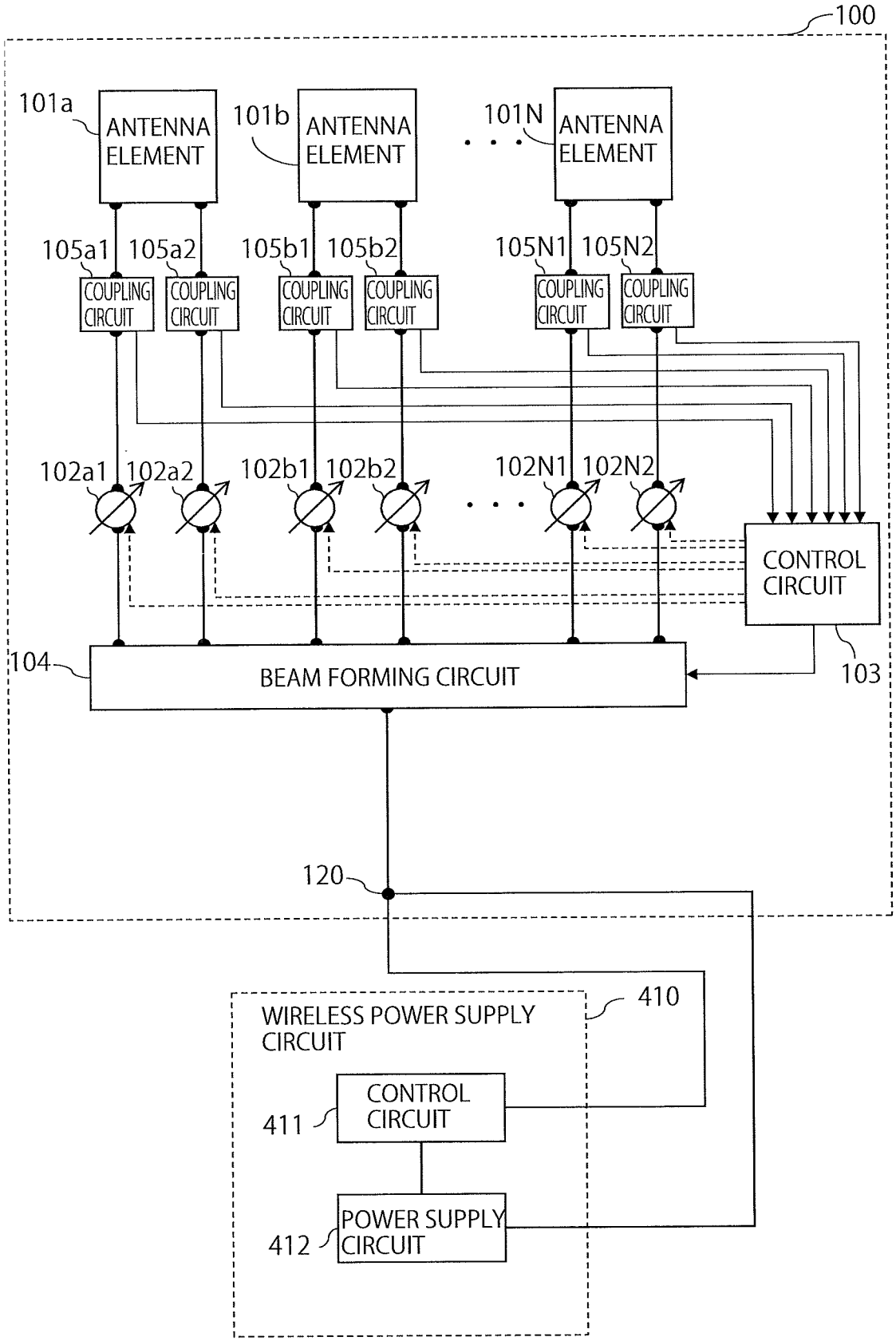
FIG. 37 is a diagram illustrating a wireless power supply circuit 410 connected to the antenna device 100 according to the fourth embodiment.

As an application example, FIG. 37 illustrates a wireless power supply circuit 410 connected to the antenna device 100. The wireless power supply circuit 410 performs wireless power transmission (hereinafter, also referred to as "wireless power supply") to a partner electronic device using the antenna device 100. The wireless power supply circuit 410 includes a control circuit 411 and a power supply circuit 412.

The control circuit 411 is a circuit that controls wireless power supply. For example, the control circuit 411 commands start and end time of wireless power supply, wireless power supply time, wireless power supply amount, or the like. Commands are sent to the power supply circuit 412. The control circuit 411 may determine a command to the power supply circuit 412 based on a signal sent from the antenna device 100.

The power supply circuit 412 receives a command from the control circuit 411 and outputs a wireless power supply signal. This signal is transmitted to the partner electronic device via the antenna device 100. The partner electronic device receives this wireless power supply signal and thereby performs power supply. Application examples of the antenna device 100 have been described so far. The application examples are not limited to the antenna device 100, but the application examples are applicable to the respective antenna devices described in the first to third embodiments.

Several embodiments, modifications thereof and application examples have been described so far. These embodiments, modifications thereof and application examples can be implemented in combination.

While certain approaches have been described, these approaches have been presented by way of example only, and are not intended to limit the scope of the inventions. Indeed, the apparatuses described herein may be embodied in a variety of other forms; furthermore various omissions, substitutions and changes in the form of the apparatuses described herein may be made. The accompanying claims and their equivalents are intended to cover such forms or modifications as would fall within the scope of the inventions.

The invention claimed is:

1. An antenna apparatus comprising:

a first phase shifter to shift a phase of a first left-hand circularly polarized wave signal indicating a left-hand circularly polarized wave;

a second phase shifter to shift a phase of a second left-hand circularly polarized wave signal indicating a left-hand circularly polarized wave;

a third phase shifter to shift a phase of a first right-hand circularly polarized wave signal indicating a right-hand circularly polarized wave;

a fourth phase shifter to shift a phase of a second right-hand circularly polarized wave signal indicating a right-hand circularly polarized wave;

a control circuit configured to determine a first phase shift amount in the first phase shifter, a second phase shift amount in the second phase shifter, a third phase shift amount in the third phase shifter, and a fourth phase shift amount in the fourth phase shifter based on a polarization angle and a radiation direction of a radio wave to be radiated;

a first radiation element to radiate a first left-hand circularly polarized wave in response to the first left-hand circularly polarized wave signal shifted by the first phase shifter and a first right-hand circularly polarized wave in response to the first right-hand circularly polarized wave signal shifted by the third phase shifter; and a second radiation element to radiate a second left-hand circularly polarized wave in response to the second left-hand circularly polarized wave signal shifted by the second phase shifter and a second right-hand circularly polarized wave in response to the second right-hand circularly polarized wave signal shifted by the fourth phase shifter.

2. The antenna apparatus according to claim 1, wherein at least one of a difference between the first phase shift amount and the second phase shift amount and a difference between the third phase shift amount and the fourth phase shift amount is a value based on the radiation direction.

3. The antenna apparatus according to claim 1, wherein at least one of a difference between the first phase shift amount and the third phase shift amount and a difference between the second phase shift amount and the fourth phase shift amount is a value based on the polarization angle.

4. The antenna apparatus according to claim 1, wherein the first left-hand circularly polarized wave and the first right-hand circularly polarized wave have directivity represented by a shape corresponding to amplitudes of the first left-hand circularly polarized wave signal and the first right-hand circularly polarized wave signal, and the second left-hand circularly polarized wave and the second right-hand circularly polarized wave have directivity represented by a shape corresponding to amplitudes of the second left-hand circularly polarized wave signal and the second right-hand circularly polarized wave signal.

5. The antenna apparatus according to claim 1, further comprising a first division circuit to divide a first transmission signal into the first left-hand circularly polarized wave signal, the second right-hand circularly polarized wave signal, the first right-hand circularly polarized wave signal, and the second right-hand circularly polarized wave signal.

6. The antenna apparatus according to claim 5, further comprising:

a fifth phase shifter to shift a phase of a third left-hand circularly polarized wave signal indicating a left-hand circularly polarized wave;

a sixth phase shifter to shift a phase of a fourth left-hand circularly polarized wave signal indicating a left-hand circularly polarized wave;

a seventh phase shifter to shift a phase of a third right-hand circularly polarized wave signal indicating a right-hand circularly polarized wave; and an eighth phase shifter to shift a phase of a fourth right-hand circularly polarized wave signal indicating a right-hand circularly polarized wave;

wherein the division circuit divides a second transmission signal in a frequency band different from a frequency band of the first transmission signal into the third left-hand circularly polarized wave signal, the fourth left-hand circularly polarized wave signal, the third right-hand circularly polarized wave signal, and the fourth right-hand circularly polarized wave signal, and the control circuit determines a fifth phase shift amount in the fifth phase shifter, a sixth phase shift amount in the sixth phase shifter, a seventh phase shift amount in the seventh phase shifter, and an eighth phase shift amount in the eighth phase shifter based on a polarization angle and a radiation direction of a radio wave to be radiated.

7. The antenna apparatus according to claim 1, further comprising:

a first division circuit divides a first transmission signal into a first left-hand circularly polarized wave signal and a first right-hand circularly polarized wave signal corresponding to the first transmission signal, and divide a second transmission signal in a frequency band identical to that of the first transmission signal into a first left-hand circularly polarized wave signal and a first right-hand circularly polarized wave signal corresponding to the second transmission signal, wherein the first phase shifter shifts a phase of the first left-hand circularly polarized wave signal corresponding to the first transmission signal and a phase of the first left-hand circularly polarized wave signal corresponding to the second transmission signal, the third phase shifter shifts a phase of the first right-hand circularly polarized wave signal corresponding to the first transmission signal and a phase of the first right-hand circularly polarized wave signal corresponding to the second transmission signal, the first radiation element radiates a first left-hand circularly polarized wave and a first right-hand circularly polarized wave corresponding to the first transmission signal in response to the first left-hand circularly polarized wave signal corresponding to the first transmission signal shifted by the first phase shift amount and a first right-hand circularly polarized wave corresponding to the first transmission signal shifted by the third phase shift amount, the first radiation element radiates a first left-hand circularly polarized wave and a first right-hand circularly polarized wave corresponding to the second transmission signal in response to the first left-hand circularly polarized wave signal corresponding to the second transmission signal shifted by the first phase shift amount and the first right-hand circularly polarized wave signal corresponding to the second transmission signal shifted by the third phase shift amount, and a first polarization plane of the first left-hand circularly polarized wave and the first right-hand circularly polarized wave signal corresponding to the first transmission signal is substantially orthogonal to a second polarization plane of the second left-hand circularly polarized wave and the second right-hand circularly polarized wave signal corresponding to the second transmission signal.

8. The antenna apparatus according to claim 1, further comprising:

a fifth phase shifter to shift a phase of a third left-hand circularly polarized wave signal indicating a left-hand circularly polarized wave;

a sixth phase shifter to shift a phase of a fourth left-hand circularly polarized wave signal indicating a left-hand circularly polarized wave;

a seventh phase shifter to shift a phase of a third right-hand circularly polarized wave signal indicating a right-hand circularly polarized wave; and an eighth phase shifter to shift a phase of a fourth right-hand circularly polarized wave signal indicating a right-hand circularly polarized wave, wherein the control circuit determines a fifth phase shift amount in the fifth phase shifter, a sixth phase shift amount in the sixth phase shifter, a seventh phase shift amount in the seventh phase shifter and an eighth phase shift amount in the eighth phase shifter based on a polarization angle and a radiation direction of a radio wave to be radiated, the first radiation element radiates a third left-hand circularly polarized wave and a third right-hand circularly polarized wave in response to the third left-hand circularly polarized wave signal shifted by the fifth phase shifter and the third right-hand circularly polarized wave signal shifted by the seventh phase shifter, the second radiation element radiates a fourth left-hand circularly polarized wave and a fourth right-hand circularly polarized wave in response to the fourth left-hand circularly polarized wave signal shifted by the sixth phase shifter and the fourth right-hand circularly polarized wave signal shifted by the eighth phase shifter, and a frequency band of the third left-hand circularly polarized wave signal, the fourth left-hand circularly polarized wave signal, the third right-hand circularly polarized wave signal, and the fourth right-hand circularly polarized wave signal is different from a frequency band of the first left-hand circularly polarized wave signal, the second left-hand circularly polarized wave signal, the first right-hand circularly polarized wave signal, and the second right-hand circularly polarized wave signal.

9. The antenna apparatus according to claim 8, further comprising a second division circuit to divide a third transmission signal into a third left-hand circularly polarized wave signal and a third right-hand circularly polarized wave signal corresponding to the third transmission signal wherein a frequency band of the third transmission signal is different from a frequency band of the first transmission signal and the second transmission signal, and to divide a fourth transmission signal in a frequency band identical to that of the third transmission signal into a third left-hand circularly polarized wave signal and a third right-hand circularly polarized wave signal corresponding to the fourth transmission signal, wherein the fifth phase shifter shifts a phase of the third left-hand circularly polarized wave signal corresponding to the third transmission signal and a phase of the fourth left-hand circularly polarized wave signal corresponding to the fourth transmission signal, the seventh phase shifter shifts a phase of the third right-hand circularly polarized wave signal corresponding to the third transmission signal and a phase of the fourth right-hand circularly polarized wave signal corresponding to the fourth transmission signal, the first radiation element radiates a first left-hand circularly polarized wave and a first right-hand circularly polarized wave corresponding to the third transmission signal in response to the third left-hand circularly polarized wave signal corresponding to the third transmission signal shifted by the fifth phase shift amount and a third right-hand circularly polarized wave corresponding to the third transmission signal shifted by the seventh phase shift amount, the first radiation element radiates a first left-hand circularly polarized wave and a first right-hand circularly polarized wave corresponding to the fourth transmission signal in response to the fourth left-hand circularly polarized wave signal corresponding to the fourth transmission signal shifted by the fifth phase shift amount and the fourth right-hand circularly polarized wave signal corresponding to the fourth transmission signal shifted by the seventh phase shift amount, and a third polarization plane of the first left-hand circularly polarized wave and the first right-hand circularly polarized wave signal corresponding to the third transmission signal is substantially orthogonal to a fourth polarization plane of the first left-hand circularly polarized wave and the first right-hand circularly polarized wave signal corresponding to the fourth transmission signal.

10. An antenna apparatus comprising:

a first radiation element to receive a first left-hand circularly polarized wave and a first right-hand circularly polarized wave;

a second radiation element to receive a first left-hand circularly polarized wave and a first right-hand circularly polarized wave;

a first phase shifter to shift a phase of a first left-hand circularly polarized wave signal representing the first left-hand circularly polarized wave received from the first radiation element;

a second phase shifter to shift a phase of a second left-hand circularly polarized wave signal representing the first left-hand circularly polarized wave received from the second radiation element;

a third phase shifter to shift a phase of a first right-hand circularly polarized wave signal representing the first right-hand circularly polarized wave received from the first radiation element;

a fourth phase shifter to shift a phase of a second right-hand circularly polarized wave signal representing the first right-hand circularly polarized wave received from the second radiation element; and a control circuit configured to estimate first polarization angles of the first left-hand circularly polarized wave and the first right-hand circularly polarized wave based on a difference between a phase of the first left-hand circularly polarized wave signal and a phase of the first right-hand circularly polarized wave signal or a difference between a phase of the second left-hand circularly polarized wave signal and a phase of the second right-hand circularly polarized wave signal, wherein the control circuit estimates first arrival directions of the first left-hand circularly polarized wave and the first right-hand circularly polarized wave based on a difference between a phase of the first left-hand circularly polarized wave signal and a phase of the second left-hand circularly polarized wave signal or a difference between a phase of the first right-hand circularly polarized wave signal and a phase of the second right-hand circularly polarized wave signal, and the control circuit determines a first phase shift amount in the first phase shifter, a second phase shift amount in the second phase shifter, a third phase shift amount in the third phase shifter, and a fourth phase shift amount in the fourth phase shifter based on the first polarization angles and the first arrival directions.

11. The antenna apparatus according to claim 10, wherein the first radiation element receives a second left-hand circularly polarized wave in a frequency band different from that of the first left-hand circularly polarized wave and a second right-hand circularly polarized wave in a frequency band different from that of the first right-hand circularly polarized wave, the second radiation element receives the second left-hand circularly polarized wave and the first right-hand circularly polarized wave, the antenna apparatus comprises:

a fifth phase shifter to shift a phase of a third left-hand circularly polarized wave signal indicating the second left-hand circularly polarized wave received from the first radiation element;

a sixth phase shifter to shift a phase of a fourth left-hand circularly polarized wave signal indicating the second left-hand circularly polarized wave from the second radiation element;

a seventh phase shifter to shift a phase of a third right-hand circularly polarized wave signal indicating the second right-hand circularly polarized wave received from the first radiation element; and an eighth phase shifter to shift a phase of a fourth right-hand circularly polarized wave signal indicating the second right-hand circularly polarized wave received from the second radiation element;

the control circuit estimates second polarization angles of the second left-hand circularly polarized wave and the second right-hand circularly polarized wave based on a difference between a phase of the third left-hand circularly polarized wave signal and a phase of the third right-hand circularly polarized wave signal or a difference between a phase of the fourth left-hand circularly polarized wave signal and a phase of the fourth right-hand circularly polarized wave signal, the control circuit estimates second arrival directions of the second left-hand circularly polarized wave and the second right-hand circularly polarized wave based on a difference between a phase of the third left-hand circularly polarized wave signal and a phase of the fourth left-hand circularly polarized wave signal or a difference between a phase of the third right-hand circularly polarized wave signal and a phase of the third right-hand circularly polarized wave signal, and the control circuit determines a fifth phase shift amount in the fifth phase shifter, a sixth phase shift amount in the sixth phase shifter, a seventh phase shift amount in the seventh phase shifter, and an eighth phase shift amount in the eighth phase shifter based on the second polarization angles and the second arrival directions.

12. The antenna apparatus according to claim 10, further comprising a first composition circuit to generate a first received signal based on the first left-hand circularly polarized wave signal shifted by the first phase shifter and the first right-hand circularly polarized wave signal shifted by the third phase shifter or based on the second left-hand circularly polarized wave signal shifted by the second phase shifter and the second right-hand circularly polarized wave signal shifted by the fourth phase shifter.

13. The antenna apparatus according to claim 10, wherein the first radiation element receives a second left-hand circularly polarized wave orthogonal to the first left-hand circularly polarized wave and a second right-hand circularly polarized wave orthogonal to the first right-hand circularly polarized wave, the first phase shifter shifts a phase of a third left-hand circularly polarized wave signal representing the second left-hand circularly polarized wave received from the first radiation element by the first phase shift amount, the third phase shifter shifts a phase of a third right-hand circularly polarized wave signal representing the second right-hand circularly polarized wave received from the first radiation element by the third phase shift amount, and the antenna apparatus comprises a first composition circuit to:

generate a first received signal based on the first left-hand circularly polarized wave signal shifted by the first phase shifter and the first right-hand circularly polarized wave signal shifted by the third phase shifter and generate a second received signal based on the third left-hand circularly polarized wave signal shifted by the first phase shifter and the third right-hand circularly polarized wave signal shifted by the third phase shifter.

14. The antenna apparatus according to claim 13, wherein:

the first radiation element receives a third left-hand circularly polarized wave in a frequency band different from that of the first left-hand circularly polarized wave and a third right-hand circularly polarized wave in a frequency band different from that of the first right-hand circularly polarized wave, the second radiation element receives the third left-hand circularly polarized wave and the third right-hand circularly polarized wave, the antenna apparatus comprises:

a fifth phase shifter to shift a phase of a fourth left-hand circularly polarized wave signal indicating the third left-hand circularly polarized wave received from the first radiation element;

a sixth phase shifter to shift a phase of a fifth left-hand circularly polarized wave signal indicating the third left-hand circularly polarized wave from the second radiation element;

a seventh phase shifter to shift a phase of a fourth right-hand circularly polarized wave signal indicating the third right-hand circularly polarized wave received from the first radiation element; and an eighth phase shifter to shift a phase of a fifth right-hand circularly polarized wave signal indicating the third right-hand circularly polarized wave received from the second radiation element, wherein the control circuit estimates second polarization angles of the third left-hand circularly polarized wave and the third right-hand circularly polarized wave based on a difference between a phase of the fourth left-hand circularly polarized wave signal and a phase of the fourth right-hand circularly polarized wave signal or a difference between a phase of the fifth left-hand circularly polarized wave signal and a phase of the fifth right-hand circularly polarized wave signal, the control circuit estimates second arrival directions of the third left-hand circularly polarized wave and the third right-hand circularly polarized wave based on a difference between a phase of the fourth left-hand circularly polarized wave signal and a phase of the fifth left-hand circularly polarized wave signal or a difference between a phase of the fourth right-hand circularly polarized wave signal and a phase of the fifth right-hand circularly polarized wave signal, and the control circuit determines a fifth phase shift amount in the fifth phase shifter, a sixth phase shift amount in the sixth phase shifter, a seventh phase shift amount in the seventh phase shifter and an eighth phase shift amount in the eighth phase shifter based on the second polarization angles and the second arrival directions.

15. The antenna apparatus according to claim 14, wherein the first radiation element receives a fourth left-hand circularly polarized wave orthogonal to the third left-hand circularly polarized wave and a fourth right-hand circularly polarized wave orthogonal to the third right-hand circularly polarized wave, the fifth phase shifter shifts a phase of a sixth left-hand circularly polarized wave signal indicating the fourth left-hand circularly polarized wave received from the first radiation element by the fifth phase shift amount, the seventh phase shifter shifts a phase of a sixth right-hand circularly polarized wave signal indicating the fourth right-hand circularly polarized wave received from the first radiation element by the seventh phase shift amount, and the antenna apparatus comprises a second composition circuit to:

generate a third received signal based on the fourth left-hand circularly polarized wave signal shifted by the fifth phase shifter and the fourth right-hand circularly polarized wave signal shifted by the seventh phase shifter, and generate a fourth received signal based on the sixth left-hand circularly polarized wave signal shifted by the fifth phase shifter and the sixth right-hand circularly polarized wave signal shifted by the seventh phase shifter.

16. The antenna apparatus according to claim 10, further comprising:

a first coupling circuit to transmit at least part of the first left-hand circularly polarized wave signal to the control circuit;

a second coupling circuit to transmit at least part of the second left-hand circularly polarized wave signal to the control circuit;

a third coupling circuit to transmit at least part of the first right-hand circularly polarized wave signal to the control circuit; and a fourth coupling circuit to transmit at least part of the second right-hand circularly polarized wave signal to the control circuit.

17. The antenna apparatus according to claim 1, further comprising:

a first mixer to change a frequency of the first left-hand circularly polarized wave signal by a first signal transmitted from the first phase shifter;

a second mixer to change a frequency of the second left-hand circularly polarized wave signal by a second signal transmitted from the second phase shifter;

a third mixer to change a frequency of the first right-hand circularly polarized wave signal by a third signal transmitted from the third phase shifter; and a fourth mixer to change a frequency of the second right-hand circularly polarized wave signal by a fourth signal transmitted from the fourth phase shifter.

18. The antenna apparatus according to claim 10, further comprising:

a first mixer to change a frequency of the first left-hand circularly polarized wave signal by a first signal transmitted from the first phase shifter;

a second mixer to change a frequency of the second left-hand circularly polarized wave signal by a second signal transmitted from the second phase shifter;

a third mixer to change a frequency of the first right-hand circularly polarized wave signal by a third signal transmitted from the third phase shifter; and a fourth mixer to change a frequency of the second right-hand circularly polarized wave signal by a fourth signal transmitted from the fourth phase shifter.

19. The antenna apparatus according to claim 1, wherein the control circuit determines the first phase shift amount and the second phase shift amount with which a first loss of a signal in the first phase shifter is substantially equivalent to a second loss of a signal in the second phase shifter, or the control circuit determines the second phase shift amount and the fourth phase shift amount with which a third loss of a signal in the second phase shifter is substantially equivalent to a fourth loss of a signal in the fourth phase shifter.

20. An antenna apparatus comprising:

a processing circuit configured to determine a polarization angle and a radiation direction of a radio wave to be radiated and generate left-hand circularly polarized wave information indicating a left-hand circularly polarized wave and right-hand circularly polarized wave information indicating a right-hand circularly polarized wave, the left-hand circularly polarized wave information and the right-hand circularly polarized wave information each having a phase corresponding to the polarization angle and the radiation direction;

a conversion circuit to convert the left-hand circularly polarized wave information to a left-hand circularly polarized wave signal and convert the right-hand circularly polarized wave information to a right-hand circularly polarized wave signal; and a plurality of radiation elements to radiate a left-hand circularly polarized wave and a right-hand circularly polarized wave in response to the left-hand circularly polarized wave signal and the right-hand circularly polarized wave signal.

* * * * *